US005659324A

United States Patent [19]

Taniguchi et al.

[11] Patent Number: 5,659,324

[45] Date of Patent: Aug. 19, 1997

[54] GLASS ANTENNA AND METHOD OF DESIGNING THE SAME

[75] Inventors: Tatsuaki Taniguchi, Hiroshima-ken; Eiichi Yamamoto, Hatsukaichi; Kenji Kubota, Kure; Kazuo Shigeta, Higashihiroshima, all of Japan

[73] Assignee: Mazda Motor Corporation, Hiroshima, Japan

[21] Appl. No.: 362,788

[22] Filed: Dec. 23, 1994

[30] Foreign Application Priority Data

| | | | |
|---|---|---|---|
| Dec. 28, 1993 | [JP] | Japan | 5-337355 |
| Jul. 15, 1994 | [JP] | Japan | 6-164429 |
| Aug. 30, 1994 | [JP] | Japan | 6-205767 |

[51] Int. Cl.[6] ..... H01Q 1/32

[52] U.S. Cl. ..... 343/713; 343/704

[58] Field of Search ..... 343/713, 704, 343/711, 712; H01Q 1/32, 1/02

[56] References Cited

U.S. PATENT DOCUMENTS

| | | | |
|---|---|---|---|
| 4,155,090 | 5/1979 | Kuroyanagi et al. | 343/713 |
| 5,029,308 | 7/1991 | Lindenmeier et al. | 343/713 |
| 5,119,106 | 6/1992 | Murakami | 343/713 |

FOREIGN PATENT DOCUMENTS

| | | |
|---|---|---|
| 0 411 963 A2 | 2/1991 | European Pat. Off. . |
| 0 506 334 A1 | 9/1992 | European Pat. Off. . |
| 0 562 607 A2 | 9/1993 | European Pat. Off. . |
| 0 588 514 A1 | 3/1994 | European Pat. Off. . |
| 55-60304 | 5/1980 | Japan . |
| 62-131606 | 6/1987 | Japan . |
| 63-92409 | 6/1988 | Japan . |
| 4-59606 | 5/1992 | Japan . |
| 5-14028 | 1/1993 | Japan . |

*Primary Examiner*—Hoanganh T. Le

[57] ABSTRACT

A glass antenna having a defogger and an antenna conductor each extending on a glass comprises a first antenna conductor element extending along the glass surface and a second antenna conductor element which extends upward and downward along the glass surface substantially at the center of the defogger in a vehicle width direction in the region to which the defogger extends and a portion of which is coupled to a heating wire of the defogger through a direct current, wherein the first antenna conductor element is disposed to the defogger so that the heating wire connected the second antenna conductor element is coupled to the first antenna conductor element through capacitive coupling with a capacitance of about 40 pF or less.

57 Claims, 58 Drawing Sheets

| COUPLING CAPACITANCE | SHORTENING RATIO |
|---|---|
| 5pF | 0.7 |
| 8pF | 0.68 |
| 10pF | 0.75 |
| 15pF | 0.84 |
| 25pF | 0.95 |
| 40pF | 1.0 |

AVERAGE VALUE IN THE RANGE OF EVALUATED FREQUENCY (dB)

| | Pw-AV |
|---|---|
| ■ (ENTIRELY ADHERED) | −8.7 |
| TWO-HORIZONTAL-LINES-SQUARE SHAPE | −8.7 |
| CROSS-IN-SQUARE SHAPE | −8.8 |
| TRIANGLE SHAPE | −9.1 |
| INVERSED T SHAPE | −9.7 |

AVERAGE VALUE IN THE RANGE OF EVALUATED FREQUENCY (dB)

| | Pw-AV |
|---|---|
| ■ (ENTIRELY ADHERED) | − 11.0 |
| TWO-HORIZONTAL-LINES-SQUARE SHAPE | − 11.0 |
| CROSS-IN-SQUARE SHAPE | − 11.1 |
| TRIANGLE SHAPE | − 11.0 |
| INVERSED T SHAPE | − 12.3 |

AVERAGE DATA TEST (dB)

| | Pw-Ave |
|---|---|
| FED AT UPPER CENTER POSITION (63cm) | −10.8 |
| 13TH STAGE (57cm) | −10.0 |
| 11TH STAGE (51cm) | −9.4 |
| 9TH STAGE (45cm) | −8.9 |
| 8TH STAGE (42cm) | −8.5 |

AVERAGE DATA TEST (dB)

| | Pw-Ave |
|---|---|
| 8TH STAGE (42cm) | − 8.5 |
| 7TH STAGE (39cm) | − 8.5 |
| 5TH STAGE (33cm) | − 8.8 |
| 3RD STAGE (27cm) | − 9.8 |
| 1ST STAGE (21cm) | − 11.6 |

AVERAGE DATA TEST (dB)

| | Pw-Ave |
|---|---|
| 1ST STAGE (21cm) | − 11.6 |
| 0TH STAGE (18cm) | − 12.9 |
| 4mm ABOVE DEFOGGER | − 13.1 |
| 1cm ABOVE DEFOGGER | − 13.4 |
| 15mm ABOVE DEFOGGER | − 13.7 |

AVERAGE DATA TEST (dB)

| | Pw-Ave |
|---|---|
| 15mm ABOVE DEFOGGER | − 13.7 |
| 3cm ABOVE DEFOGGER | − 14.6 |
| 5cm ABOVE DEFOGGER | − 16.2 |
| 10cm ABOVE DEFOGGER | − 20.9 |
| 1cm REMAINED | − 26.9 |

AVERAGE DATA TEST (dB)

| | Pw-Ave |
|---|---|
| 15TH STAGE | −8.8 |
| 13TH STAGE | −8.0 |
| 11TH STAGE | −7.4 |
| 9TH STAGE | −6.9 |
| 8TH STAGE | −6.7 |

AVERAGE DATA TEST (dB)

| | Pw-Ave |
|---|---|
| 8TH STAGE | − 6.7 |
| 7TH STAGE | − 6.6 |
| 5TH STAGE | − 6.7 |
| 3RD STAGE | − 7.6 |
| 1ST STAGE | − 9.4 |

AVERAGE DATA TEST (dB)

| | Pw-Ave |
|---|---|
| 1ST STAGE | − 9.4 |
| 0TH STAGE | − 10.7 |
| 1cm ABOVE DEFOGGER | − 11.1 |
| 15mm ABOVE DEFOGGER | − 11.4 |

AVERAGE DATA TEST (dB)

| | Pw-Ave |
|---|---|
| 15mm ABOVE DEFOGGER | − 11.4 |
| 3cm ABOVE DEFOGGER | − 12.3 |
| 5cm ABOVE DEFOGGER | − 14.0 |
| 10cm ABOVE DEFOGGER | − 18.7 |
| 1cm REMAINED | − 25.3 |

AVERAGE VALUE IN THE RANGE OF EVALUATED FREQUENCY (dB)

| | Pw-AV |
|---|---|
| LONGITUDINAL LINE 70cm | −8.5 |
| DEFOGGER 8TH STAGE (41.5cm) | −8.8 |
| DEFOGGER 4TH STAGE (29.5cm) | −6.1 |
| DEFOGGER 2nd STAGE (23.5cm) | −9.5 |

AVERAGE VALUE IN THE RANGE OF EVALUATED FREQUENCY (dB)

| | Pw-AV |
|---|---|
| DEFOGGER LOWRMOST STAGE (65.5cm) | −10.8 |
| DEFOGGER 10TH STAGE (47.5cm) | −8.9 |
| DEFOGGER 4TH STAGE (29.5cm) | −17.2 |
| DEFOGGER 2nd STAGE (23.5cm) | −20.8 |

GLASS ANTENNA AND METHOD OF DESIGNING THE SAME

BACKGROUND OF THE INVENTION

1. Field of the Invention

The present invention relates to a glass antenna disposed on a window glass of vehicles and the like and a method of designing the same.

2. Description of the Related Art

In general, there is widely known a pole antenna having a pole (rod) projected from a vehicle body in an insulated state and power is supplied thereto as an antenna for vehicles. Since the pole antenna is liable to be bent and broken and further produces noise while it travels with a swing of its body, a glass antenna is put into practical use as an antenna in place of it.

As disclosed in Japanese Utility Model Publication No. 63-92409, for example, the glass antenna has an antenna wire disposed in the vicinity of the side portion of a defogger mounted on the window glass of vehicles and electric current is fed to the antenna wire.

The conventional glass antenna, however, has a problem that since the receiving performance of the antenna is tuned by disposing the antenna wire near to the defogger, a qualitative method is not employed to improve the performance of the antenna, tuning is indefinite and difficult to be predicted as well as the arrangement of the antenna itself is complex.

Different from the above glass antenna, as disclosed in Japanese Patent Publication No. 62-131606, there is proposed an antenna composed of a transparent electric conductor film disposed on a glass surface and an antenna body with a current feeding point disposed on the glass surface above the electric conductor film with the antenna body being coupled with the transparent electric conductor film through a capacitor.

According to U.S. Pat. No. 5,029,308, a first antenna conductor extends upward and downward substantially at the center of a defogger region in which defogger heating wires are stretched and the first antenna conductor is electrically connected to the heating wires across it. Further, a second antenna conductor is disposed at the upper portion (or lower portion) of the defogger so that it is coupled to the heating wire at the uppermost portion (or lowermost portion) of the defogger. That is, the first antenna conductor and the second antenna conductor act as a single antenna. When the first antenna conductor is coupled to the second antenna conductor, a direct current flowing to the defogger is divided to the first antenna conductor and a defogging effect is lowered in the vicinity of the above connection. To cope with this problem, the U.S. Pat. No. 5,029,308 discloses a capacitor disposed between the first antenna conductor and the second antenna conductor to prevent the division of the current flow from the defogger to the first antenna conductor. Note, a capacitor having a capacitance which does not have a high impedance (preferably as low as possible) in a receiving frequency band is selected as the capacitor so that the first antenna conductor and the second antenna conductor act as the single antenna.

Japanese Patent Publication No. 55-60304 disposes a first antenna conductor upward and downward in a defogger region and a second antenna conductor outside the defogger region. Then, a first conductor wire and a second conductor wire are disposed on a glass surface in such a manner that the first conductor wire is coupled to the first conductor perpendicularly to it (i.e., parallel with a defogger heating wire) and the second conductor wire is coupled to the second antenna conductor in parallel with the first conductor, and these first and second conductor wires are placed close to each other and connected through capacitive coupling.

The conventional examples proposed above (Japanese Utility Model Publication No. 63-92409 and Japanese Patent Publication No. 62-131606) connect the antenna body to the transparent electric conductor film through capacitive coupling. When a thin electric conductor film is employed to secure the transparency of the electric conductor film to thereby secure the transparency of a glass, however, the electric conductor film cannot help having a high electric resistance value by which the flow of a received current is interfered. Thus, there is a possibility that an excellent performance of the antenna cannot be expected in practical use.

U.S. Pat. No. 5,029,308 is defective in that since the capacitor is selected to have a low impedance in the frequency region of a radio wave to be received, the defogger heating wire acts as an antenna and thus a heating current flowing to the heating wire affects the antenna and eventually the performance of the antenna is deteriorated.

Since Japanese Patent Publication No. 55-60304 does not take the configuration of the antenna disposed outside the defogger into consideration similarly to U.S. Pat. No. 5,029,308, in other words, since it does not prevent the defogger heating wire from acting as an antenna, the performance of the antenna is lowered.

Since these conventional glass antennas intrinsically have an inferior antenna receiving performance, they are required to improve a receiving performance by the addition of an antenna booster for amplifying a voltage induced to the antenna and a matching circuit for converting the impedance of the antennas into the same value of the impedance of a radio receiver when they are put into practical use. Therefore, the amount of manpower necessary to assemble the antenna and a manufacturing cost are increased, and the antenna becomes large and complex in its structure.

SUMMARY OF THE INVENTION

Taking the above problems into consideration, an object of the present invention is to propose a glass antenna capable of achieving characteristics near to those of a pole antenna.

Another object of the present invention is to propose a glass antenna capable of reducing the effect of a defogger.

To achieve the above objects, the present invention is fundamentally arranged such that a first antenna conductor element is disposed outside a defogger and a second antenna conductor element is disposed in the region of the defogger, further the defogger is partially connected to the second antenna conductor element and the heating wire of the defogger is coupled to the first antenna conductor element through capacitive coupling.

Still another object of the present invention is to provide a glass antenna having a defogger and an antenna conductor each extending on a glass, the antenna conductor having a first antenna conductor element to which electric current is fed from a current feeding point disposed below or above the defogger and extending along the glass surface, and a second antenna conductor element extending upward and downward along the glass surface in a region where the defogger extends and a portion of which is coupled to a heating wire of the defogger through a direct current, the glass antenna is characterized by the first antenna conductor element being disposed with respect to the defogger so that the heating wire connected to the portion of the second antenna conductor element is coupled to a portion of the first antenna conductor element through capacitive coupling, and by the following relation being satisfied $$\beta\cdot\lambda/4=L+\alpha\cdot Y$$

where, the length of the first antenna conductor element in a direction perpendicular to a vehicle width direction is L, an antenna shortening ratio by the capacitive coupling is $\alpha$, an antenna shortening ratio by glass is $\beta$, the wavelength of a radio wave to be received is $\lambda$, and the length of the defogger in the vehicle width direction is 2Y, whereby the effect of the defogger can be reduced. Since the coupling capacitance is properly set in the glass antenna arranged as described above, the impedance of the heating wire of the defogger is greatly increased and the effect of the heating wire can be reduced to a negligible level.

A further object of the present invention is to provide, for the purpose of reducing the effect of a defogger, a method of designing a glass antenna, the glass antenna having a flat glass, the defogger disposed on the glass, a first antenna conductor element to which electric current is fed from a current feeding point disposed below or above the defogger and extending along the glass surface, and a second antenna conductor element extending upward and downward along the glass surface in a region where the defogger extends and a portion of which is coupled to a heating wire of the defogger through a direct current, wherein the glass antenna design method is characterized by comprising the steps of determining the length of the first antenna conductor element in a direction perpendicular to a vehicle width direction L based on $$\beta\cdot\lambda/4=L+\alpha\cdot Y$$

where, an antenna shortening ratio by the capacitive coupling is $\alpha$, an antenna shortening ratio by glass is $\beta$, the wavelength of a radio wave to be received is $\lambda$, and the length of the defogger in the vehicle width direction is 2Y; and determining the upward and downward length of the second antenna conductor element X based on $$L+\alpha\cdot X=L_x$$

where, $L_x$ is the length of an optimum unipole type antenna in order that the first antenna conductor element is disposed to the defogger so that the heating wire connected to the portion of the second antenna conductor element is coupled to a portion of the first antenna conductor element through capacitive coupling. According to the design method, since the characteristics of the antenna can be quantitatively changed, a vehicle body can be properly designed and adjusted with ease in a very short period of time.

A further object of the present invention is to provide a glass antenna for receiving an FM radio wave including a defogger having a length 2Y in a vehicle width direction and a first antenna conductor element having a length L in the direction perpendicular to the vehicle width direction, each extending on a glass, which comprises a current feeding point disposed below or above the defogger, the first antenna conductor element to which electric current is fed from the current feeding point and extending along the surface, and a second antenna conductor element, extending upward and downward along the glass surface in a region where the defogger extends and a portion of which is coupled to a heating wire of the defogger through a direct current, the glass antenna is characterized by the first antenna conductor element being disposed with respect to the defogger so that the heating wire connected to the portion of the second antenna conductor element is coupled to a portion of the first antenna conductor element through capacitive coupling and $$20\ cm\leqq L+\alpha\cdot Y\leqq 70\ cm$$

is satisfied, where $\alpha$ is an antenna shortening ratio by the capacitive coupling, whereby the effect of the defogger can be reduced.

A further object of the present invention is to provide a glass antenna for receiving a TV radio wave including a defogger having a length 2Y in a vehicle width direction and a first antenna conductor element having a length L in the direction perpendicular to the vehicle width direction, each extending on a glass, which comprises a current feeding point disposed below or above the defogger, the first antenna conductor element to which electric current is fed from the current feeding point and extending along the surface, and a second antenna conductor element extending upward and downward along the glass surface in a region where the defogger extends and a portion of which is coupled to a heating wire of the defogger through a direct current, the glass antenna is characterized by the first antenna conductor element being disposed with respect to the defogger so that the heating wire connected to the portion of the second antenna conductor element is coupled to a portion of the first antenna conductor element through capacitive coupling and $$10\ cm\leqq L+\alpha\cdot Y\leqq 60\ cm$$

is satisfied, where $\alpha$ is an antenna shortening ratio by the capacitive coupling, whereby the effect of the defogger can be reduced.

A further object of the present invention is to provide a glass antenna having a defogger and an antenna conductor each extending on a glass, which comprises a current feeding point disposed below or above the defogger, a first antenna conductor element to which electric current is fed from the current feeding point and extending along the surface, and a second antenna conductor element extending upward and downward along the glass surface in a region where the defogger extends and a portion of which is coupled to a heating wire of the defogger through a direct current, the glass antenna is characterized by the first antenna conductor element having a length L perpendicular to a vehicle width direction, the second antenna conductor element having a length X perpendicular to a vehicle width direction, and the first antenna conductor element is disposed to the defogger so that the heating wire connected to the portion of the second antenna conductor element is coupled to a portion of the first antenna conductor element through capacitive coupling and $$20\ cm\leqq L+\alpha\cdot X\leqq 70\ cm$$

is established, where $\alpha$ is an antenna shortening ratio by the capacitive coupling, whereby the effect of the defogger can be reduced. The glass antenna arranged as described above can further reduce the effect of the heating wire of the defogger.

A further object of the present invention is to provide a glass antenna having a defogger and an antenna conductor each extending on a glass, which is characterized by comprising a current feeding point disposed below or above the defogger, a substantially-loop-shaped first antenna conductor element to which electric current is fed from the current feeding point and extending along the surface, and a second antenna conductor element extending upward and downward along the glass surface in a region where the defogger extends and a portion of which is coupled to a heating wire of the defogger through a direct current, and characterized by the first antenna conductor element being disposed with respect to the defogger so that the heating wire connected to the portion of the second antenna conductor element is coupled to a portion of the first antenna conductor element through capacitive coupling, whereby the effect of the defogger can be reduced.

A further object of the present invention is to provide a glass antenna having a defogger and an antenna conductor each extending on a glass, which comprises a current feeding point disposed below or above the defogger, a first antenna conductor element to which electric current is fed from the current feeding point and extending along the glass surface, and a second antenna conductor element extending upward and downward along the glass surface in a region where the defogger extends and a portion of which is coupled to a heating wire of the defogger through a direct current, the glass antenna characterized by the first antenna conductor element being disposed with respect to the defogger so that the heating wire connected to the portion of the second antenna conductor element is coupled to a portion of the first antenna conductor element through capacitive coupling with a capacitance of about 40 pF or less, whereby the effect of the defogger can be reduced.

According to one aspect of the present invention, the receiving sensitivity of a glass antenna can be improved as compared with that of prior art antenna by forming the first antenna conductor element in a loop shape.

According to one aspect of the present invention, a glass antenna can obtain characteristics nearer to those of a pole antenna by setting the coupling capacitance to 40 pF or less or about 2 pF to 20 pF or less.

According to one aspect of the present invention, a glass antenna having an excellent receiving sensitivity can be obtained by setting the length of the first antenna conductor element in the vehicle width direction to the range of from 50 mm to 300 mm.

According to one aspect of the present invention, an antenna having a high sensitivity can be obtained by forming the first antenna conductor element to a preferable loop shape such as "two-horizontal-line-in square", "a-horizontal-line-in-square" and the like.

According to one aspect of the present invention, the defogger can be set to another frequency region (e.g., the reception of AM broadcasting) by providing the defogger with a minus bus bar and connecting an apex of the loop conductor to the bus bar. Thus, the antenna can be used as an antenna for another frequency region.

According to one aspect of the present invention, since the current feeding point is directly connected to a radio receiver through a feeder cable, an antenna booster and the like which are needed with a conventional glass antenna having a low receiving sensitivity become unnecessary, whereby cost can be reduced.

According to one aspect of the present invention, since the first antenna conductor element includes at least two antenna elements spaced apart from each other, a diversity system or an antenna backup system having an excellent performance can be easily arranged.

According to one aspect of the present invention, since the first antenna conductor element is surrounded by the defogger, an area capable of being defogged is increased.

According to one aspect of the present invention, since the gap between the first antenna conductor element and the heating wire of the defogger to be connected thereto through capacitive coupling is set in the range of from 1 mm to 50 mm or the range of from 2 mm to 35 mm, a frequency having a maximum receiving sensitivity can be easily set, and in particular this is effective when a diversity system is arranged.

According to one aspect of the present invention, since the second antenna conductor element is disposed substantially at the center in the vehicle width direction, a glass antenna having a good outward appearance can be obtained.

DETAILED DESCRIPTION OF THE PREFERRED EMBODIMENTS

Embodiments of the present invention will be described below with reference to the drawings. Note, the following embodiments are examples of the present invention applied to a glass antenna for vehicles and in particular to an antenna disposed on a rear glass. In the description of the respective embodiments, a term "left" means the left side of a vehicle body, a term "right" means the right side thereof, a term "upper" means the upper side thereof, and a term "lower" means the lower side thereof.

First, various embodiments of the present invention will be described by describing a first embodiment to a sixth embodiment, then a reason why the effect of a defogger on an antenna can be reduced, which is a feature common to the first to sixth embodiments, will be clarified. Next, a seventh embodiment will be described as the most preferable embodiment of the present invention. In addition, an eighth embodiment will be further described.

[First Embodiment]

Figure 2:
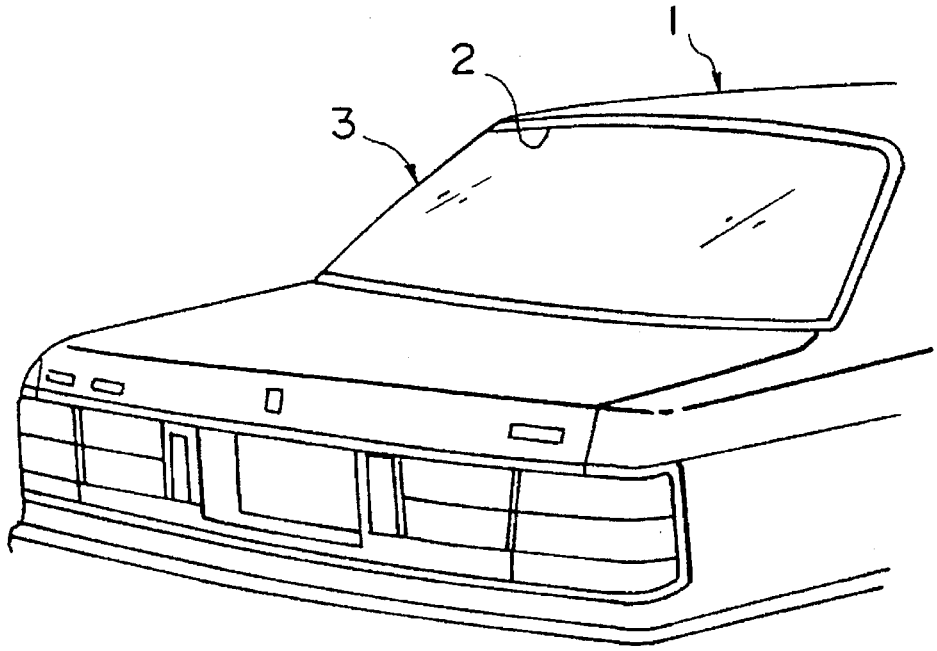
FIG. 2 is a perspective view showing the rear portion of a vehicle.

FIG. 2 shows the rear portion of a vehicle relating to the first to eighth embodiments of the present invention, wherein numeral 1 denotes the body of a vehicle, a rear window 2 is opened to the rear portion of the body 1 and a rear window glass 3 (hereinafter, simply referred to as a window glass) is substantially air tightly attached to the rear window 2.

Figure 1:
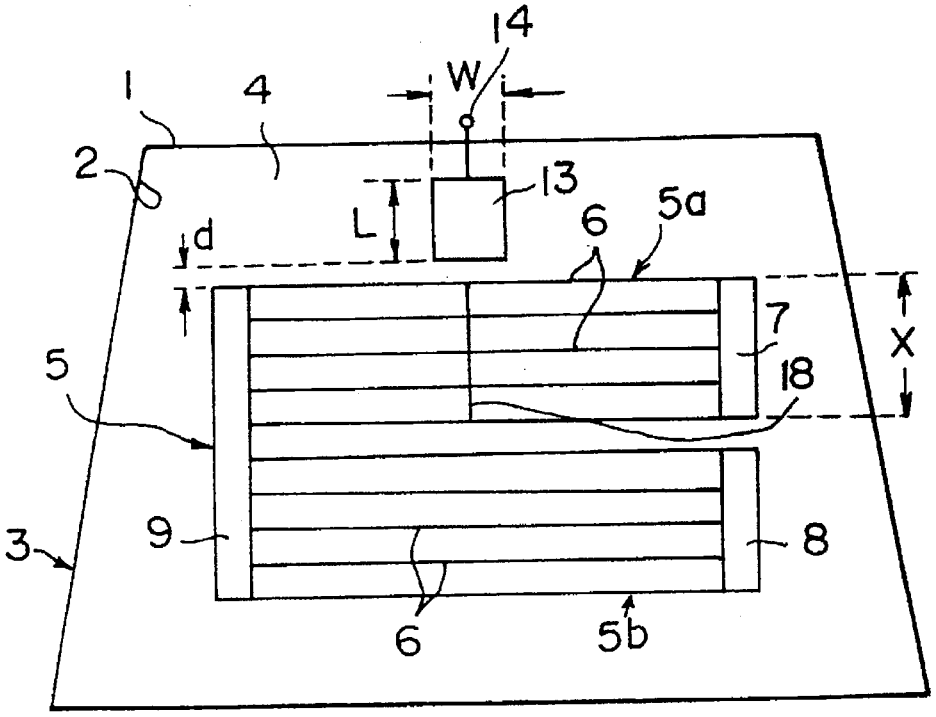
FIG. 1 is a plan view of the rear window of a vehicle according to a first embodiment of the present invention viewed from a direction perpendicular to the surface of a window glass.

As shown in FIG. 1, a rear defogger 5 is disposed on the inside of the window glass 3 in a compartment in such a manner that the defogger 5 is spaced apart from the upper edge of the window glass 3 by a space portion 4 having a predetermined size and the center in the right and left direction of the defogger 5 substantially coincides with the center in the right and left direction of the window glass 3. The defogger 5 has an upper stage portion 5*a* and a lower stage portion 5*b* and is formed to a C-shape. Further, the defogger 5 has a plurality of heater wires 6, 6 . . . (heating wires) which extend to the right and left in a vehicle width direction and are divided into upper stage heating wires 6 and lower stage heating wires 6, . . . The ends on one side (right side) of the upper stage heating wires 6, 6 . . . and the ends on one side (right side) of the lower stage heating wires 6, 6 . . . are connected to each other through independent bus bars 7, 8, respectively, and the ends on the other side (left side) of the entire heating wires 6, 6 . . . are connected to each other through a common bus bar 9.

Note, although not shown, the upper side bus bar 7 is grounded to the body 1 and serves as the ground of the defogger 5 and the lower independent bus bar 8 is coupled to the + terminal of a vehicle mounted battery through a not shown switch. When the switch is turned on, electric current is fed from the battery to the respective heating wires 6 of the defogger 5 so that the heating wires 6 are heated to defog surface of the glass window 3.

Note, in this specification, the arrangement that the ends on the left side of the upper stage heating wires 6, 6 . . . and the lower stage heating wires 6, 6 . . . are connected to each other through the independent bus bars 7, 8 and the ends on the right side of the entire heating wires 6, 6 . . . are connected to each other through the common bus bar 9, that is, a defogger whose right and left sides are upset with respect to the first embodiment is also referred to as a C-shape.

Further, as one of the features of the present invention, a rectangular electric conductor sheet 13 comprised of a conductor having a right to left width W and a vertical length L is adhered, at the center in the right and left direction of the window glass, to the inner surface of the space portion 4 facing the compartment above the defogger 5 in the window glass 3 with a gap d from the upper end of the defogger 5. A power feed wire extending from one end of a coaxial feeder cable 14 is coupled to the electric conductor sheet 13 at the upper end at the center in the right and left direction thereof and the shield conductor at the end of the coaxial feeder cable 14 is grounded to the body 1 at the center in the right and left direction thereof on the upper side of the periphery of the rear window 2. Although not shown, the other end of the coaxial feeder cable 14 is connected to a vehicle mounted radio receiver and the like.

Further, an electric conductor wire 18 (short bar), which is comprised of a conductor wire having a predetermined length X, extends from the upper end of the upper stage portion 5*a* downwardly, is disposed at the center of the defogger 5 in the right and left direction thereof. The heating wires 6, 6 . . . stretched between the upper independent bus bar 7 and the common bus bar 9 in the upper stage portion 5*a* of the defogger 5 are connected to each other through the electric conductor wire 18.

When the gap d between the lower end of the electric conductor sheet 13 and the upper end of the defogger 5 is less than 1 mm, the electric conductor sheet 13 cannot be securely isolated from the defogger 5, whereas when the gap d exceeds 50 mm, the effect of the defogger 5 to the electric conductor sheet 13 cannot be kept in a preferable state and the antenna is made similar to an antenna composed only of the electric conductor sheet 13. Thus, it is preferable to set d to 1 mm–50 mm and it is more preferable to set d to 2 mm–35 mm.

It is preferable that the right to left width W of the electric conductor sheet 13 is set to 20 mm or more when a radio wave to be received is a horizontally polarized wave, and that it is set to 5 mm or more when a radio wave to be received includes a vertically polarized wave component (including a circularly polarized wave component). That is, the right to left width W of the electric conductor sheet 13 must be set to an optimum value in accordance with a radio wave to be received.

Therefore, in the above embodiment, since the glass antenna is comprised such that the defogger 5 is disposed at the center in the right and left direction of the window glass 3 of the vehicle, the electric conductor sheet 13 is disposed at the center in the right and left direction of the space portion 4 of the window glass above the defogger 5 with the gap d from the defogger 5 and electric current is fed to the electric conductor sheet 13, the electric conductor sheet 13 constituting the antenna is coupled to the defogger 5 in capacitive coupling. Moreover, since the electric conductor wire 18 extending upward and downward is disposed to the defogger 5 in correspondence with the electric conductor sheet 13, a kind of a pole type antenna is arranged which includes the electric conductor sheet 13 and the electric conductor wire 18 in the region of the defogger 5. As a result, the receiving performance of the antenna can be enhanced.

Further, the defogger 5 is usually disposed on the window glass 3 of a vehicle and the glass antenna is arranged only by disposing the electric conductor sheet 13 in the space portion 4 above the defogger 5, the performance of the antenna can be improved by a simple arrangement making use of the glass on which the defogger is disposed.

The receiving performance of the antenna is not almost changed even if the power feed position from which electric current is fed to the electric conductor sheet 13 is changed. Therefore, the power supply position of the electric conductor sheet 13 can be optionally set and when restriction is imposed on the power feed position, the position may be changed, thus this type of the antenna is advantageous as a vehicle antenna.

The receiving sensitivity characteristics of the antenna can be set by adjusting the length X of the electric conductor wire 18 disposed to the defogger 5, the gap d between the lower end of the electric conductor sheet 13 and the upper end of the defogger 5 and the right to left width W of the electric conductor sheet 13. That is, a frequency having a maximum receiving sensitivity of the antenna can be set by adjusting the length X of the electric conductor wire 18, and the longer the length of the electric conductor wire 18 is, a frequency band having a maximum receiving sensitivity moves to a lower frequency band.

A frequency having a maximum receiving sensitivity can be also set by adjusting the gap d between the electric conductor sheet 13 and the defogger 5.

Further, a frequency having a maximum receiving sensitivity can be set by adjusting the right to left width W of the electric conductor sheet 13, and when the right to left width W is increased, a value enabling the receiving sensitivity to be maximized is obtained in the midway of the increase of the width, and when the width is increased exceeding the value, the receiving sensitivity is lowered.

In addition, when the right to left width W of the electric conductor sheet 13 is reduced, if the gap between the electric conductor sheet 13 and the defogger 5 is reduced, the same receiving performance as that obtained when the right to left width W is increased can be obtained. Therefore, the respective values of the length X of the electric conductor wire 18, the gap d between the lower end of the electric conductor sheet 13 and the upper end of the defogger 5, the right to left width of the electric conductor sheet 13 may be set to suitable values corresponding to frequencies to be received depending upon the aforesaid qualitative characteristics, the detail of which will be described below.

[Second Embodiment]

Figure 3:
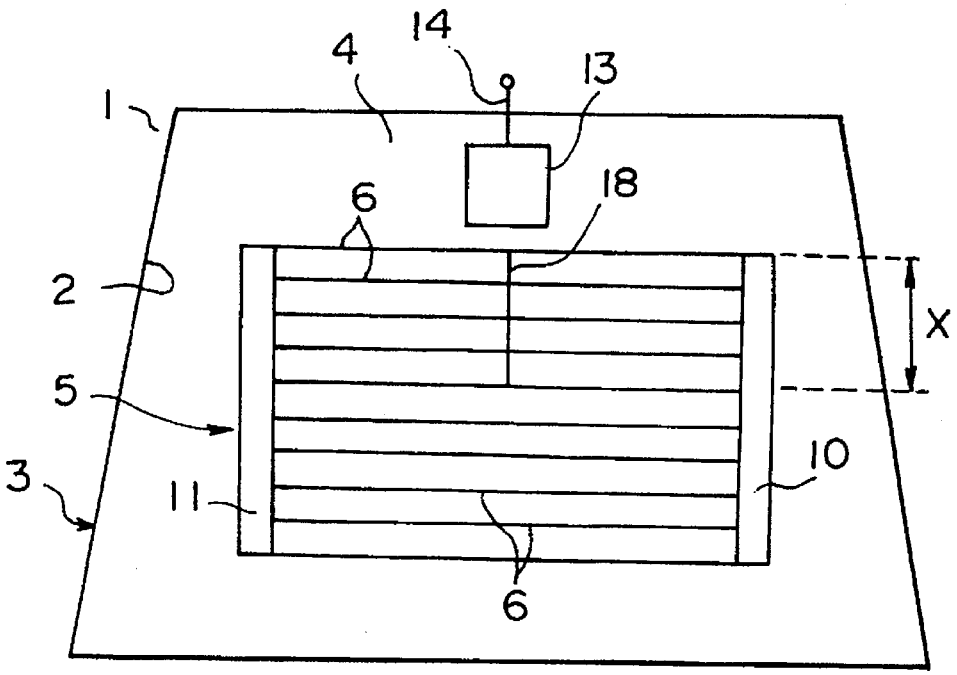
FIG. 3 is a plan view corresponding to FIG. 1 to show a second embodiment.

FIG. 3 shows the second embodiment (note, the same numerals as used in FIG. 1 are used to denote the same parts in the following embodiments) which is applied to a window glass 3 provided with a defogger 5 different from that used in the embodiment 1.

That is, in the second embodiment, the defogger 5 to be disposed on the inner surface of the window glass includes a plurality of heating wires 6, 6, . . . extending to the right and left in a vehicle width direction and the ends of one side (right side) of the heating wires 6, 6, . . . are connected to each other through a ground side bus bar 10 and the ends of the other side (left side) thereof are connected to each other through a power feed side bus bar 11, respectively. Although not shown, the ground side bus bar 10 is grounded to a body 1 and serves as the ground of the defogger 5 and the power feed side bus bar 11 is coupled to the + terminal of a vehicle mounted battery.

Further, an electric conductor wire 18 having a length X is disposed to the center in the right and left direction of the defogger 5 and extends from the upper end thereof downwardly. The heating wires 6, 6 . . . stretched between the bus bars 7 and 8 in the defogger 5 are connected to each other through the electric conductor wire 18.

An electric conductor sheet 13 is disposed to a glass space portion 4 above the defogger 5 at the center in the right and left direction thereof which corresponds to the position of the electric conductor wire 18. The other arrangement of the second embodiment is the same as that of the first embodiment.

Therefore, this embodiment can also achieve the same functions and effects as those of the first embodiment.

[Embodiment 3]

Figure 4:
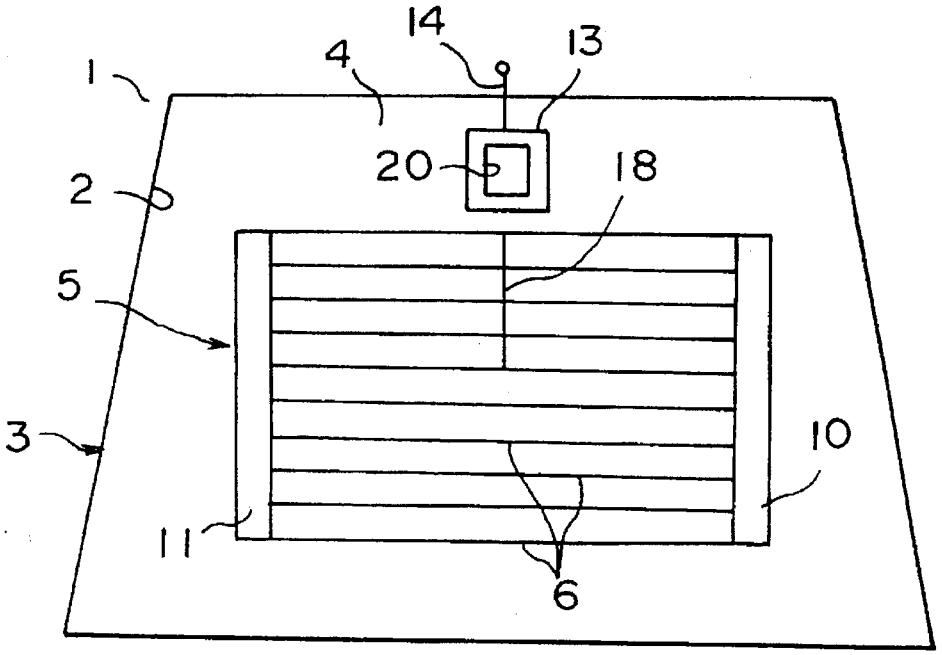
FIG. 4 is a plan view corresponding to FIG. 1 to show a third embodiment.

FIG. 4 shows the third embodiment which forms a space portion in an electric conductor sheet 13 in the arrangement of the second embodiment and the electric conductor sheet 13 is composed of an equivalent and uniform conductor.

More specifically, in the third embodiment, the rectangular space portion 20 is formed in the rectangular electric conductor sheet 13 so that the electric conductor sheet 13 is formed to a shape having an empty portion therein. The part of a glass 3 corresponding to the space portion 20 is used as a space where the antenna (not shown) of a vehicle mounted telephone is installed.

Therefore, although the space portion 20 is formed in the rectangular electric conductor sheet 13 and the electric conductor sheet 13 is formed to the shape having the empty portion therein in the second embodiment, the electric conductor sheet 13 is equivalent to an electric conductor sheet in which the space portion 20 is not formed so that the electric conductor sheet 13 can obtain a receiving performance similar to that of the electric conductor sheet without the space portion 20.

Since the space portion 20 in the electric conductor sheet 13 composed of the equivalent and uniform conductor is used to install the telephone antenna, a space for installing the telephone antenna can be secured in the window glass 3 and the telephone antenna can be easily positioned in the window glass 3.

Note, the C-shaped defogger 5 described in the first embodiment may be used in place of the defogger 5 in the third embodiment and the same effects can be also obtained even in this case.

Various kinds of other electrical equipment such as a high mount stop lamp, sensor or the like may be installed in the space portion 20 in the electric conductor sheet 13 in place of the telephone antenna.

Figure 5:
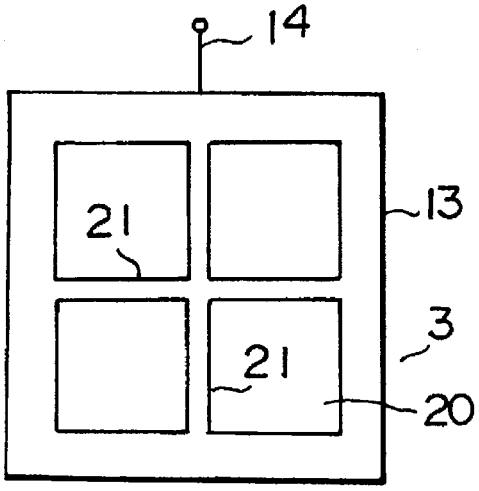
FIG. 5 is an enlarged view showing a modified example of an electric conductor sheet.

Further, as shown in FIG. 5, a single or a plurality of conductor wires 21 may be disposed in the space portion 20 of the electric conductor sheet 13, by which a similar antenna performance can be obtained.

[Embodiment 4]

Figure 6:
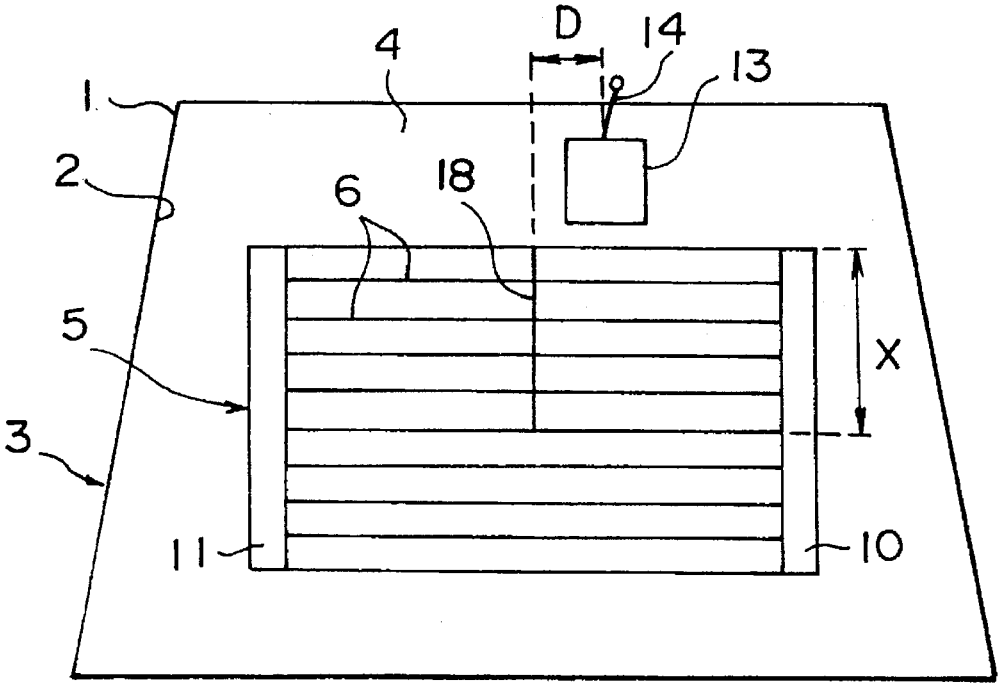
FIG. 6 is a plan view corresponding to FIG. 1 to show a fourth embodiment.

FIG. 6 shows the fourth embodiment having an electric conductor sheet 13 which is offset from the position of an electric conductor wire 18 to the right, while the electric conductor sheet 13 in the above respective embodiments is disposed just above the electric conductor wire 18 in the defogger 5.

In the fourth embodiment, a defogger 5 is disposed on a window glass 3 so that the center in the right and left direction thereof coincides with the center in the right and left direction of the glass 3 and the electric conductor wire 18 having a length X is attached to the defogger 5 at the center in the right and left direction thereof in the same way as the second embodiment.

On the other hand, the electric conductor sheet 13 disposed to a space portion 4 above the defogger 5 is offset from the center in the right and left direction of the window glass 3, i.e., from the position of the electric conductor wire 18 to one side in the right and left direction (to the right side in the illustrated example) thereof by a predetermined amount of offset D (the distance between the electric conductor sheet 13 and the electric conductor wire 18 in the right and left direction thereof).

The fourth embodiment can obtain functions and effects similar to those of the second embodiment. Therefore, this embodiment is advantageous when, for example, there is a requirement for installing other equipment such as a high mount stop light and the like at the center in the right and left direction of the window glass 3 because an antenna performance can be secured while enabling the installation of the equipment at the center of the glass 3.

Further, this embodiment is advantageous in a diversity antenna in which two antennas are disposed by being spaced apart from the center in the right and left direction of the window glass 3.

[Fifth Embodiment]

Figure 7:
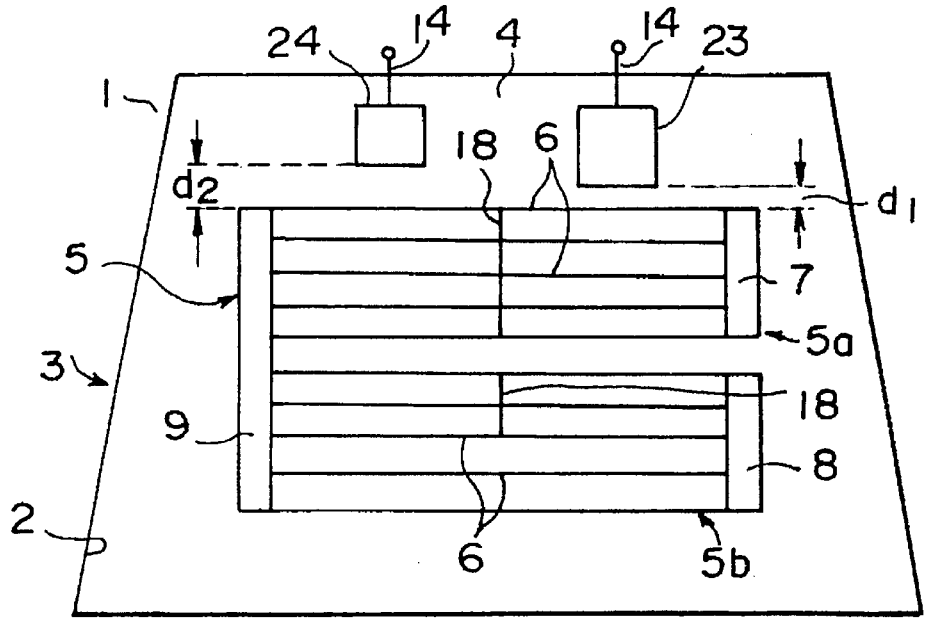
FIG. 7 is a plan view corresponding to FIG. 1 to show a fifth embodiment.

FIG. 7 shows the fifth embodiment arranged as a diversity antenna.

More specifically, in the fifth embodiment, a C-shaped defogger 5 is disposed on a window glass 3 so that the center in the right and left direction thereof coincides with the center in the right and left direction of the glass 3 and an electric conductor wire 18 is attached to the defogger 5 at the center in the right and left direction thereof in the same way as the first embodiment.

Two electric conductor sheets 23, 24 are disposed to the space portion 4 of the window glass 3 above the defogger 5 and equally spaced apart from the upper position of the electric conductor wire 18 located at the center of the defogger 5. That is, the electric conductor sheets 23, 24 are disposed symmetrically with respect to the right and left. An electric current is fed to the electric conductor sheets 23, 24 from coaxial power feed cables 14, 14 and the diversity antenna is composed of both electric conductor sheets 23, 24.

The gap $d_1$ between the right electric conductor sheet 23 and the defogger 5 is made smaller than the gap $d_2$ between the left electric conductor sheet 24 and the defogger 5 ($d_1<d_2$) and the capacitance of capacitive coupling of the right electric conductor sheet 23 with the defogger 5 is made larger than that of capacitive coupling of the left electric conductor sheet 24 with the defogger 5. With this arrangement, the right electric conductor sheet 23 having the larger capacitance of capacitive coupling with the defogger 5 is arranged as a main antenna and the left electric conductor sheet 24 having the smaller capacitance of capacitive coupling with the defogger 5 is arranged as a subantenna.

Consequently, since the electric conductor wire 18 extending upward and downward is disposed at the center in the right and left direction of the defogger 5, a pair of the right and left electric conductor sheets 23, 24 are disposed to the space portion 4 of the window glass above the defogger 5 and equally spaced apart the upper position of the electric conductor wire 18 and electric current is fed to the electric conductor sheets 23, 24, respectively in this embodiment, each of both antennas has a different directivity and receiving sensitivity so that the diversity effect of the diversity antenna can be easily predicted.

Since the gap $d_1$ between the right electric conductor sheet 23 and the defogger 5 is smaller than the gap $d_2$ between the left electric conductor sheet 24 and the defogger 5 and the capacitance of capacitive coupling of the right electric conductor sheet 23 with the defogger 5 is larger than that of capacitive coupling of the left electric conductor sheet 24 with the defogger 5, the right electric conductor sheet 23 having the larger capacitance of capacitive coupling with the defogger 5 can be used as the high sensitive main antenna, whereas the left electric conductor sheet 24 having the smaller capacitance of capacitive coupling with the defogger 5 can be used as the low sensitive subantenna.

Since the main antenna and the subantenna are set by making the magnitudes of capacitive coupling of the two electric conductor sheets 23, 24 in the space portion 4 of the glass window 3 with the defogger 5 different by changing the gaps $d_1$, $d_2$ between the two electric conductor sheets 23, 24 and the defogger 5 as described above, the main antenna and the subantenna of the diversity antenna can be easily set. Further, since each of the two electric conductor sheets 23, 24 constituting the diversity antenna has a different receiving sensitivity, they need not be used as the diversity antenna in a weal radio wave area and it suffices to use only the high sensitive main antenna composed of the electric conductor sheet 23 having the large capacitive coupling with the defogger 5, whereby an excellent receiving sensitivity can be obtained.

Although the capacitances of capacitive coupling of the electric conductor sheets 23, 24 with the defogger 5 are made different by changing the gaps $d_1$, $d_2$ between the electric conductor sheets 23, 24 and the defogger 5 in the embodiment, the capacitances of capacitive coupling of the electric conductor sheets 23, 24 with the defogger 5 can be made different by other arrangement.

Figure 8:
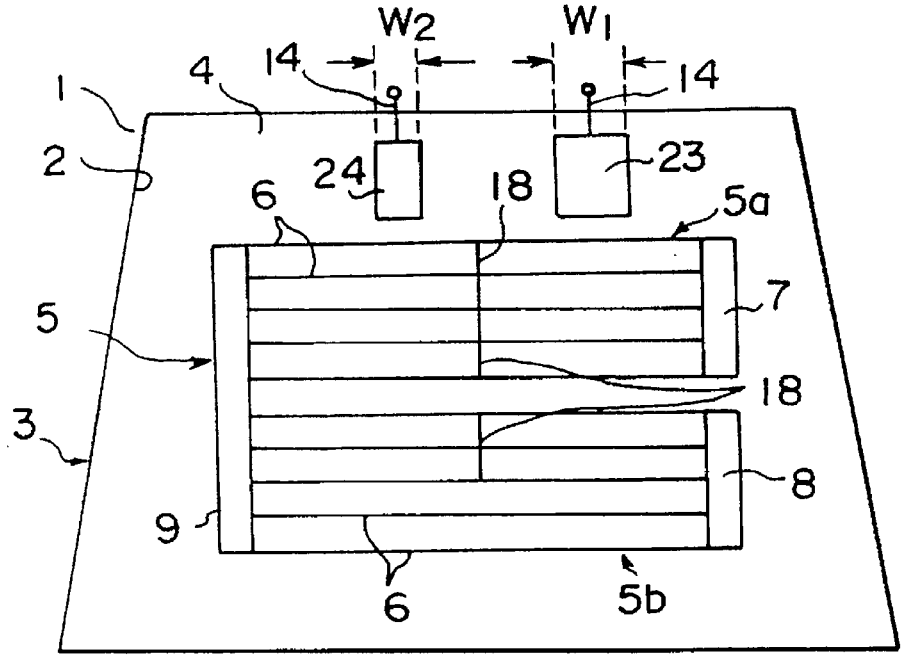
FIG. 8 is a plan view corresponding to FIG. 7 to show a modified example of the fifth embodiment.

For example, in the modified example shown in FIG. 8 in which the electric conductor sheets 23, 24 have different right to left widths W1, W2 and the main antenna of a diversity antenna is composed of the right electric conductor sheet 23, the electric conductor sheet 23 has the larger right to left width W1 so that the capacitance of the capacitive coupling of the electric conductor sheet 23 with the defogger 5 is increased, whereas the left electric conductor sheet 24 serving as a subantenna has the right to left width W2 which smaller than that of the electric conductor sheet 23 (W2<W1) and the capacitance of the capacitive coupling of the electric conductor sheet 24 with the defogger 5 is reduced. Since the capacitances of capacitive coupling of the electric conductor sheets 23, 24 with the defogger 5 can be made different only by changing the right to left widths W1, W2 of the electric conductor sheets 23, 24 even in this case, the main antenna and the subantenna can be easily set.

Figure 9:
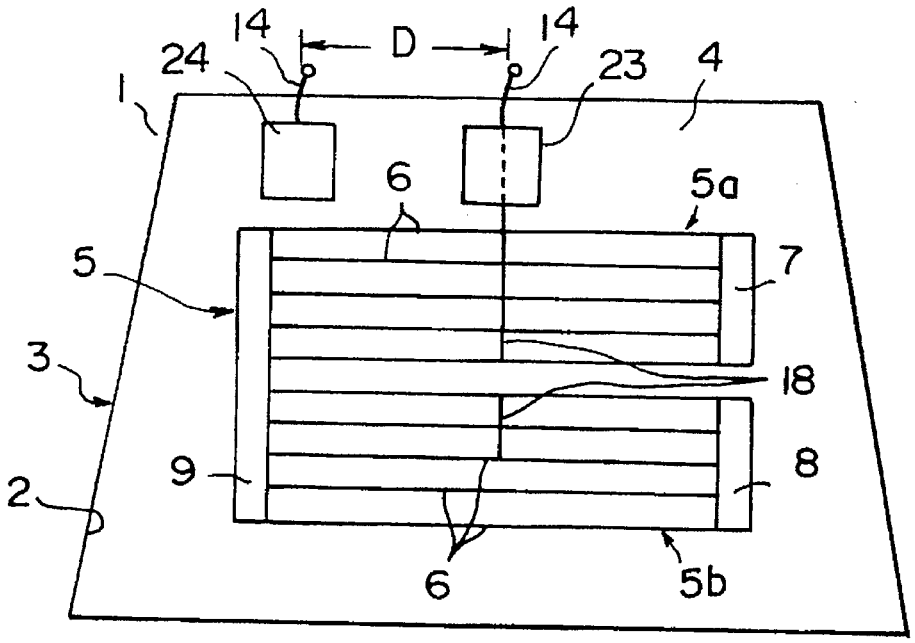
FIG. 9 is a plan view corresponding to FIG. 7 to show another modified example of the fifth embodiment.

Further, the example shown in FIG. 9 makes use of the fact that as the amounts of offset D from the center in the right and left direction of the electric conductor sheets 23, 24 are made larger than a predetermined amount, a receiving sensitivity is lowered.

Figure 10:
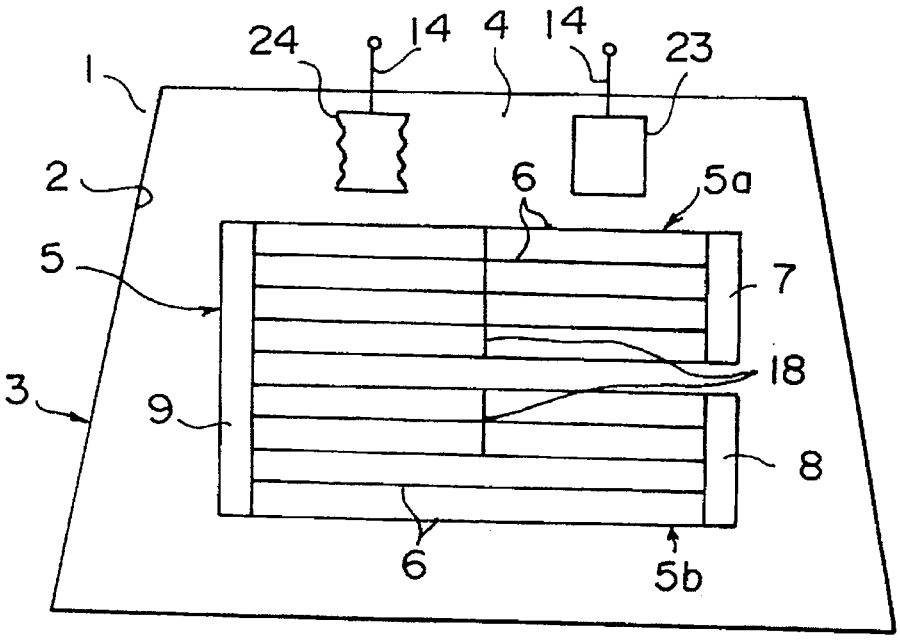
FIG. 10 is a plan view corresponding to FIG. 7 to show a further modified example of the fifth embodiment.

The example shown in FIG. 10 forms the right electric conductor sheet 23 serving as the main antenna to a rectangular shape by making use of the fact that the capacitances of capacitive coupling of the electric conductor sheets 23, 24 with the defogger 5 are made different depending upon the shape thereof, whereas the capacitance of the capacitive coupling of the left electric conductor sheet 24 serving as the subantenna with the defogger 5 is made smaller than that of the right electric conductor sheet 23 by forming it to a shape having irregularities at the right and left sides thereof (otherwise, a trapezoid, parallelogram, quadrilateral exhibiting an intermediate shape between a parallelogram and a trapezoid or the like may be employed).

Although the main antenna and the subantenna of the diversity antenna are provided by changing the capacitances of capacitive coupling of the electric conductor sheets 23, 24 with the defogger 5 in the fifth embodiment, the main antenna and the subantenna of the diversity antenna may be set in such a manner that the capacitances of capacitive coupling of the electric conductor sheets 23, 24 with the defogger 5 are previously set to predetermined values, respectively and the main antenna and the subantenna of the diversity antenna are set accordingly by changing a frequency band by which a maximum receiving sensitivity can be obtained. In this case, the electric conductor sheet 23 (or 24) corresponding to a frequency band by which a maximum receiving sensitivity can be obtained is used as the main antenna of the diversity antenna and the other electric conductor sheet 24 (or 23) is used as the subantenna thereof, so that the main antenna and the subantenna of the diversity antenna can be easily set.

Further, the number of the electric conductor sheets 23, 24 is not limited to the two sets but may be three or more sets.

[Sixth Embodiment]

Figure 11:
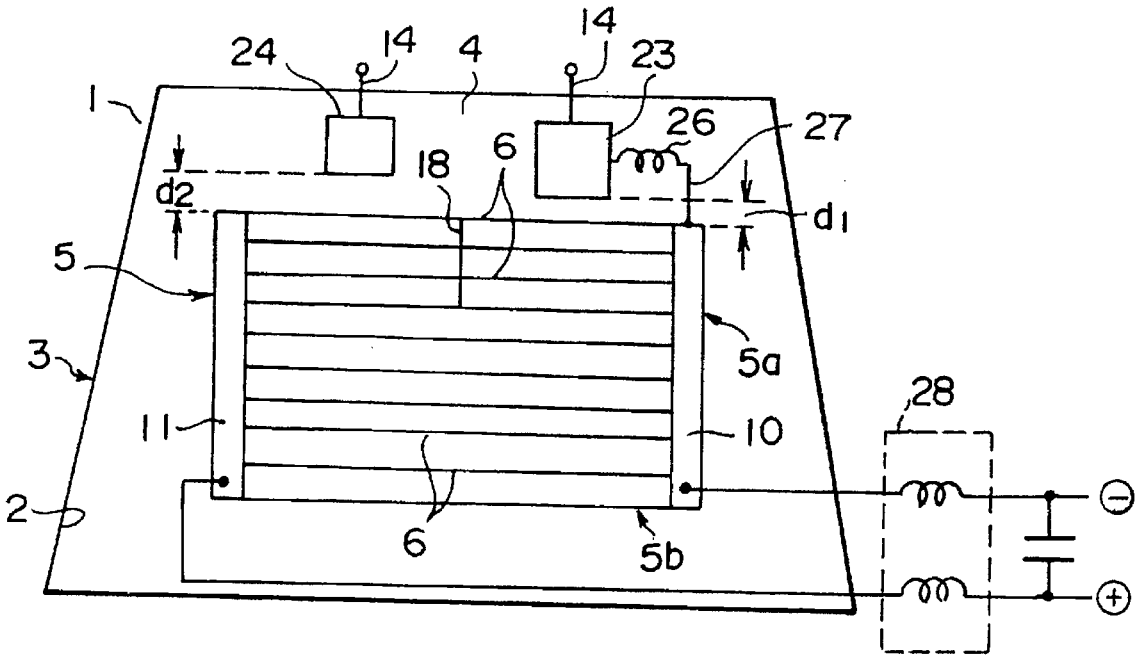
FIG. 11 is a plan view corresponding to FIG. 1 to show a sixth embodiment.

FIG. 11 shows the sixth embodiment which not only can receive an FM band radio wave by a diversity system but also can receive an AM band radio wave.

That is, the sixth embodiment has a window glass 3 provided with a defogger 5 which is the same as that of the second embodiment and an electric conductor wire 18 is disposed at the center in the right and left direction of the defogger 5.

Further, a pair of right and left electric conductor sheets 23, 24 are disposed to the glass space portion 4 above the defogger 5 symmetrically to the right and left with respect to the position of the electric conductor wire 18 to constitute a diversity antenna in the same way as the fifth embodiment.

The gap $d_1$ between a right electric conductor sheet 23 corresponding to the ground side bus bar 10 of the defogger 5 and the defogger 5 is set smaller than the gap $d_2$ between a left electric conductor sheet 24 corresponding to the power feed side bus bar 11 thereof and the defogger 5. Thus, the right electric conductor sheet 23 having a large capacitance in capacitive coupling with the defogger 5 is used as a main antenna and disposed in correspondence with the ground side bus bar 10 serving as the ground side of the defogger 5 and the left electric conductor sheet 24 having a small capacitance in capacitive coupling with the defogger 5 is used as a subantenna and disposed in correspondence with the power feed side bus bar 11 of the defogger 5, respectively.

An end of a conductor wire 27, to which a coil 26 having a predetermined capacitance for shutting off FM signals is connected in series, is coupled to the upper right end of the right electric conductor sheet 23 serving as the main antenna and the other end of the conductor wire 27 is coupled to the upper end of the ground side bus bar 10 of the defogger 5. With this arrangement, the right electric conductor sheet 23 as the main antenna of the diversity antenna is coupled to the ground side of the defogger 5 so that the electric conductor sheet 23 also serves as an AM antenna. Note, numeral 28 in FIG. 11 denotes a choke coil connected in series to the defogger 5.

Therefore, when an FM radio wave is received in this embodiment, it is received by the diversity system in the same way as the fifth embodiment, the right electric conductor sheet 23 having the large capacitance of capacitive coupling with the defogger 5 acts as the main antenna of the diversity antenna and the left electric conductor sheet 24 having the small capacitance of capacitive coupling with the defogger 5 acts as the subantenna.

On the other hand, when an AM radio wave is received, the defogger 5 connected to the right electric conductor sheet 23 receives the radio wave as an AM antenna.

At the time, since the electric conductor sheet 23, which has the large capacitance of capacitive coupling with the defogger 5 and serves as the main antenna is disposed on the right side of the glass 3 in correspondence with the ground side bus bar 10 of the defogger 5 and connected to the ground side bus bar 10 through the coil 26, the length of the conductor wire 27 for connecting the electric conductor sheet 23 having the large capacitance with the defogger 5 to the defogger 5 can be shortened. As a result, the transmission loss of AM radio wave signals can be reduced and a receiving performance can be enhanced.

Figure 12:
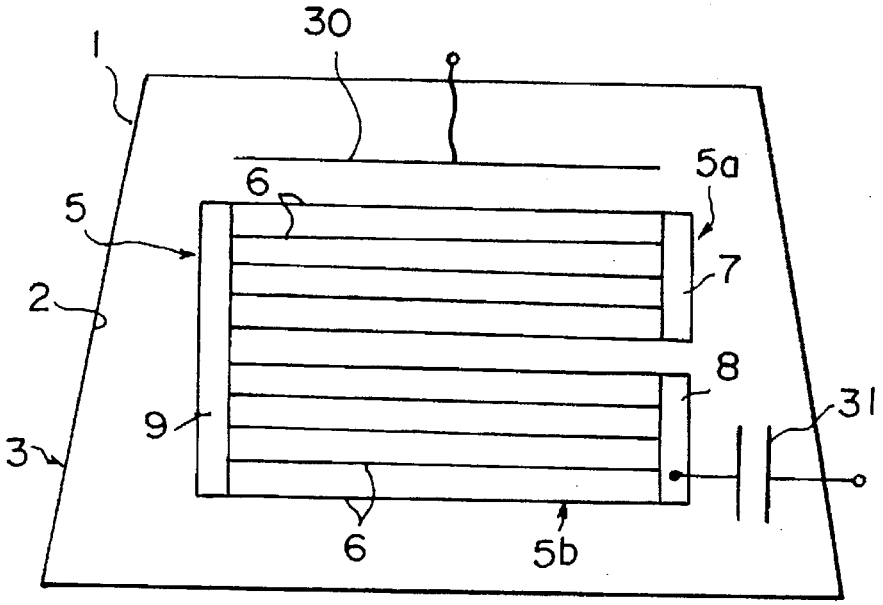
FIG. 12 is a plan view corresponding to FIG. 11 to show a conventional example in which an AM antenna is also used as the main antenna of a diversity type FM antenna.

As shown in FIG. 12, when a diversity antenna is arranged in prior art in such a manner that an antenna wire 30 stretched in the vicinity of the upper side of the defogger 5 is used as a main antenna for an FM receiving band an AM antenna for an AM receiving band and the defogger 5 is used as a subantenna for the FM receiving band, a capacitor 31 must be connected to the defogger 5 constituting the subantenna to cut the AM receiving band. In the sixth embodiment shown in FIG. 11, however, since the subantenna for the FM receiving band can be arranged by the left electric conductor sheet 24 having the small capacitance with the defogger 5, the conventional capacitor 31 is not needed.

Figure 13:
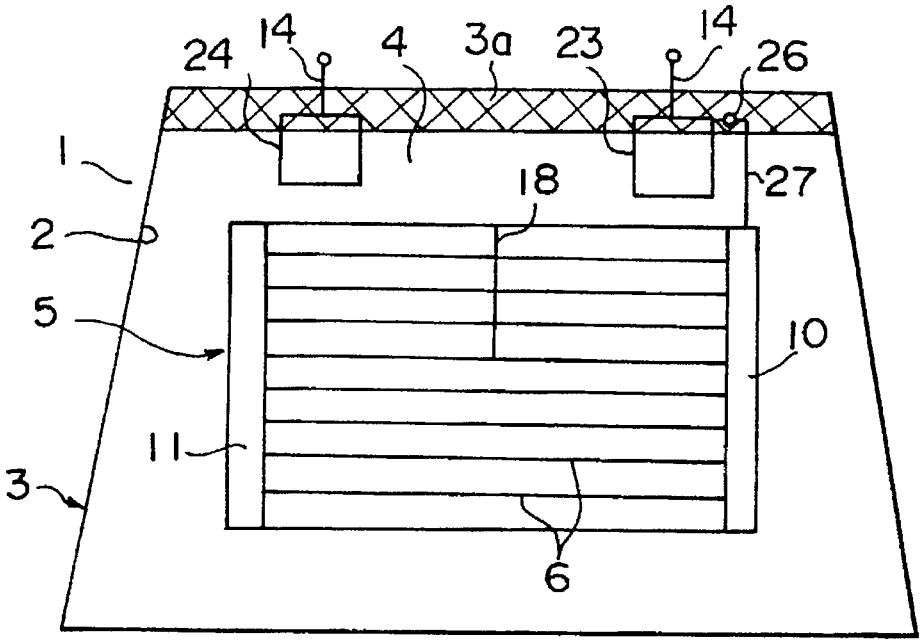
FIG. 13 is a plan view corresponding to FIG. 11 to show a modified example of the sixth embodiment.

Note, as shown in FIG. 13, since the coil 26 connected to the upper right end of the right electric conductor sheet 23 can be concealed from the outside of a vehicle by the provision of an opaque portion 3*a* at the upper end of the window glass 3, the outward appearance of the vehicle can be improved.

Figure 14:
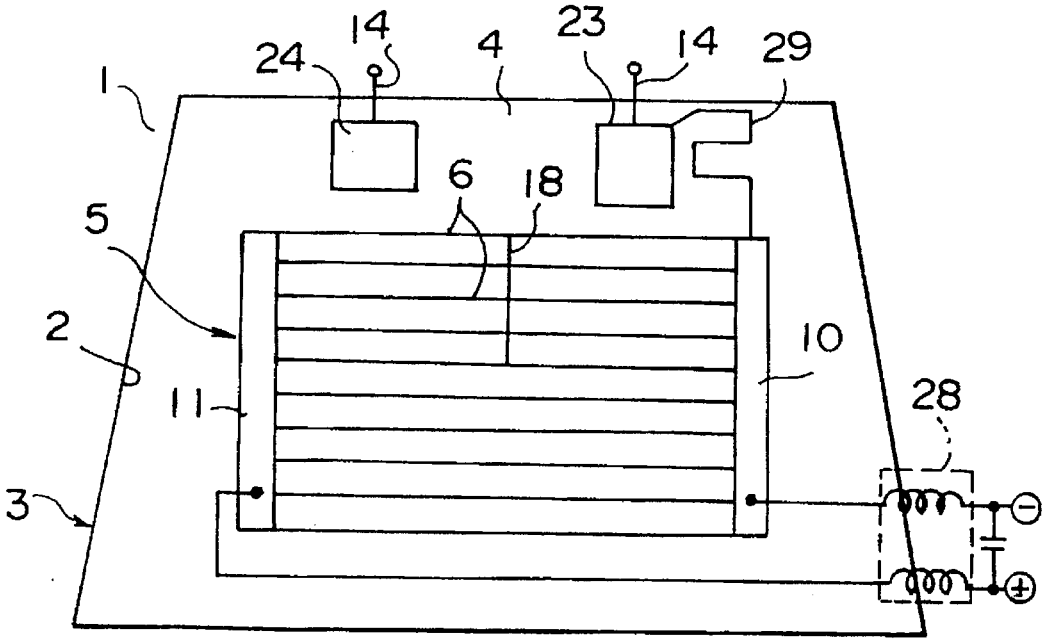
FIG. 14 is a plan view corresponding to FIG. 11 to show another modified example of the sixth embodiment.
Figure 15:
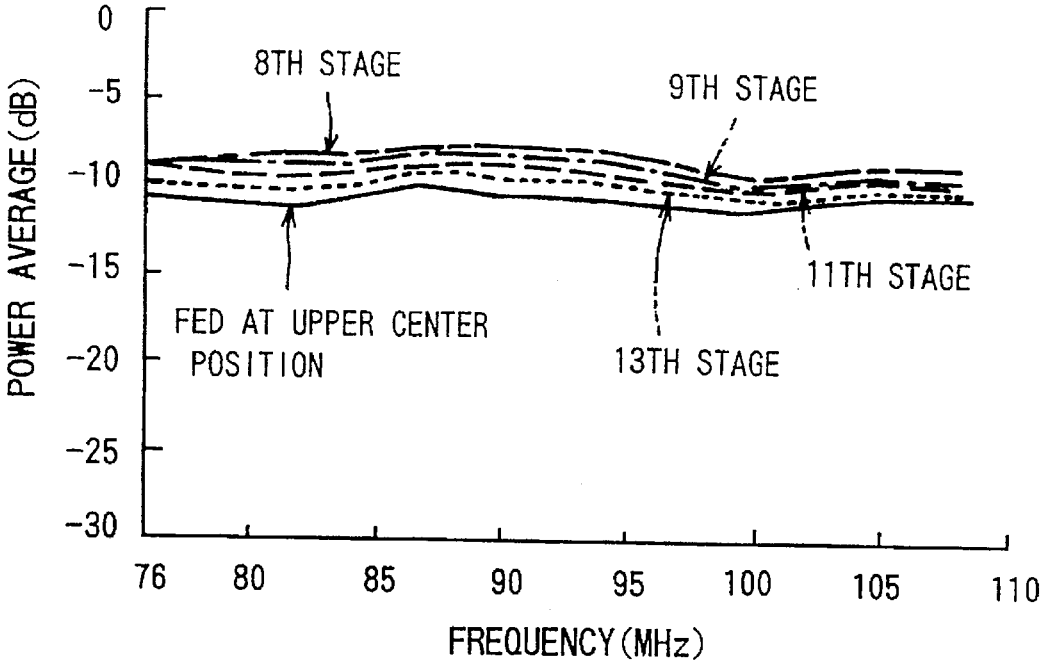
FIG. 15 is a characteristic graph showing the receiving sensitivity characteristics of a horizontally polarized wave when the length of an electric conductor sheet located at the upper portion of a glass is changed from the lowermost stage position of the heat wire in a defogger to the eighth stage position counted from the upper side of the heating wire in the case that the defogger is not provided on the window glass of a vehicle.
Figure 16:
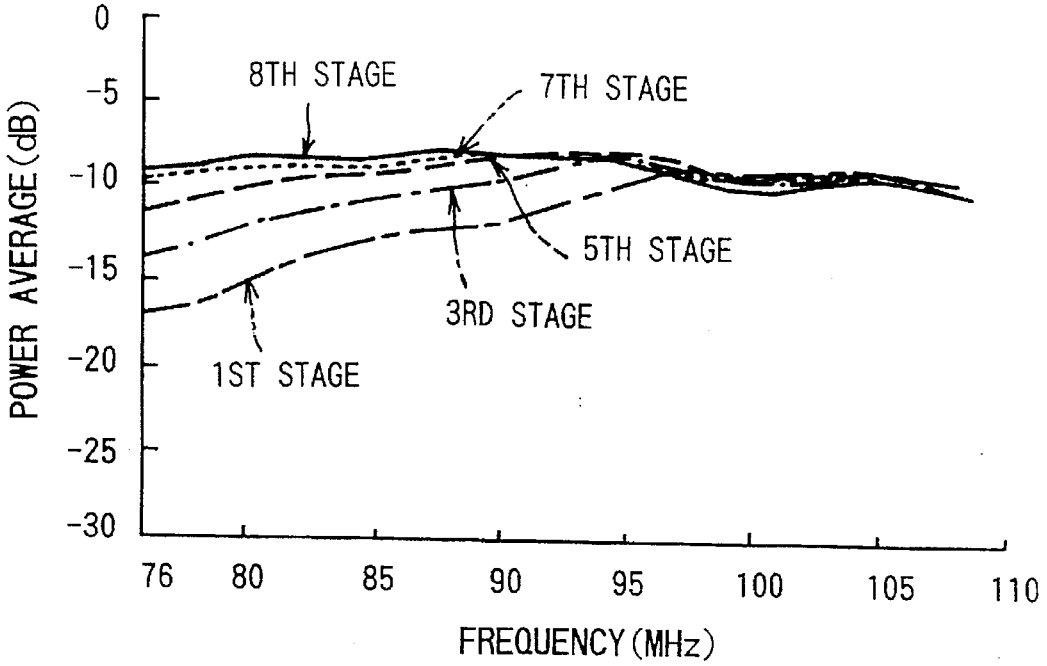
FIG. 16 is a characteristic graph showing the reception sensitivity characteristics of a horizontally polarized wave when the length of the electric conductor sheet is changed from the eighth stage position to the first stage position counted from the upper side of the heating wire in the defogger.
Figure 17:
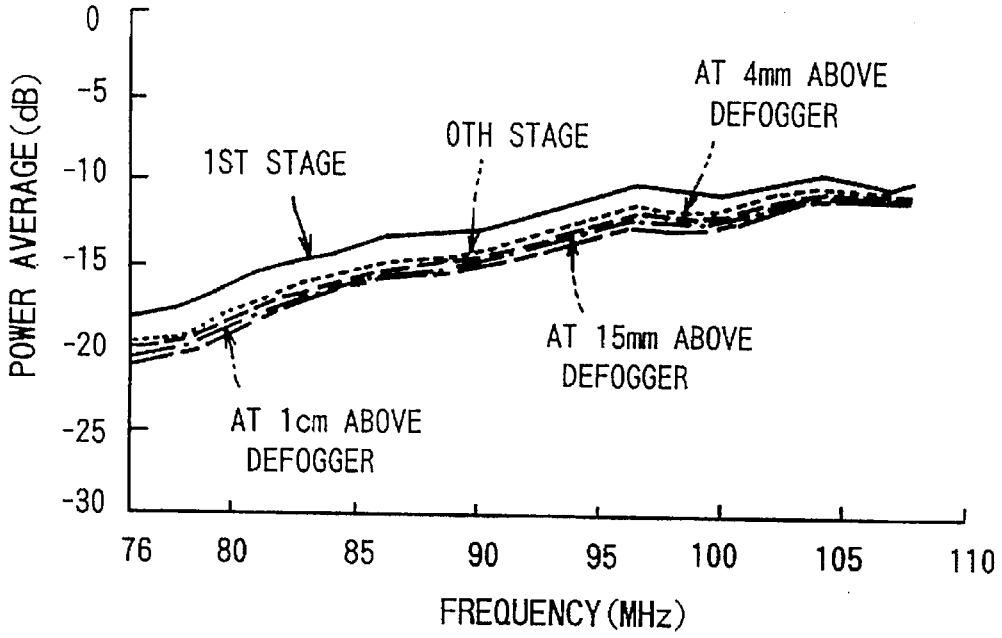
FIG. 17 is a characteristic graph showing the reception sensitivity characteristics of a horizontally polarized wave when the length of the electric conductor sheet is changed from the first stage position counted from the upper side of the heating wire in the defogger to the position 15 mm above the defogger.
Figure 18:
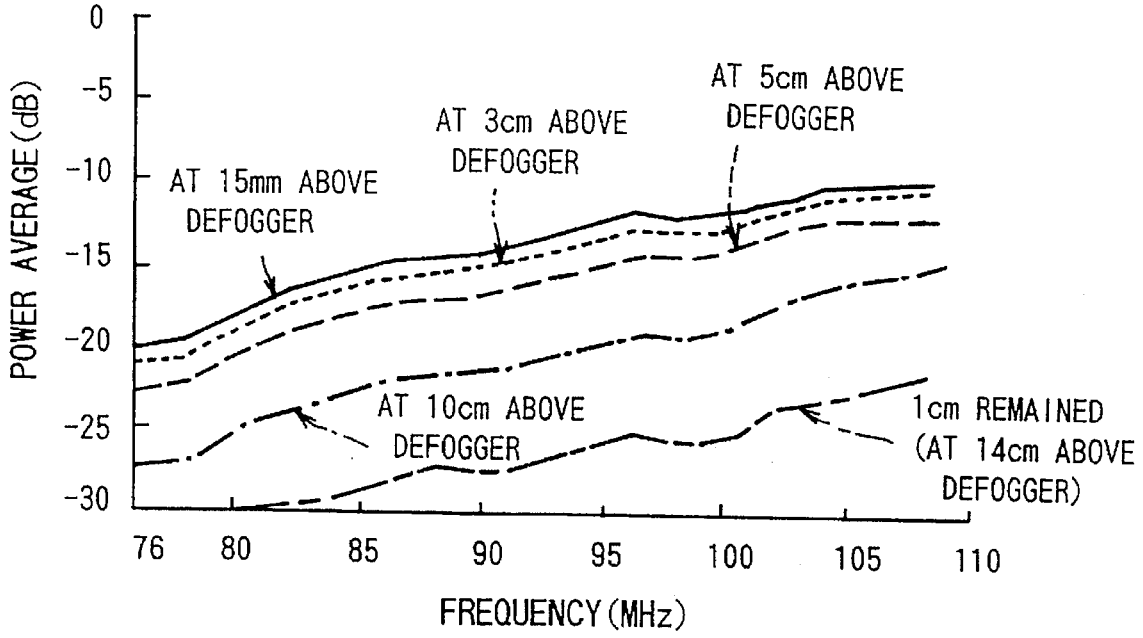
FIG. 18 is a characteristic graph showing the reception sensitivity characteristics of a horizontally polarized wave when the length of the electric conductor sheet is changed from the position 15 mm above the defogger to the position above 14 cm above the defogger.
Figure 19:
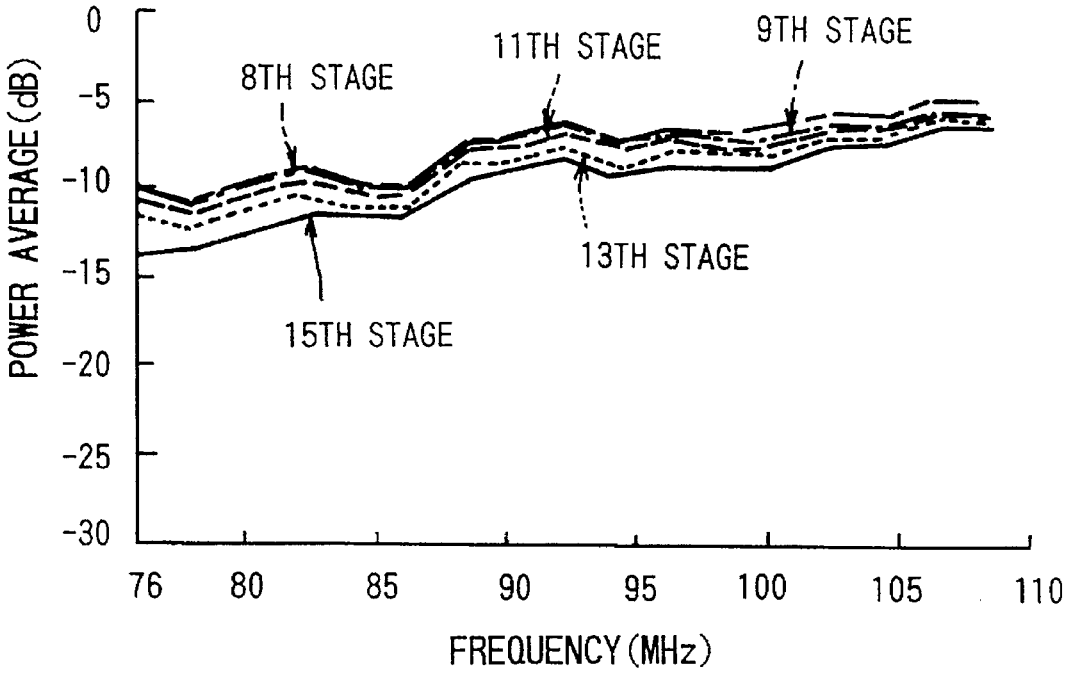
FIG. 19 is a characteristic graph showing the receiving sensitivity characteristics of a vertically polarized wave when the length of an electric conductor sheet is changed from the position of the lowermost stage position of the heating wire in a defogger to the eighth stage position counted from the upper side of the heating wire in the case that the defogger is not provided.
Figure 20:
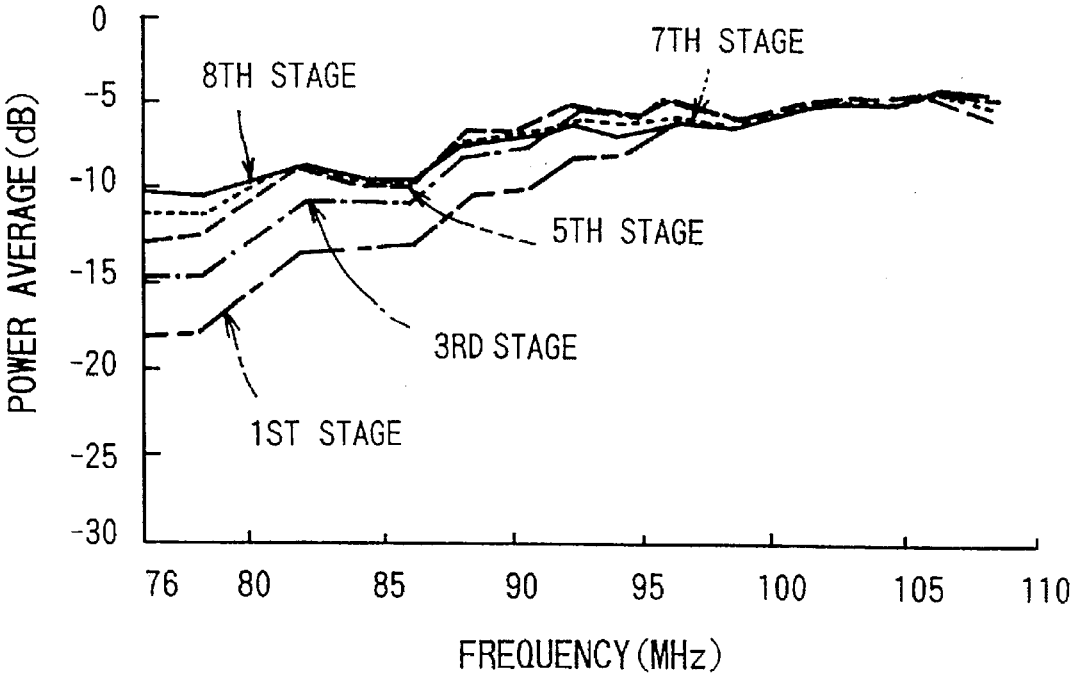
FIG. 20 is a characteristic graph showing the receiving sensitivity characteristics of a vertically polarized wave when the length of the electric conductor sheet is changed from the eighth stage position to the first stage position counted from the upper side of the heating wire in the defogger.
Figure 21:
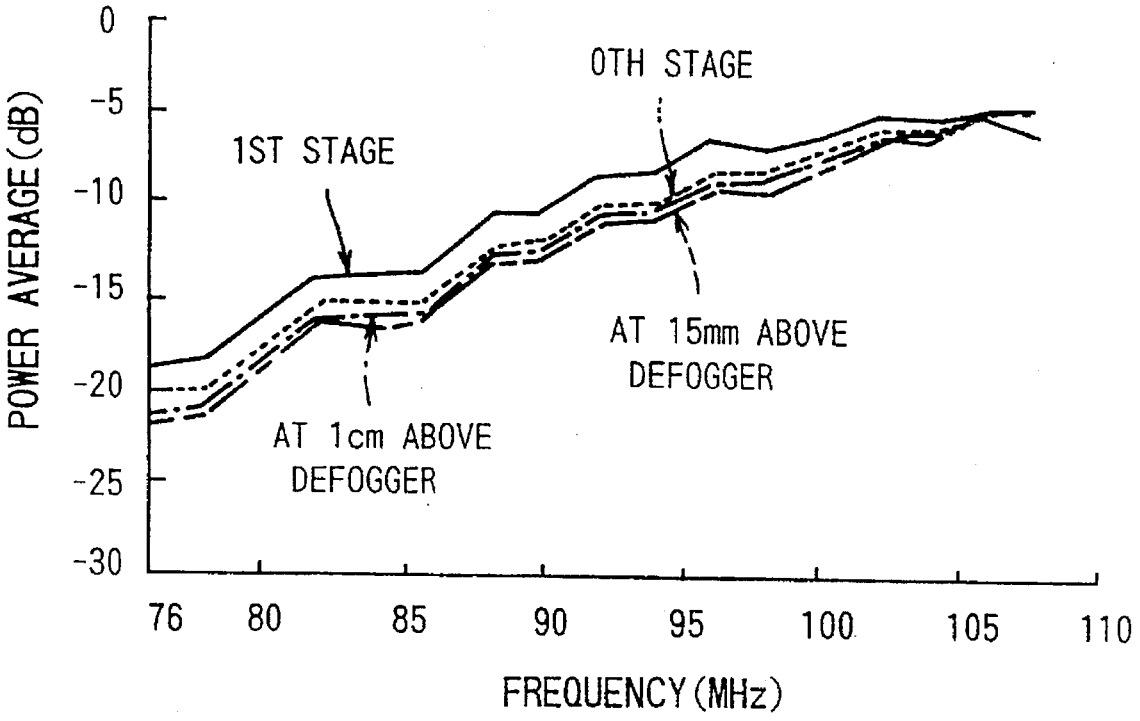
FIG. 21 is a characteristic graph showing the receiving sensitivity characteristics of a vertically polarized wave when the length of the electric conductor sheet is changed from the first stage position counted from the upper side of the heating wire in the defogger to the position 15 mm above the defogger.
Figure 22:
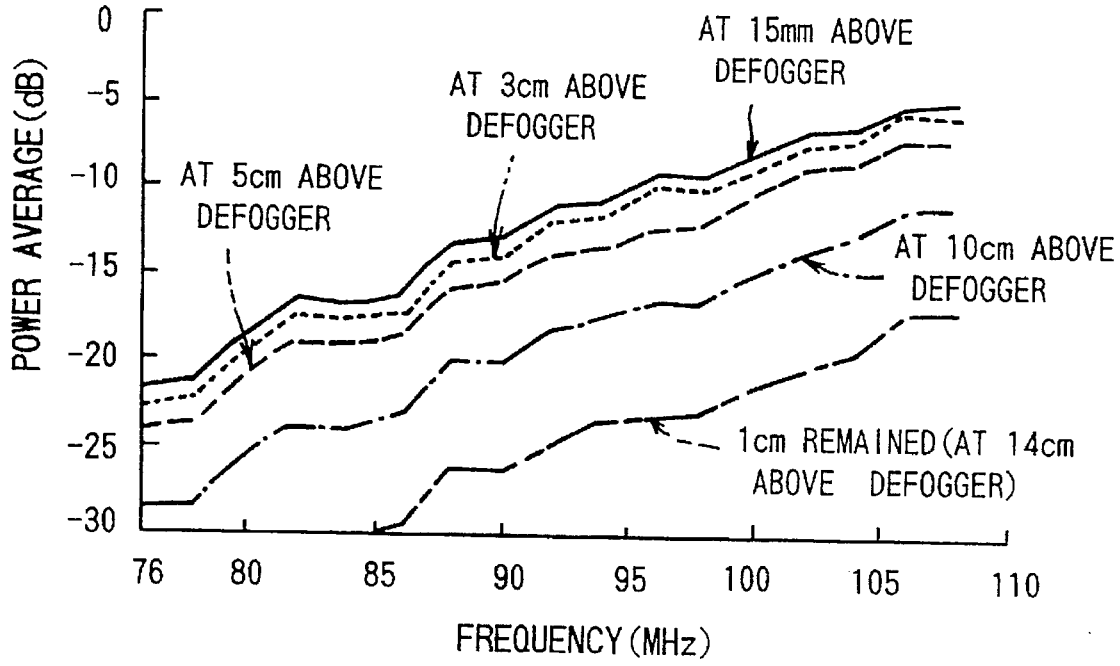
FIG. 22 is a characteristic graph showing the receiving sensitivity characteristics of a vertically polarized wave when the length of the electric conductor sheet is changed from the position 15 mm above the defogger to the position above 14 cm above the defogger.

Although the coil 26 is connected to the conductor wire for connecting the electric conductor sheet 23 to the ground side bus bar 10 of the defogger 5 in the sixth embodiment, a stub 29 having a predetermined length corresponding to the wavelength of an FM band may be connected to the conductor wire as shown in FIG. 14, by which the same functions and effects as those of the sixth embodiment can be obtained.

Although the space portion 4 is formed to the window glass 3 above the defogger 5 and the electric conductor sheets 13, 23, 24 are disposed in the space portion 4 in the above respective embodiments, the defogger 5 may be disposed in a space portion formed from the lower edge of the window glass 3 and the electric conductor sheets 13, 23, 24 may be disposed to a glass space portion below the defogger 5 and electric current is fed to them, by which the same functions can be obtained.

[Experiment Data] . . . Refer to FIG. 15–FIG. 54

Next, experiment data regarding the above respective embodiments and the modified examples thereof. i.e., fundamentally data for comparing gains corresponding to the frequencies of an antenna with those of a dipole antenna (reference antenna) will be shown.

FIG. 15–FIG. 18 show the receiving sensitivity characteristics of a horizontally polarized wave when an electric conductor sheet having a right to left width W of 10 cm is mounted on the upper portion of the window glass of a vehicle with which a defogger is not provided and the length of the electric conductor sheet is changed in the state that electric current is fed to the upper portion of the electric conductor sheet at the center in the right and left direction thereof. FIG. 19–FIG. 22 show the receiving sensitivity characteristics of a vertically polarized wave in the above case. Note, the symbols such as "eighth stage", "ninth stage" and the like in FIG. 15–FIG. 21 show the position of the lower end of the electric conductor sheet. That is, a C-shaped defogger composed of fifteen heating wires disposed vertically and spaced apart from each other by a gap of 3 cm is virtually disposed on the glass window and the lower end position of the electric conductor sheet is indicated by the position of the heating wire counted from the uppermost heating wire. More specifically, in the example shown in the Figure, for example, "fed at upper central position" or "fifteen stage" indicates that the electric conductor sheet is 63 cm long, "thirteenth stage" indicates that the electric conductor sheet is 57 cm long, "first stage" indicates that the electric conductor sheet is 21 cm long, and further "zero-th stage" indicates that the electric conductor sheet is 18 cm long, respectively. Further, "at 4 mm above defogger" indicates that the lower end of the electric conductor sheet is located at a position 4 mm above the upper end of the defogger. From the mentioned above, it is found that the receiving sensitivity of the antenna is changed in accordance with the length of the electric conductor sheet.

Figure 23:
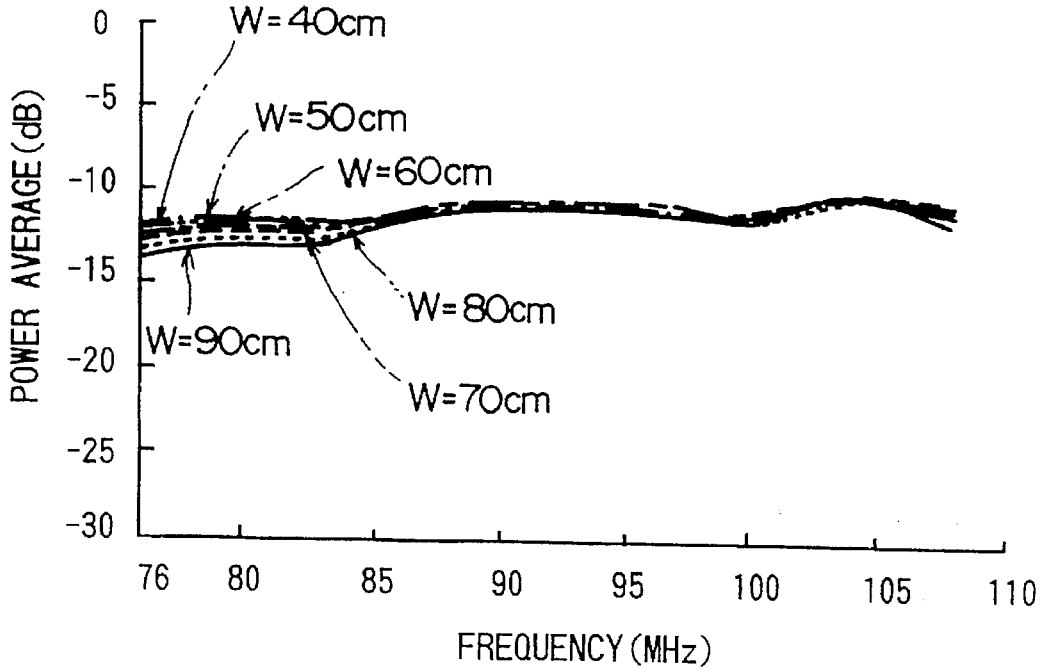
FIG. 23 is a characteristic graph showing the receiving sensitivity characteristics of a horizontally polarized wave when the right to left width of the electric conductor sheet disposed in a glass space portion above a C-shaped defogger is changed from 90 cm to 40 cm.
Figure 24:
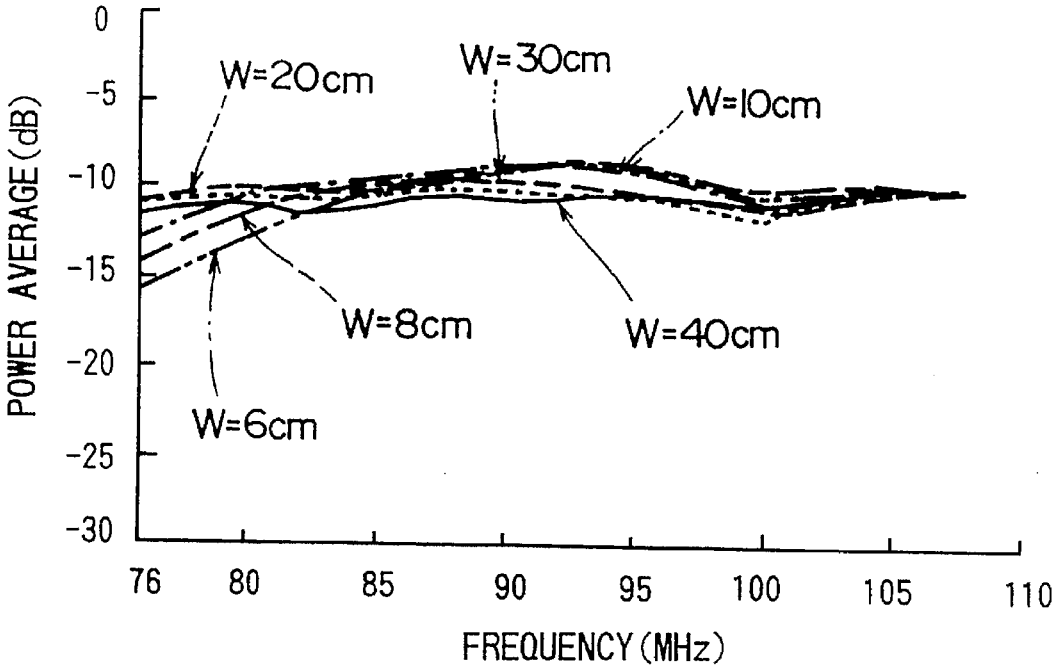
FIG. 24 is a characteristic graph showing the receiving sensitivity characteristics of a horizontally polarized wave when the right to left width of the electric conductor sheet is changed from 40 cm to 6 cm.
Figure 25:
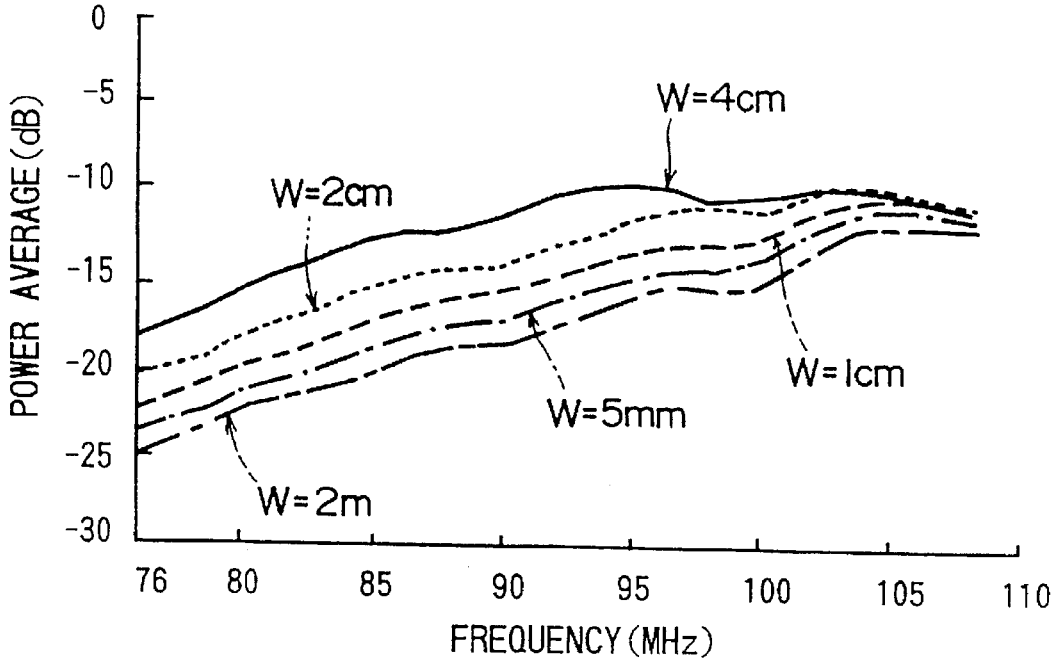
FIG. 25 is a characteristic graph showing the receiving sensitivity characteristics of a horizontally polarized wave when the right to left width of the electric conductor sheet is changed from 4 cm to 2 mm.
Figure 26:
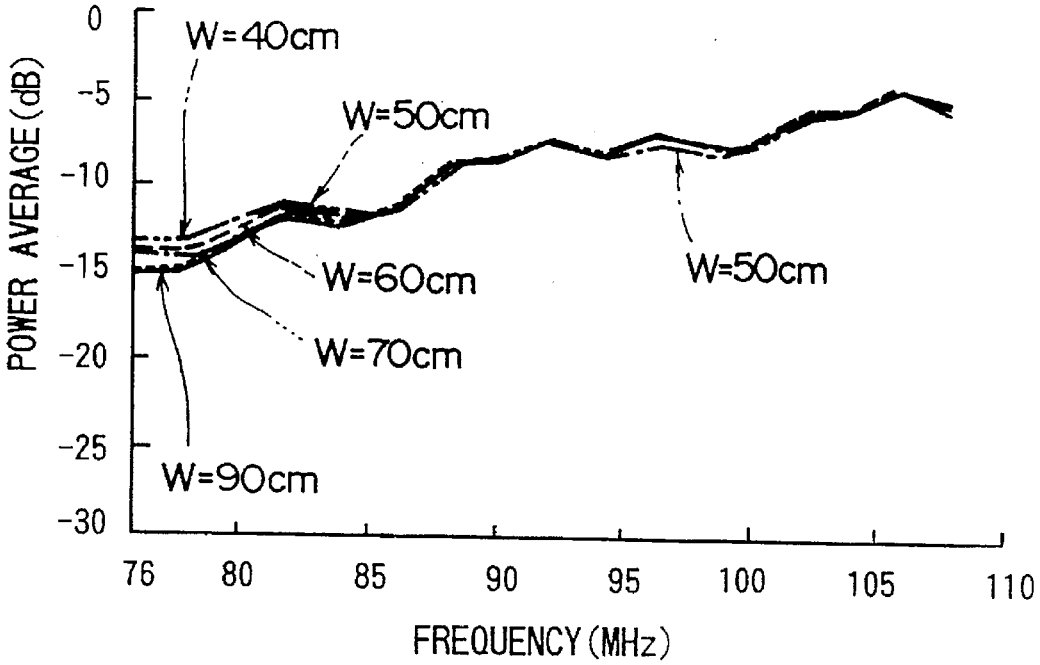
FIG. 26 a characteristic graph showing the receiving sensitivity characteristics of a vertically polarized wave when the right to left width of the electric conductor sheet is changed from 90 cm to 40 cm.
Figure 27:
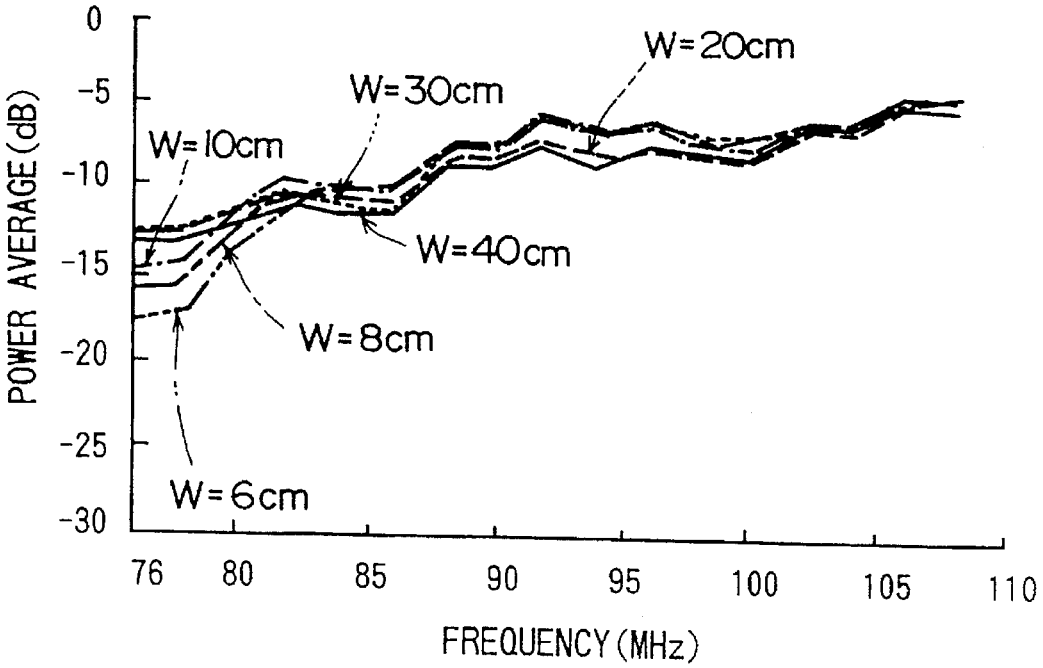
FIG. 27 is a characteristic graph showing the receiving sensitivity characteristics of a vertically polarized wave when the right to left width of the electric conductor sheet is changed from 40 cm to 6 cm.
Figure 28:
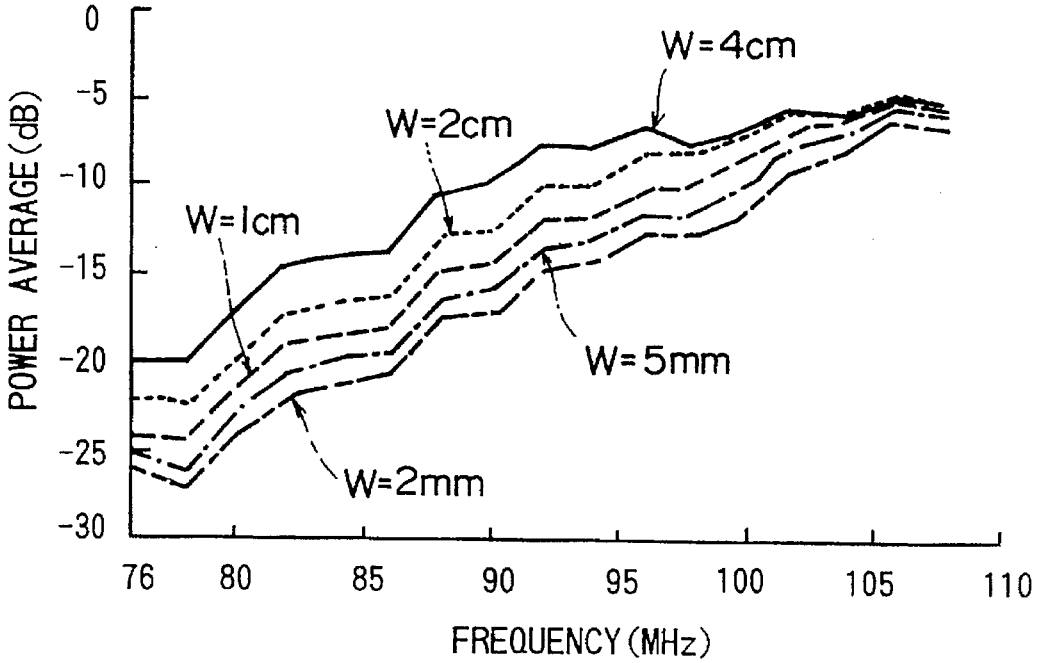
FIG. 28 is a characteristic graph showing the receiving sensitivity characteristics of a vertically polarized wave when the right to left width of the electric conductor sheet is changed from 4 cm to 2 mm.

FIG. 23–FIG. 25 show the receiving sensitivity characteristics of a horizontally polarized wave when the C-shaped defogger described above is actually mounted on a window glass, an electric conductor sheet is attached to a glass space portion above the defogger at the center in the right and left direction thereof so that the electric conductor sheet is spaced apart from the upper end of the defogger 4 mm with a gap (slot) of 3 cm from the upper end of the glass and the right to left width of the electric conductor sheet is changed. FIG. 26–FIG. 28 show the receiving sensitivity characteristics of a vertically polarized wave in the above case. According to the characteristics, it is found that when the right to left width of the electric conductor sheet is increased, the receiving sensitivity is increased and maximized when the right to left width reaches 20 cm, but when the width is increased in excess of 20 cm, however, the receiving sensitivity is decreased. According to the experiment, the right to left width of the electric conductor sheet is preferably in the range of from 50 mm or more to 300 mm or less and more preferably from 100 mm or more to 250 mm or less in practical use.

In the comparison of the characteristics shown in FIG. 24–FIG. 27 with the characteristics shown in FIG. 15–FIG. 22 in which no defogger is employed, when the gap between the electric conductor sheet and the defogger exceeds 50 mm, the gap between the electric conductor sheet and the defogger does not affect the receiving sensitivity. Consequently, in the antenna in which the gap between the electric conductor sheet and the defogger is set to 50 mm or less, the receiving sensitivity can be adjusted.

Figure 29:
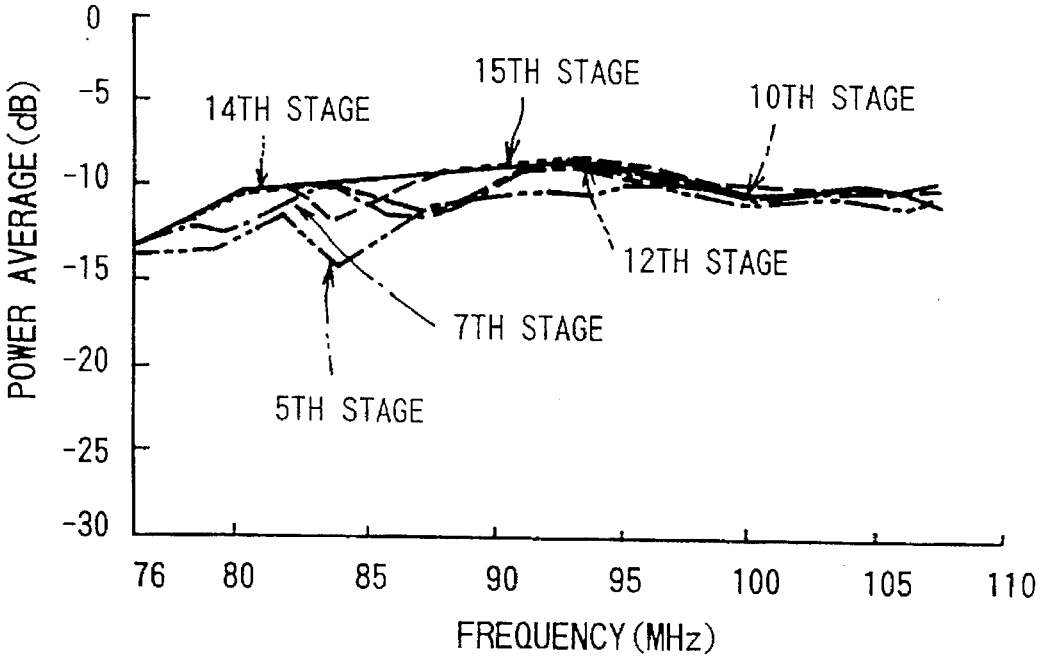
FIG. 29 is a characteristic graph showing the receiving sensitivity characteristics of a horizontally polarized wave when the length of an electric conductor wire disposed to a C-shaped defogger is changed from the lowermost stage position of the heating wire in the defogger to the seventh stage position counted from the upper side of the heating wire.
Figure 30:
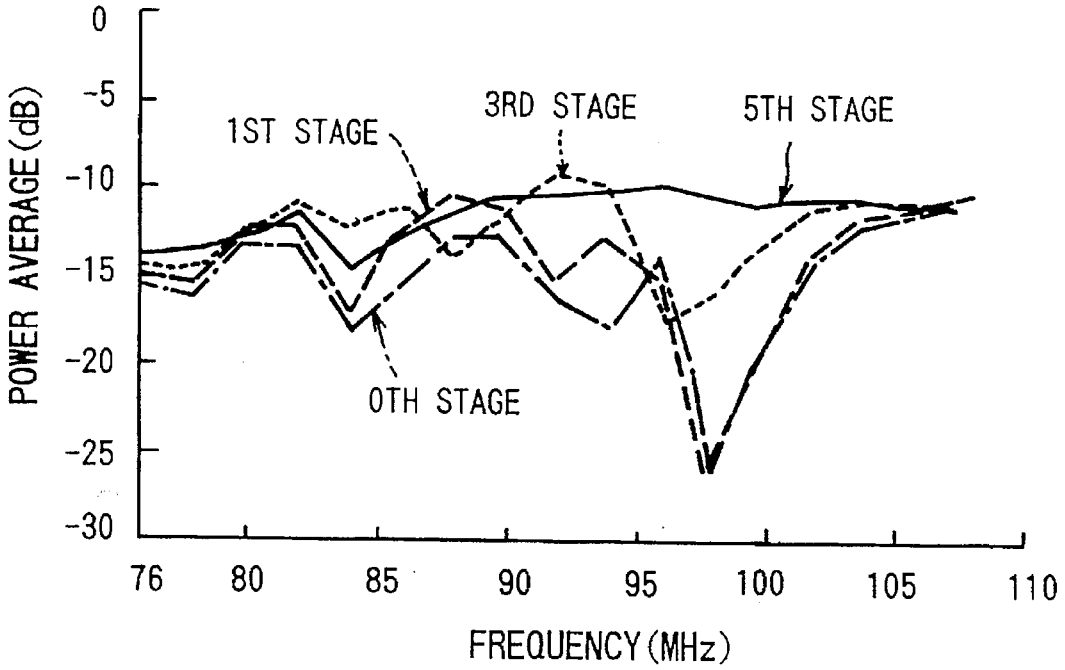
FIG. 30 is a characteristic graph showing the receiving sensitivity characteristics of a horizontally polarized wave when the length of the electric conductor wire is changed from the fifth stage position of the heating wire in the defogger counted from the upper side thereof to the zero stage position counted therefrom.
Figure 31:
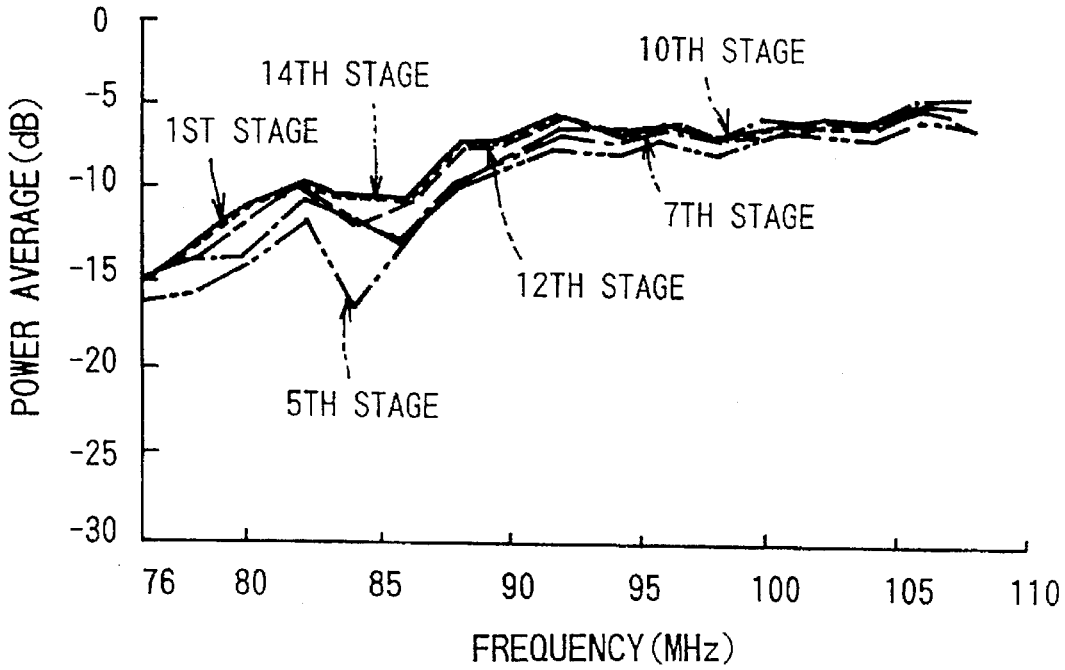
FIG. 31 is a characteristic graph showing the receiving sensitivity characteristics of a vertically polarized wave when the length of an electric conductor wire disposed to a defogger is changed from the lowermost stage position of the heating wire in the defogger to the seventh stage position counted from the upper side of the heating wire.
Figure 32:
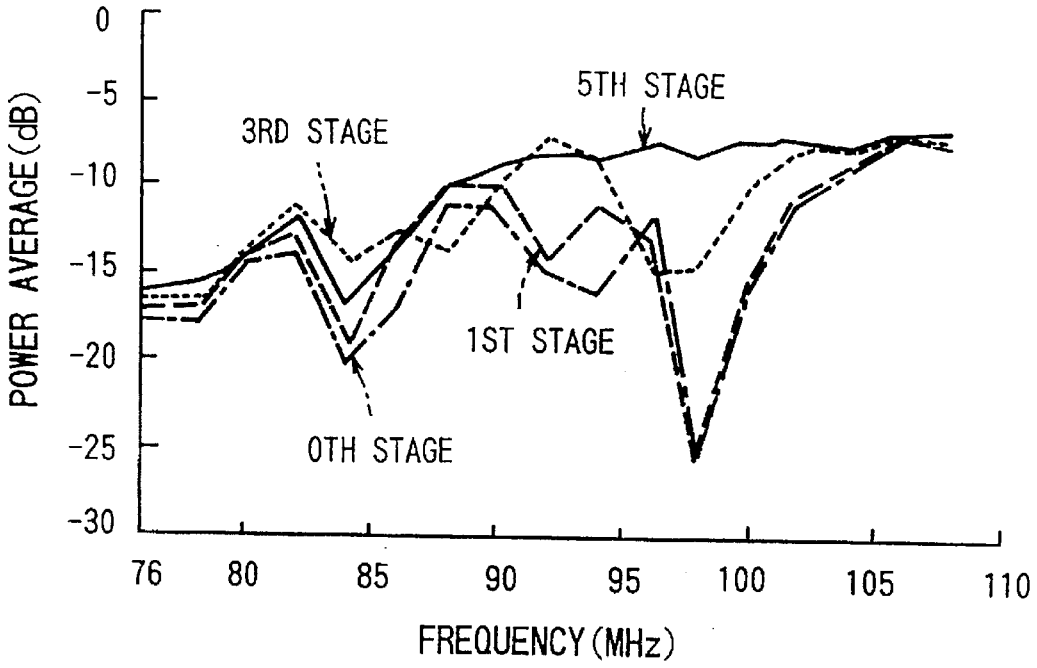
FIG. 32 is a characteristic graph showing the receiving sensitivity characteristics of a vertically polarized wave when the length of the electric conductor wire is changed from the fifth stage position of the heat wire in the defogger counted from the upper side thereof to the zero stage position counted therefrom.
Figure 33:
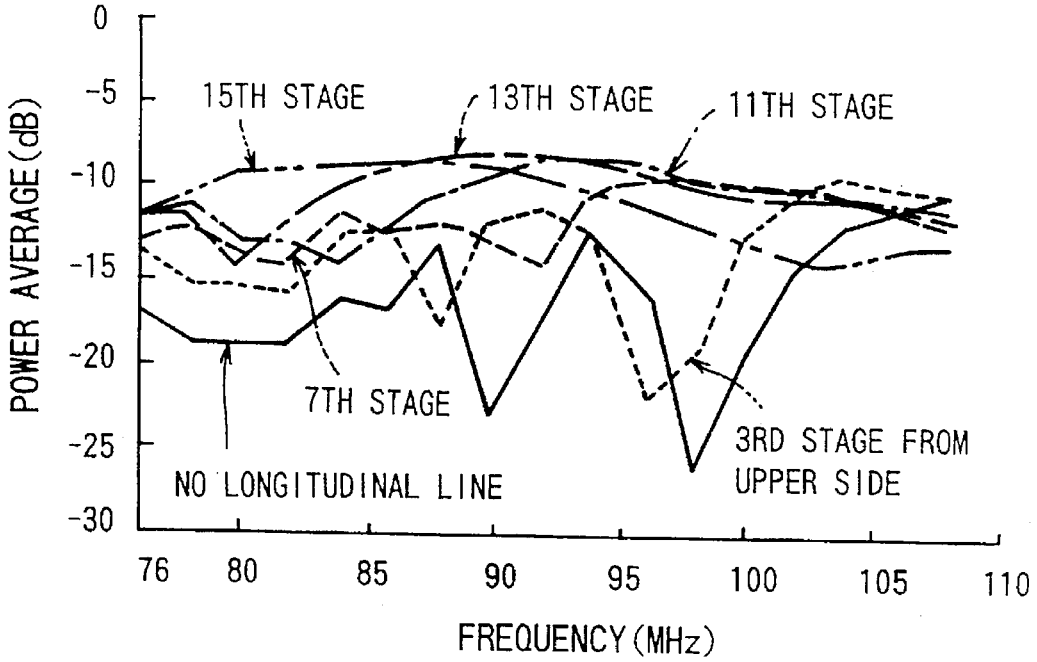
FIG. 33 is a characteristic graph showing the receiving sensitivity characteristics of a horizontally polarized wave when the length of an electric conductor wire disposed to another kind of a defogger is changed from the lowermost stage position of the heating wire in the defogger to the uppermost stage position thereof.
Figure 34:
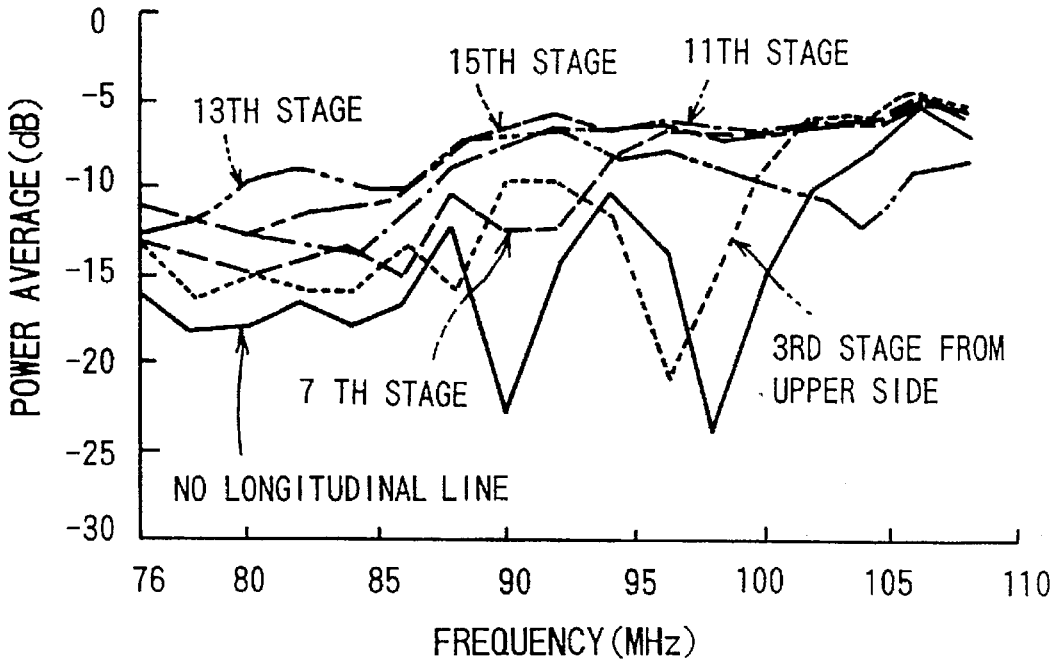
FIG. 34 is a characteristic graph showing the receiving sensitivity characteristics of the vertically polarized wave.
Figure 35:
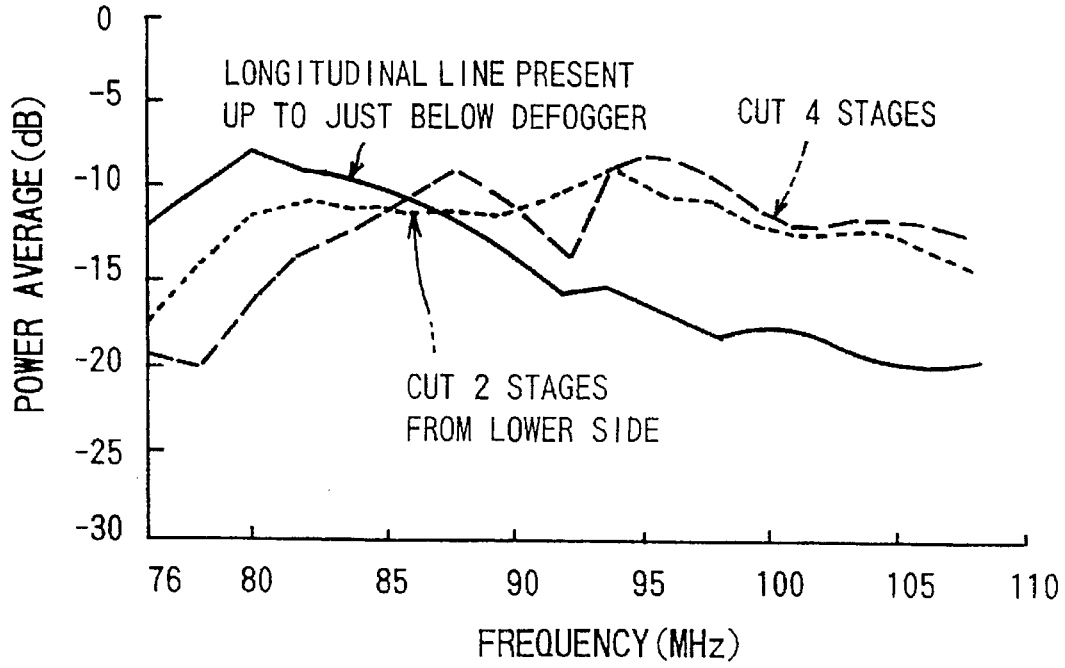
FIG. 35 is a characteristic graph showing the receiving sensitivity characteristics of a horizontally polarized wave when the length of an electric conductor wire disposed to a defogger in a window glass having another shape is changed.
Figure 36:
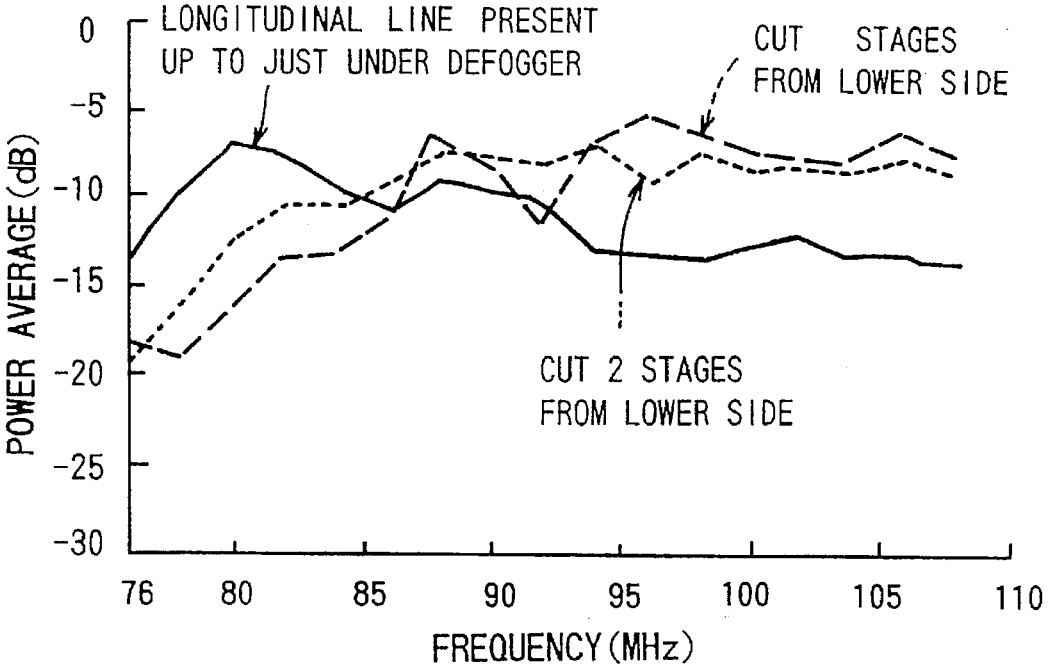
FIG. 36 is a characteristic graph showing the receiving sensitivity characteristics of the vertically polarized wave.

FIG. 29 and FIG. 30 show the receiving sensitivity characteristics of a horizontally polarized wave when a defogger is formed to a C-shape, a space portion composed of only glass (without any conductor) is provided above the defogger and an electric conductor sheet having a right to left width of 10 cm is attached at the center in the right and left direction of the space portion so that the electric conductor sheet is spaced apart from the upper end of the defogger 4 mm with a slot of 3 cm from the upper end of the glass as well as an electric conductor wire (longitudinal wire) is disposed to the defogger and the distance of the electric conductor wire from the upper end to the lower end thereof is changed. FIG. 31 and FIG. 32 show the receiving sensitivity characteristics of a vertically polarized wave in the above case. On the other hand, FIG. 33 shows the receiving sensitivity characteristics of a horizontally polarized wave when the C-shaped defogger provided with the window glass is replaced with the defogger shown in the second embodiment (refer to FIG. 3) and the length of an electric conductor wire (longitudinal wire) disposed to the defogger is changed. FIG. 34 shows the receiving sensitivity characteristics of a vertically polarized wave in the above case. Note, the lower end position of the electric conductor wire is indicated by the position of the heating wire counted from the uppermost heating wire in the same way as the mentioned above, and "fifteen stage" indicates that the electric conductor wire is disposed from the upper end to the lower end of the defogger and "zero-th stage of longitudinal wire", i.e., "no longitudinal wire" indicates that there is no electric conductor wire. Further, FIG. 35 shows the receiving sensitivity characteristics of a horizontally polarized wave when the defogger shown in the second embodiment is provided on a window glass having a shape different from that of the one mentioned above (the upward to downward length of the glass is about one third the right to left width thereof) and the length of an electric conductor wire in the defogger is changed and FIG. 36 shows the receiving sensitivity characteristics of a vertically polarized wave in the above case, respectively. The lower end position of the electric conductor wire is indicated by the position of the heating wire counted from the uppermost heating wire and, for example, "cut two stages from the lower side" indicates the state that the electric conductor wire is disposed from the lower end of the defogger to the position of the second heating wire. According to these characteristics, it is found that a receiving performance without problem in practical use can be obtained in a predetermined frequency band even in the state of the "zero-th stage of longitudinal wire", i.e., "no longitudinal wire" and that as the length of the electric conductor wire is increased, the receiving sensitivity is increased and the high receiving sensitivity area is slid to the side of low frequencies.

Figure 37:
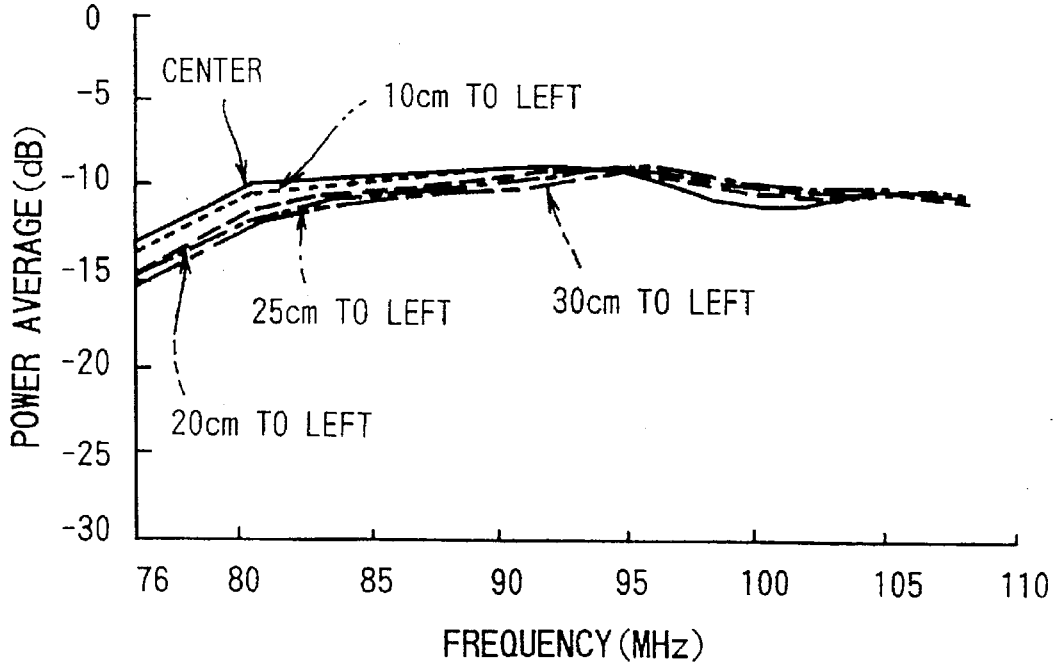
FIG. 37 is a characteristic graph showing the receiving sensitivity characteristics of a horizontally polarized wave when an electric conductor sheet disposed above a C-shaped defogger and having a right to left width of 10 cm is offset from the center in the right and left direction of a glass to the position apart 30 cm from the center in the left direction.
Figure 38:
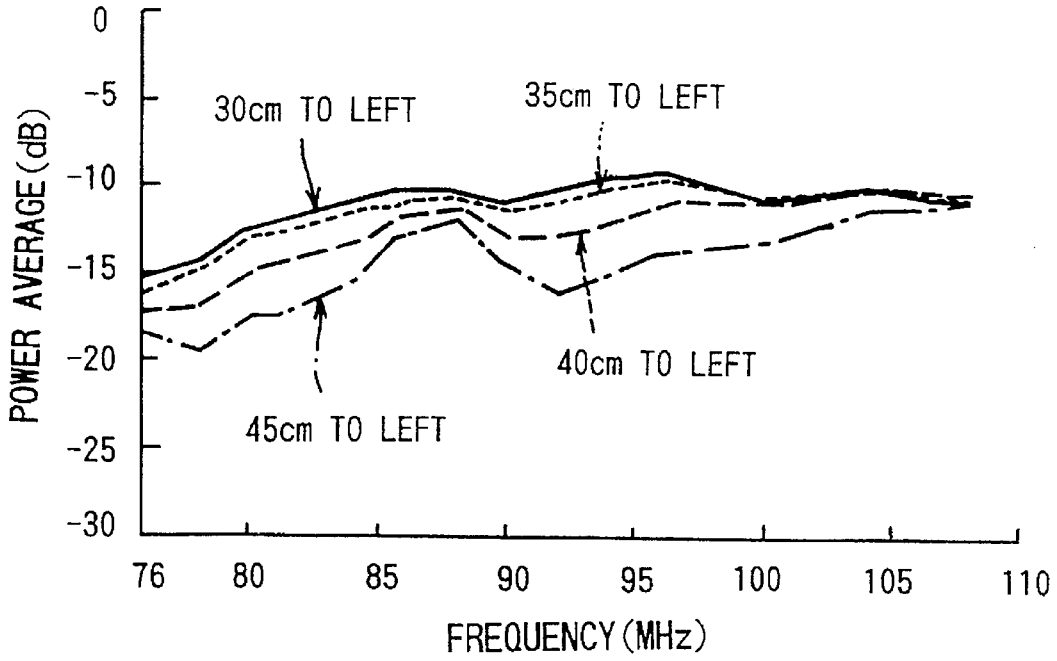
FIG. 38 is a characteristic graph showing the receiving sensitivity characteristics of a horizontally polarized wave when the electric conductor sheet is offset from the position apart 30 cm in the left direction from the center in the right and left direction of the glass to the position apart 45 cm therefrom in the left direction.
Figure 39:
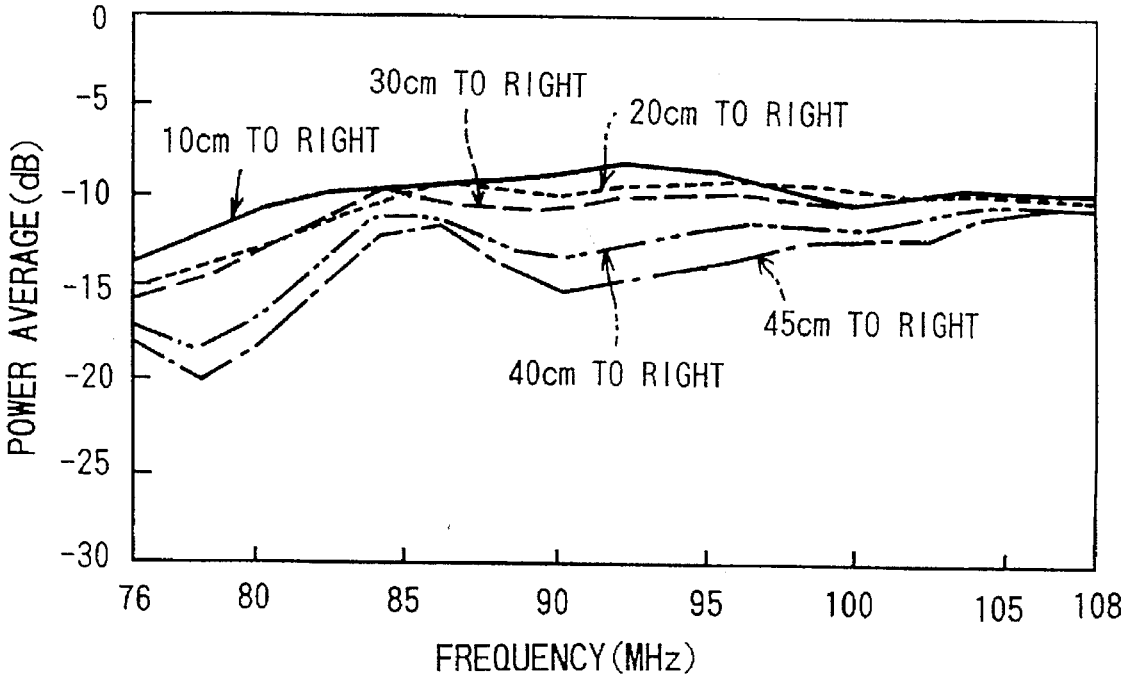
FIG. 39 is a characteristic graph showing the receiving sensitivity characteristics of a horizontally polarized wave when the electric conductor sheet is offset from the position apart 10 cm in the right direction from the center in the right and left direction of the glass to the position apart 45 cm therefrom in the right direction.
Figure 40:
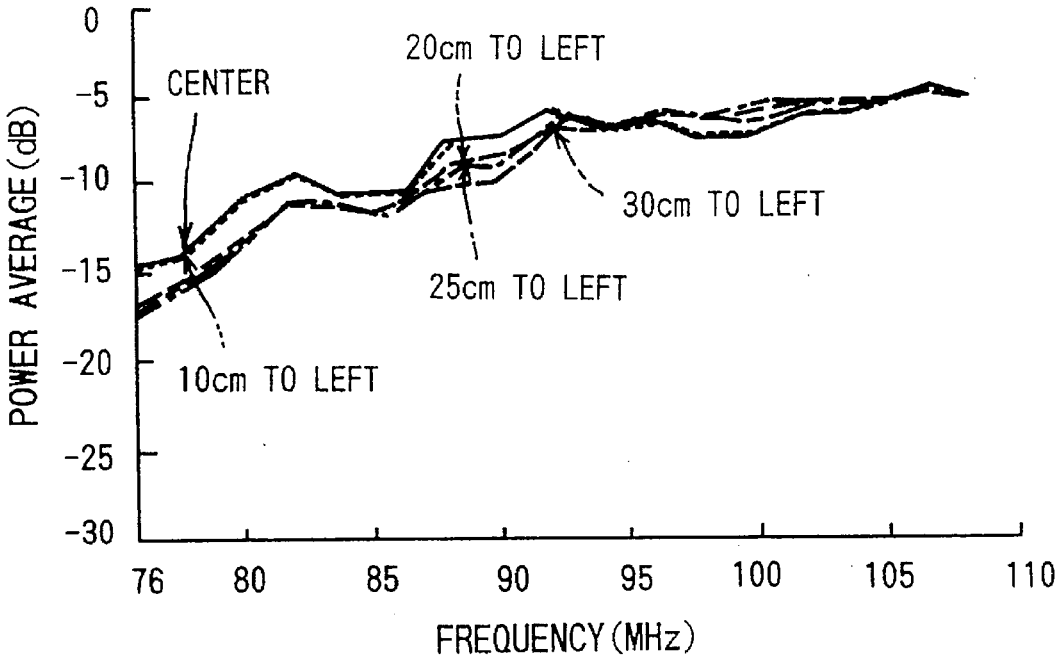
FIG. 40 is a characteristic graph showing the receiving sensitivity characteristics of a vertically polarized wave when the electric conductor sheet is offset from the center in the right and left direction of the glass to the position apart 30 cm therefrom in the left direction.
Figure 41:
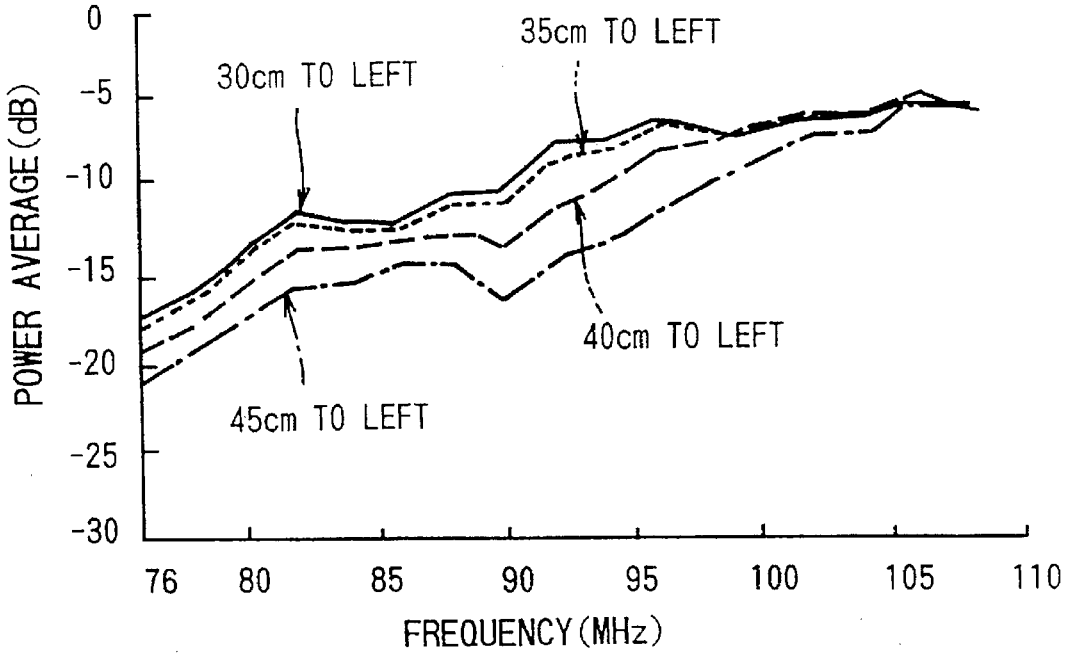
FIG. 41 is a characteristic graph showing the receiving sensitivity characteristics of a vertically polarized wave when the electric conductor sheet is offset from the position apart 30 cm in the left direction from the center in the right and left direction of the glass to the position apart 45 cm therefrom in the left direction.
Figure 42:
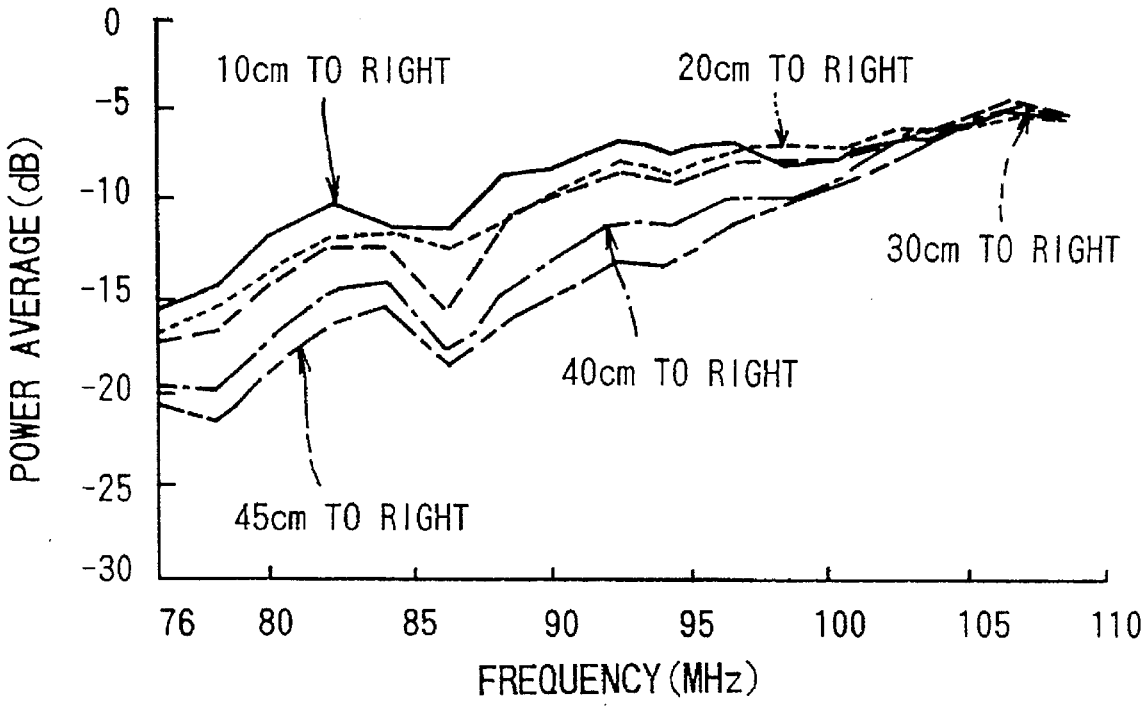
FIG. 42 is a characteristic graph showing the receiving sensitivity characteristics of a vertically polarized wave when the electric conductor sheet is offset from the position apart 10 cm in the right direction from the center in the right and left direction of the glass to the position apart 45 cm therefrom in the right direction.

FIG. 37–FIG. 39 show the receiving sensitivity characteristics of a horizontally polarized wave when an electric conductor sheet, which has a right to left width of 10 cm and is disposed above an electric conductor wire in a C-shaped defogger with a gap of 4 mm from the upper side of the electric conductor wire, is offset from the center in the right and left direction of a glass by a predetermined amount and FIG. 40–42 show the receiving sensitivity characteristics of a vertically polarized wave in the above case, respectively. Consequently, it is found that as the amount of offset of the electric conductor sheet from the center in the right and left direction of the glass is increased, the receiving sensitivity is lowered.

Figure 43:
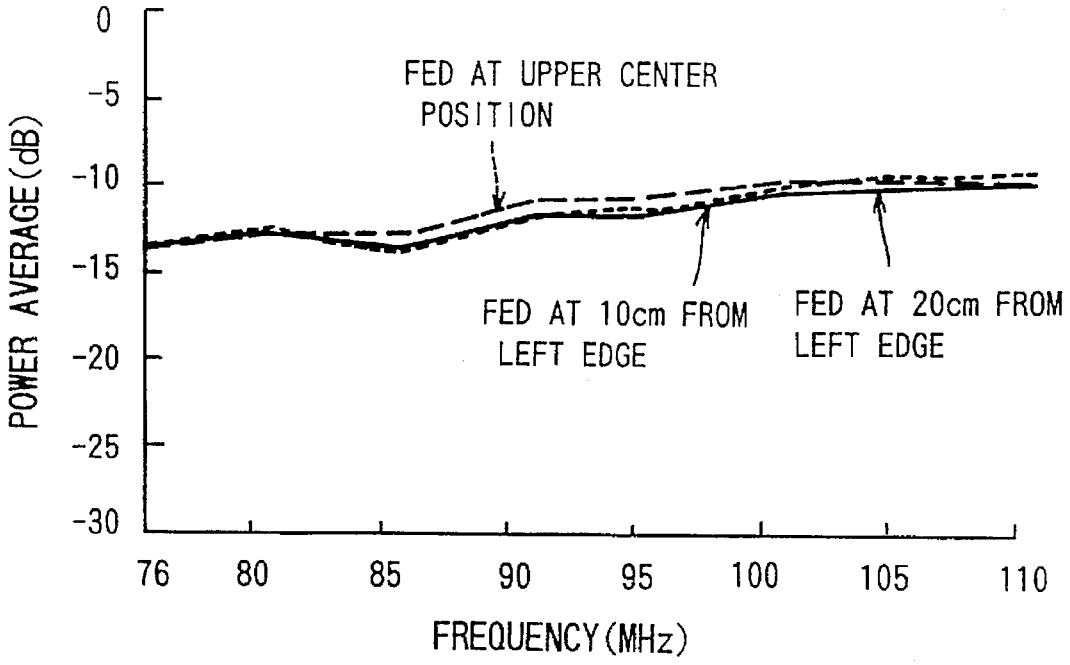
FIG. 43 is a characteristic graph showing the receiving sensitivity characteristics of a horizontally polarized wave when a power feed position to an electric conductor sheet having a right to left width of 40 cm and disposed on a defogger is changed.
Figure 44:
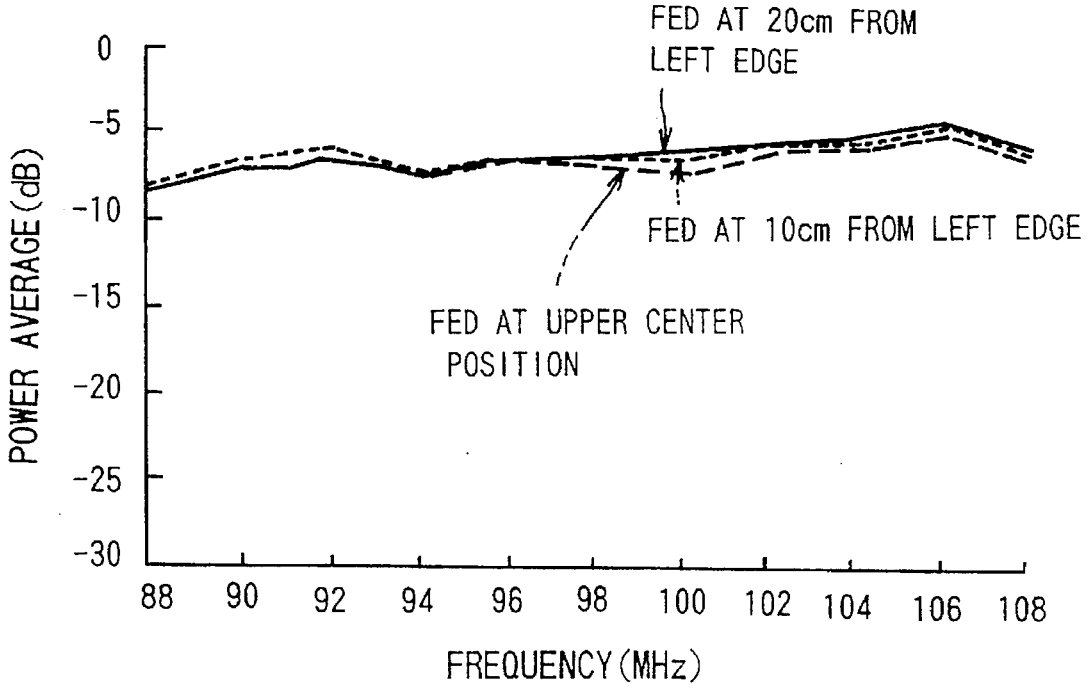
FIG. 44 is a characteristic graph showing the receiving sensitivity characteristics of a vertically polarized wave.

FIG. 43 shows the receiving sensitivity characteristics of a horizontally polarized wave when an electric conductor sheet having a right to left width of 40 cm is disposed to a defogger and a power feed position to the electric conductor sheet is changed and FIG. 44 shows the receiving sensitivity characteristics of a vertically polarized wave in the above case, respectively.

In the Figures, for example, "fed at upper center position" means that electric current is fed at the center in the right and left direction of the upper portion of the electric conductor sheet and "fed at 10 cm from left edge means that electric current is fed at the position 10 cm from the left end of the electric conductor sheet. According to these characteristics, it is found that even if the power feed position to the electric conductor sheet is changed, the receiving sensitivity characteristics are not changed.

Figure 45:
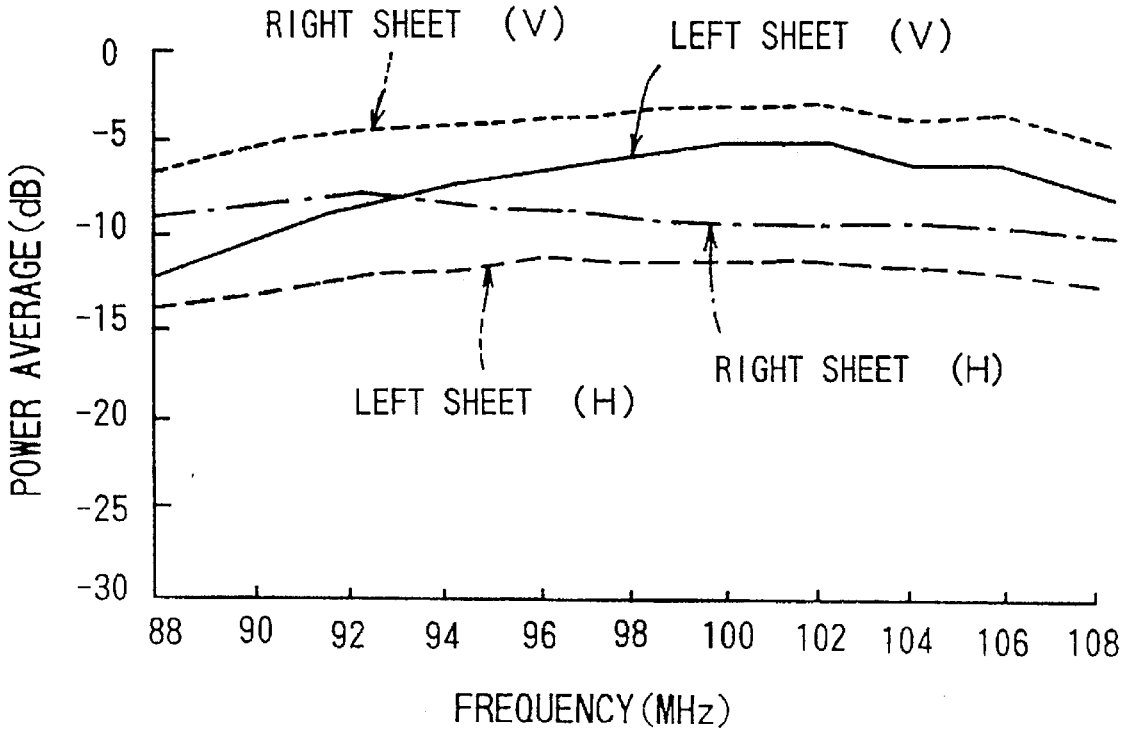
FIG. 45 is a characteristic graph showing the respective receiving sensitivity characteristics of a horizontally polarized wave and a vertically polarized wave, respectively when a left electric conductor sheet is disposed to a glass space potion above a defogger having an electric conductor wire at the center in the right and left direction thereof with a gap of 24 mm from the defogger and a right electric conductor sheet is disposed in the glass space portion with a gap of 4 mm from the defogger.
Figure 46:
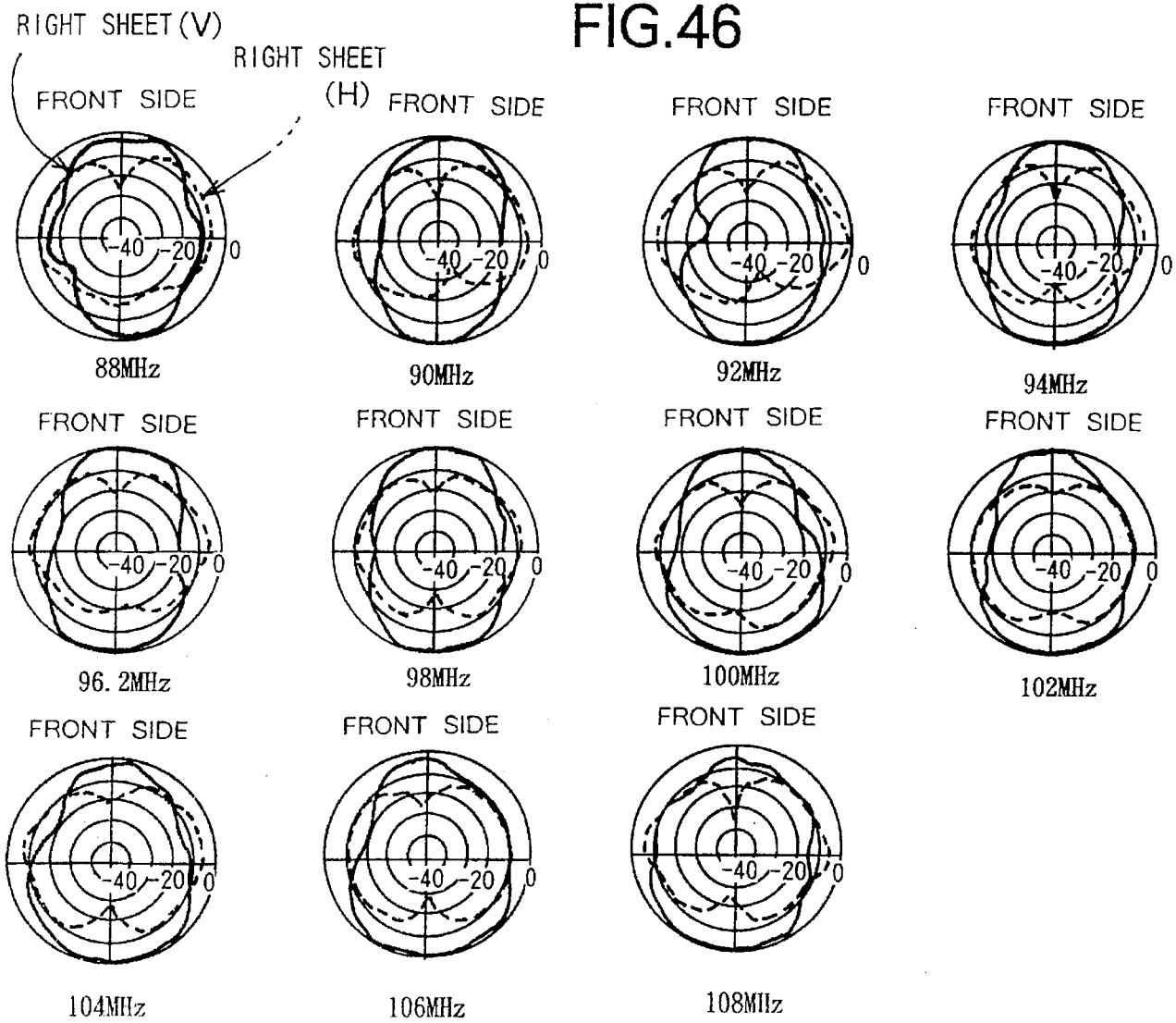
FIG. 46 is a characteristic graph showing the directivity to a horizontally polarized wave and a vertically polarized wave of the right electric conductor sheet as a main antenna in the same antenna arrangement.
Figure 47:
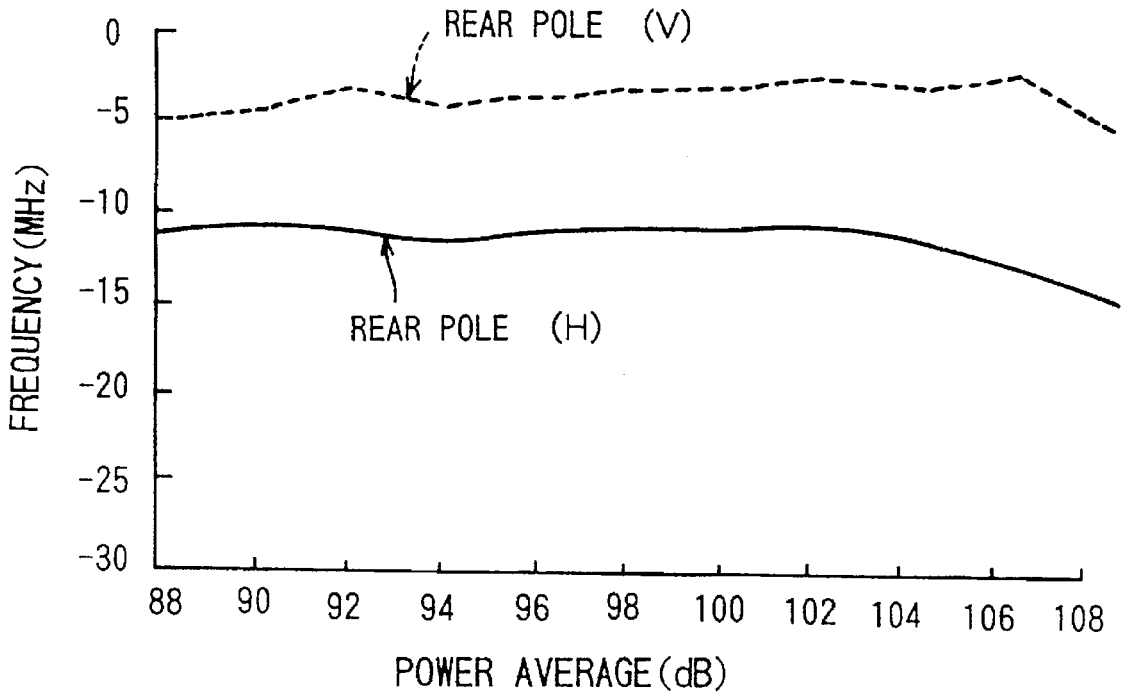
FIG. 47 is a characteristic graph showing the respective receiving sensitivity characteristics of a horizontally polarized wave and a vertically polarized wave of a rear pole antenna.
Figure 48:
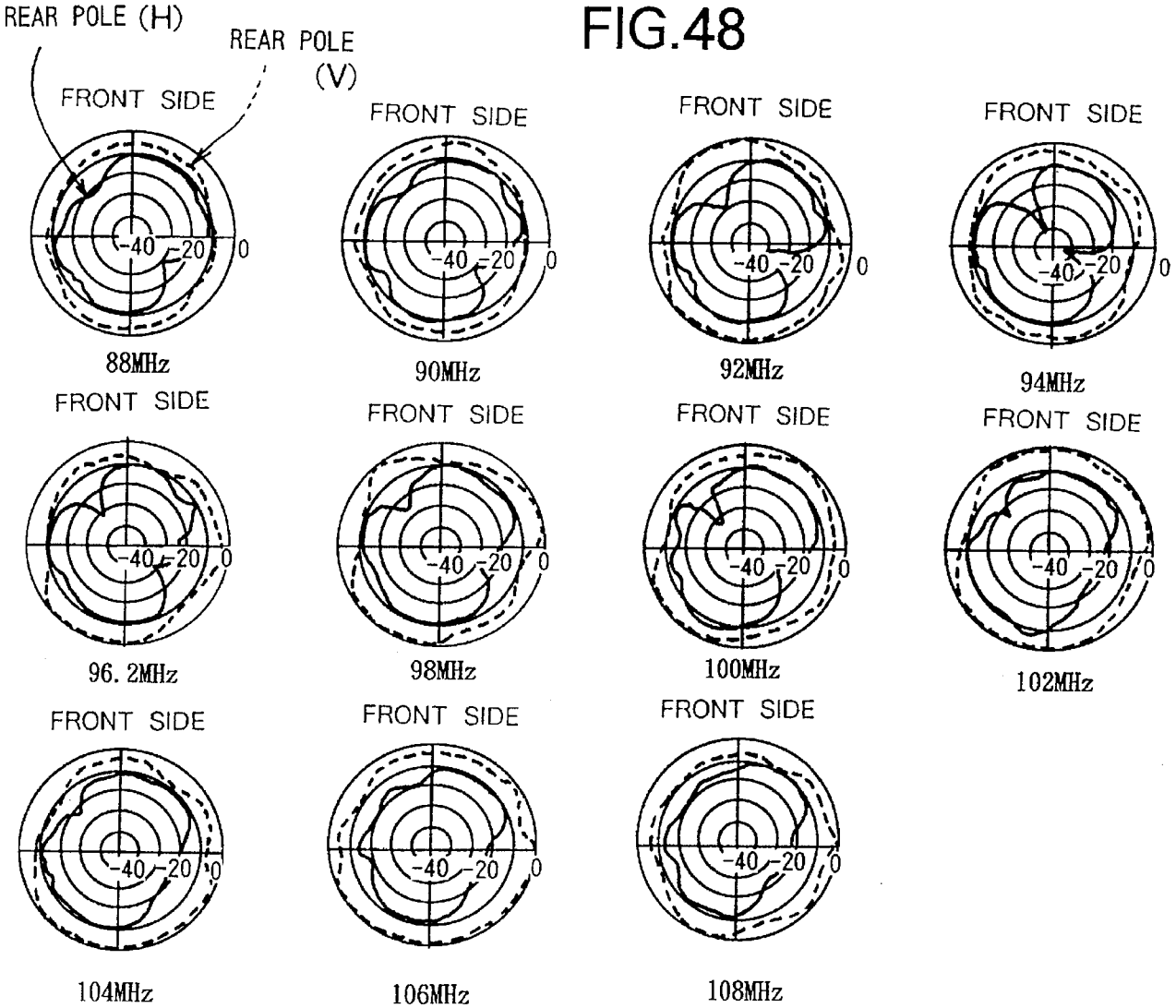
FIG. 48 is a characteristic graph showing the directivity of each of a horizontally polarized wave and a vertically polarized wave of the rear pole antenna.

FIG. 45 shows the receiving sensitivity characteristics of each of a horizontally polarized wave and a vertically polarized wave when an electric conductor wire extending up to the position of the seventh heating wire is disposed at the center in the right to left direction of a defogger and a left electric conductor sheet (left sheet) serving as the subantenna of a diversity antenna is disposed to a glass space portion above the defogger with a gap of 24 mm from the defogger and a right electric conductor sheet (right sheet) serving as the main antenna of the diversity antenna is disposed in the same way with the gap of 4 mm, respectively. Further, FIG. 46 shows a directivity of each of a horizontally polarized wave and a vertically polarized wave of the right electric conductor sheet as the main antenna in the same antenna arrangement. On the other hand, FIG. 47 shows the receiving sensitivity characteristics of each of a horizontally polarized wave and a vertically polarized wave of a rear pole antenna generally used in vehicles and FIG. 48 shows a directivity of each of the a horizontally polarized wave and a vertically polarized wave of the rear pole antenna. When they are compared, it is found that the glass antennas of the present invention can obtain the same receiving sensitivity characteristics and directivity as those of the rear pole antenna with respect to both of the a horizontally polarized wave and a vertically polarized wave.

Figure 49:
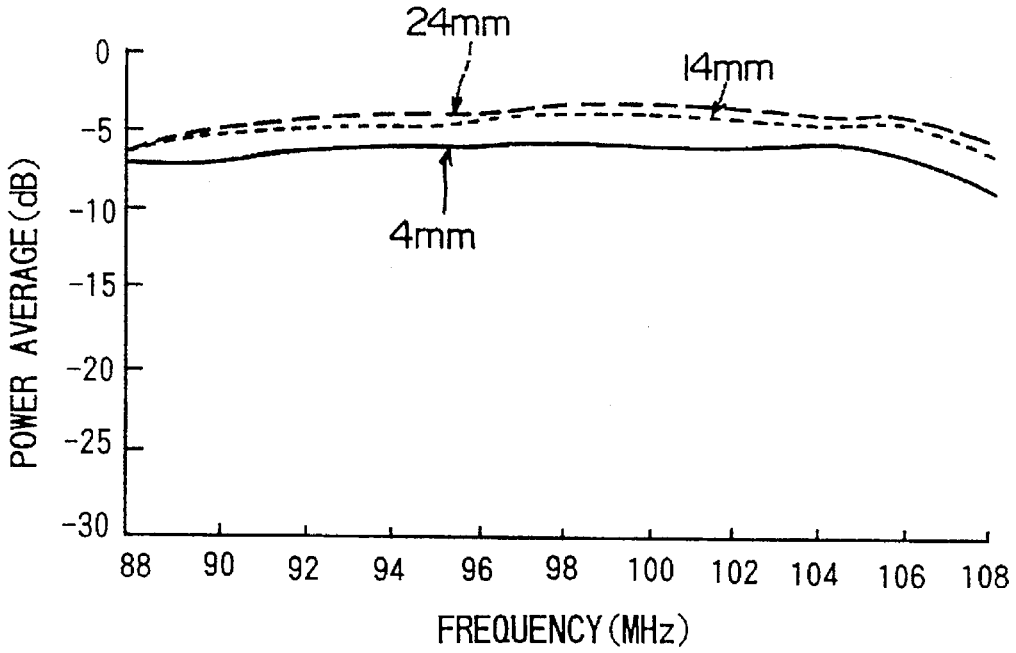
FIG. 49 is a characteristic graph showing the receiving sensitivity characteristics of a vertically polarized wave of a right electric conductor sheet when a pair of the right electric conductor sheet and a left electric conductor sheet each having a right to left width of 10 cm are disposed in a glass space portion above a defogger with the gap between the right electric conductor sheet and the defogger fixed and the gap between the left side electric conductor sheet and the defogger changed.
Figure 50:
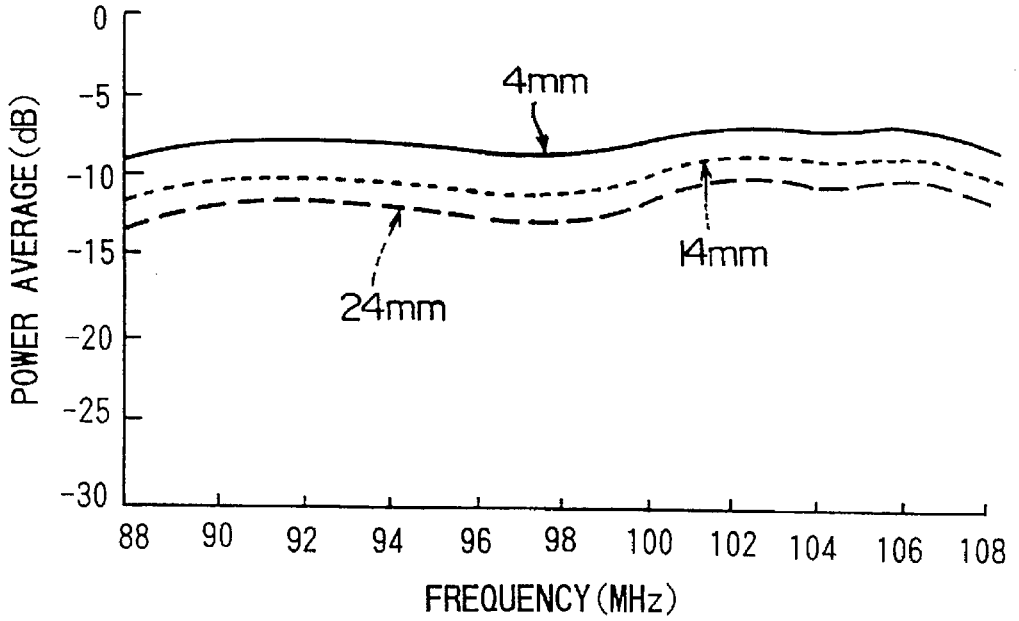
FIG. 50 is a characteristic graph showing the receiving sensitivity characteristics of a vertically polarized wave of the left electric conductor sheet under the above conditions.

FIG. 49 shows the receiving sensitivity characteristics of a vertically polarized wave in a right electric conductor sheet (main antenna) when a pair of the right electric conductor sheet and a left electric conductor sheet each having a right to left width of 10 cm are disposed to a space portion above the defogger arranged as described above, the gap between the right electric conductor sheet serving as the main antenna of a diversity antenna and the defogger is fixed to 4 mm and the gap between the left electric conductor sheet serving as the subantenna thereof and the defogger is changed. Further, FIG. 50 shows the receiving sensitivity characteristics of a vertically polarized wave in the left electric conductor sheet (subantenna) in the same antenna arrangement. From the aforesaid, it is found that when the gap between the left electric conductor sheet and the defogger is the same as the gap between the right electric conductor sheet and the defogger, the receiving sensitivity of the right electric conductor sheet is lowered, but as the gap between the left electric conductor sheet and the defogger is increased, the receiving sensitivity of the right electric conductor sheet is returned to its original receiving sensitivity accordingly.

Figure 51:
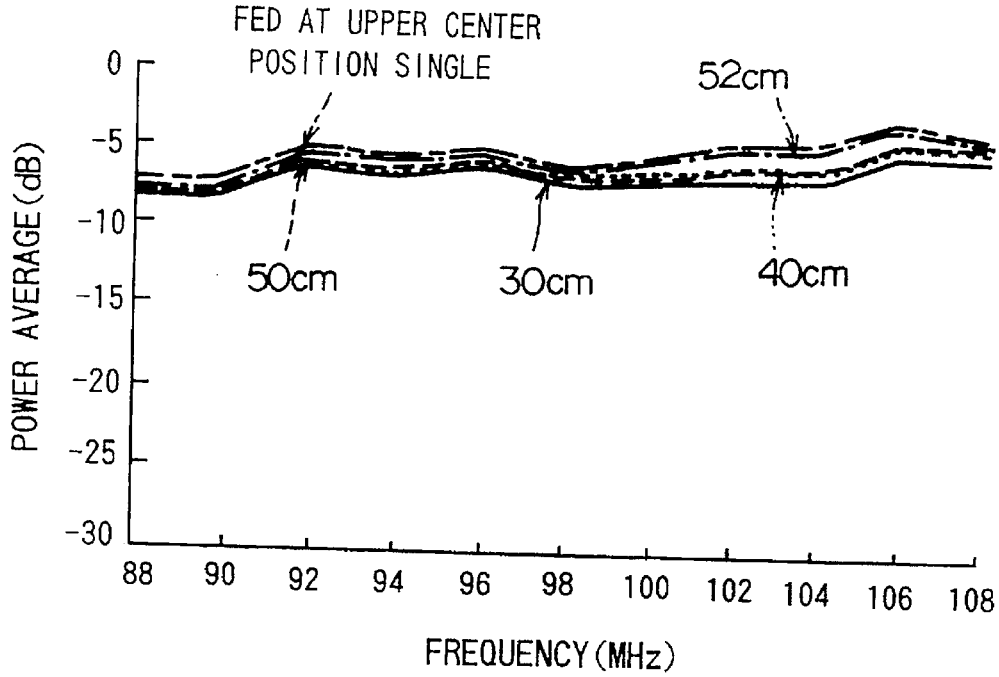
FIG. 51 is a characteristic graph showing the receiving sensitivity characteristics of a vertically polarized wave of a main antenna when an electric conductor sheet serving as the main antenna is disposed in a space portion above a defogger at the center in the right and left direction of the space portion and a power feed position to a subantenna disposed by being offset from the center in the right and left direction is changed.

FIG. 51 shows the receiving sensitivity characteristics of a vertically polarized wave in a main antenna when an electric conductor sheet serving as the main antenna of a diversity antenna is disposed at the center in the right and left direction of a space potion above a defogger, another subantenna is disposed by being offset from the center in the right and left direction (refer to FIG. 9 showing the fifth embodiment) and a power feed position to the subantenna is changed. In FIG. 51, "52 cm" means that the power feed position to the subantenna is set at the position of 52 cm. Further, "fed at upper center position" shows the characteristics for comparison when a current feeding point is disposed at the upper center position of the electric conductor sheet in a single antenna system employing the electric conductor sheet only. It is found from FIG. 51 that even if the power feed position to the subantenna is changed the receiving sensitivity characteristics of the main antenna are not changed.

Figure 52:
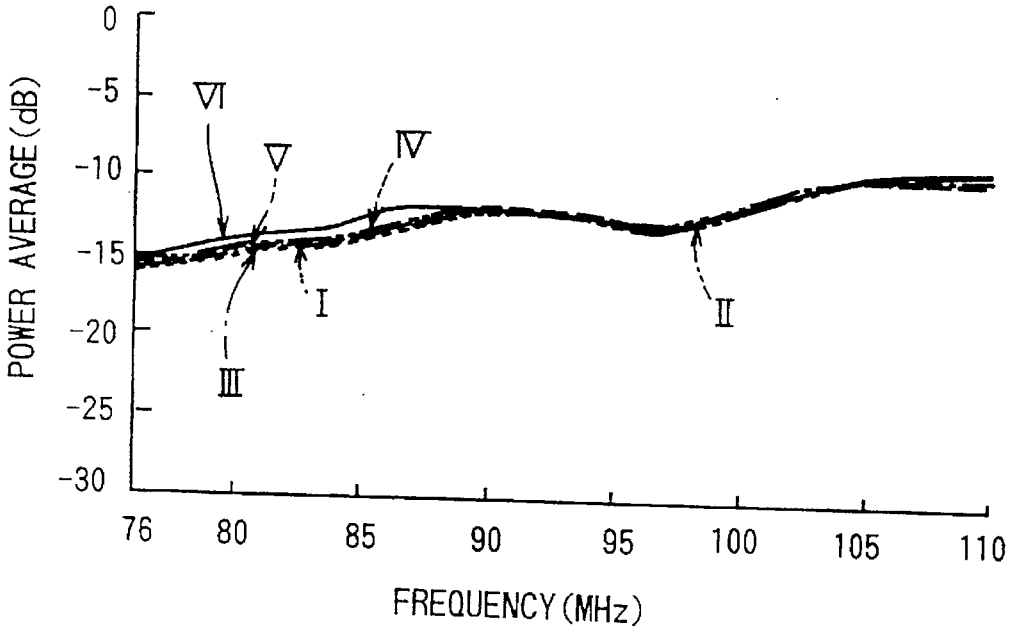
FIG. 52 is a characteristic graph showing the receiving sensitivity characteristics of a horizontally polarized wave when the structure of a right electric conductor sheet disposed above a defogger is variously changed.
Figure 53:
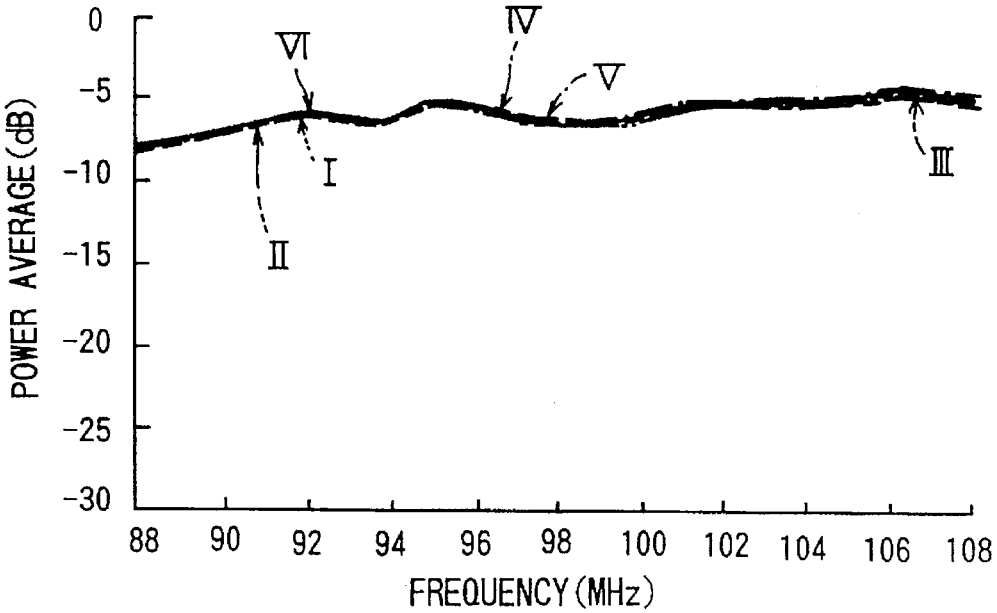
FIG. 53 is a characteristic graph showing the receiving sensitivity characteristics of a vertically polarized wave of the right electric conductor sheet.

FIG. 52 shows the receiving sensitivity characteristics of a horizontally polarized wave with respect to the characteristics (characteristics VI) of an antenna arranged such that a right electric conductor sheet (solid sheet having a right to left width of 10 cm) is disposed above a defogger and offset 23 cm to the right from the center in the right and left direction of the defogger, the characteristics (I) of an antenna arranged such that the above electric conductor sheet has a space portion formed therein and is formed to a hollow frame having a width of 2 mm, the characteristics (II) of an antenna arranged such that a conductor wire (lateral wire) is stretched in the right and left direction in the space portion formed in the frame of 2 mm wide, the characteristics (III) of an antenna arrange such that two conductor wires (cross wires) are horizontally and vertically stretched in the above space portion, the characteristics (IV) of an antenna arranged such that three conductor wires are horizontally stretched and a conductor wire is vertically stretched in the space portion, respectively, and the characteristics (V) of an antenna arranged such that three conductor wires are horizontally and vertically stretched in the space portion, respectively. FIG. 53 shows the receiving sensitivity characteristics of a vertically polarized wave in the antennas as described above. According to these characteristics, it is found that the electric conductor sheets which include the space portion therein or have a single or a plurality of conductor wires stretched in the space portion thereof are equivalent and uniform to a solid electric conductor sheet and any of the electric conductor sheets can obtain the same antenna performance as that of the solid electric conductor sheet.

Figure 54:
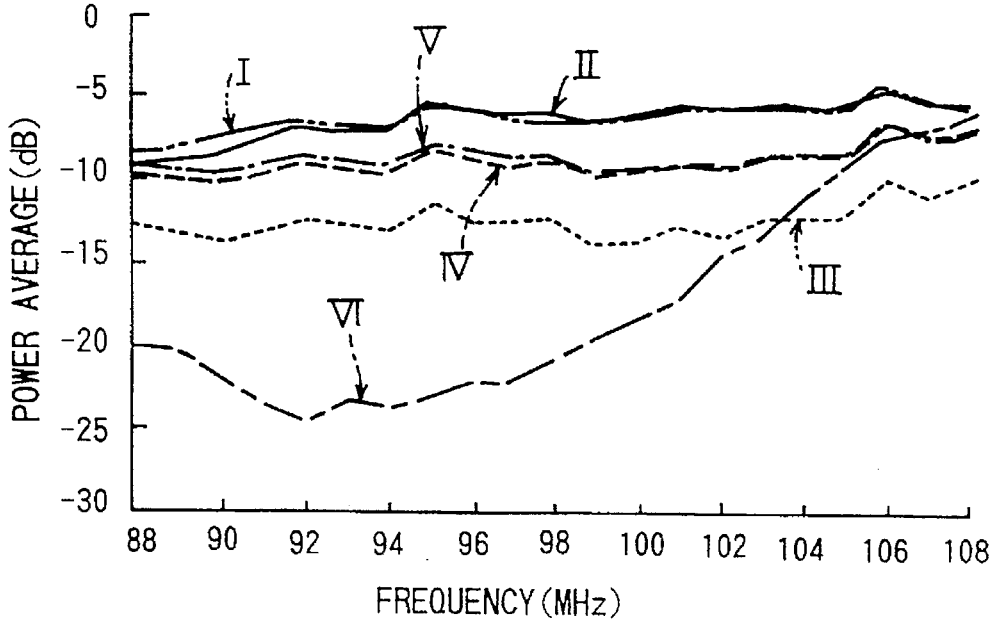
FIG. 54 is characteristic graph showing the receiving sensitivity characteristics of a vertically polarized wave of a right electric conductor sheet having a right to left width of 10 cm and disposed above a defogger when the connection of the sheet to the defogger is variously changed.

FIG. 54 shows the receiving sensitivity characteristics of a vertically polarized wave with respect to the characteristics (I) of an antenna arranged such that a right electric conductor sheet, which has a right to left width of 10 cm and formed to a frame shape of 2 mm wide by the formation of a space portion therein, is disposed above a defogger and three conductor wires are horizontally and vertically stretched in the space portion, respectively, the characteristics (II) of an antenna arranged such that the above electric conductor sheet is connected to the defogger through a coil of 10 μH, the characteristics (III) of an antenna arranged such that the electric conductor sheet is connected to the defogger through a conductor wire extending from the electric conductor sheet right under it, the characteristics (IV) of an antenna arranged such that the electric conductor sheet is connected to the defogger through a conductor wire of 1 mm disposed in a reverse direction, the characteristics (V) of an antenna arranged such that the electric conductor sheet is connected to the defogger by removing the ground side bus bar of the defogger, and the characteristics (VI) of an antenna arranged such that the electric conductor sheet is directly connected to the bus bar of the defogger. According to these characteristics, it is found that when the electric conductor sheet is connected to the defogger, the receiving sensitivity of the main antenna can be improved and maintained to the same degree as that of a reference state by properly connecting them.

[Principle]

In the glass antennas of the first embodiment to the sixth embodiment described above, the first antenna conductor is composed of the electric conductor sheet (first embodiment) or the thick conductor wire (third embodiment). However, the first antenna conductor arranged as described above is not preferable as an antenna for vehicles because it narrows a rear view. Thus, a reason why the heating wire of the defogger can be prevented from affecting the operation of the antenna, which is a common subject of the first embodiment to the sixth embodiment, will be described first. After the description, a structure by which the heating wire of the defogger is prevented from affecting the operation of the antenna will be embodied and an embodiment capable of securing the good rear view by use of a thin conductor will be sequentially described.

Figure 55:
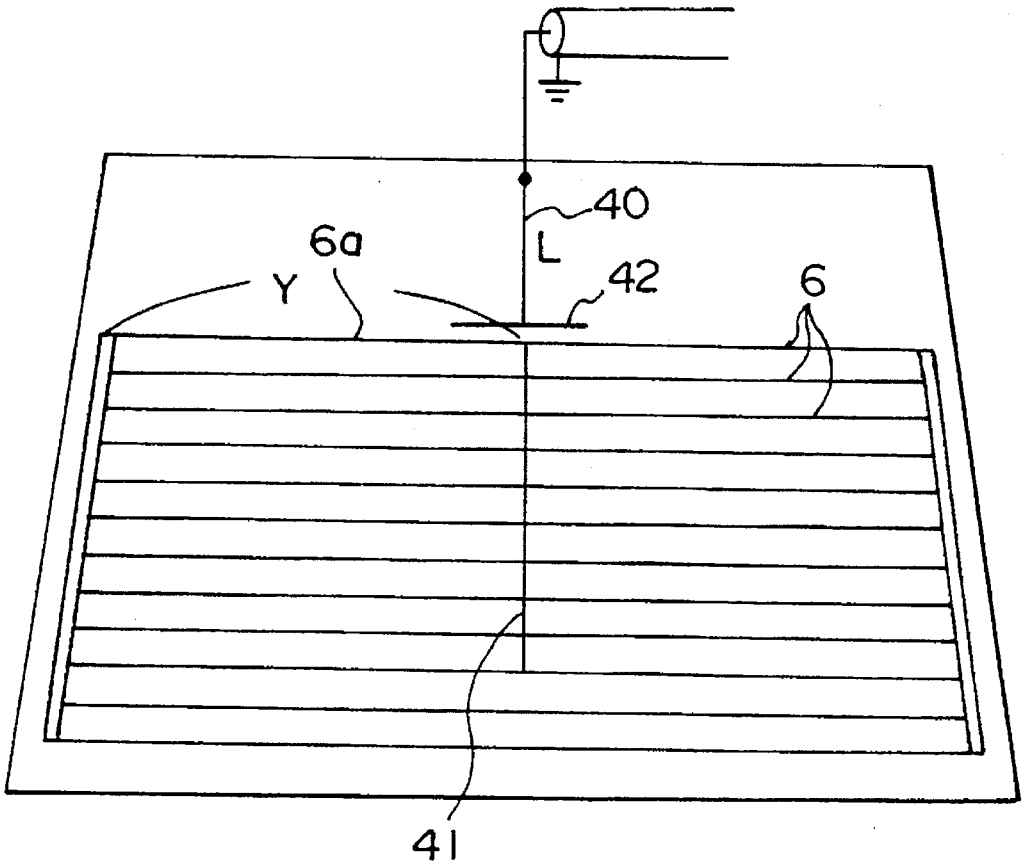
FIG. 55 is a view showing the principle of the arrangement of an antenna to explain why the effect of a defogger is minimized.
Figure 56:
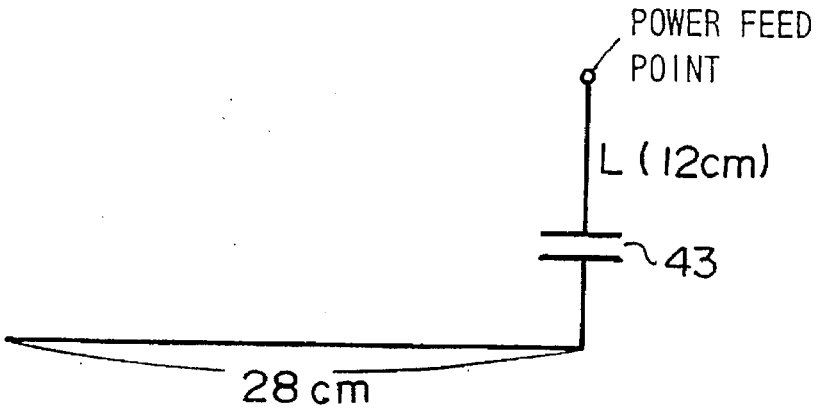
FIG. 56 is a view showing the arrangement of an antenna as a model to explain a principle why the effect of the defogger is minimized.
Figure 57:
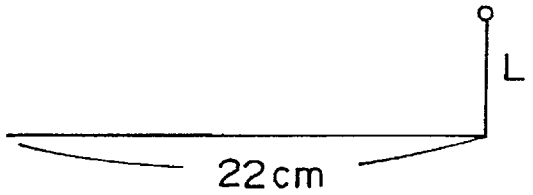
FIG. 57 is a view showing the arrangement of an antenna as a model to explain a principle why the effect of the defogger is minimized.
Figure 58:
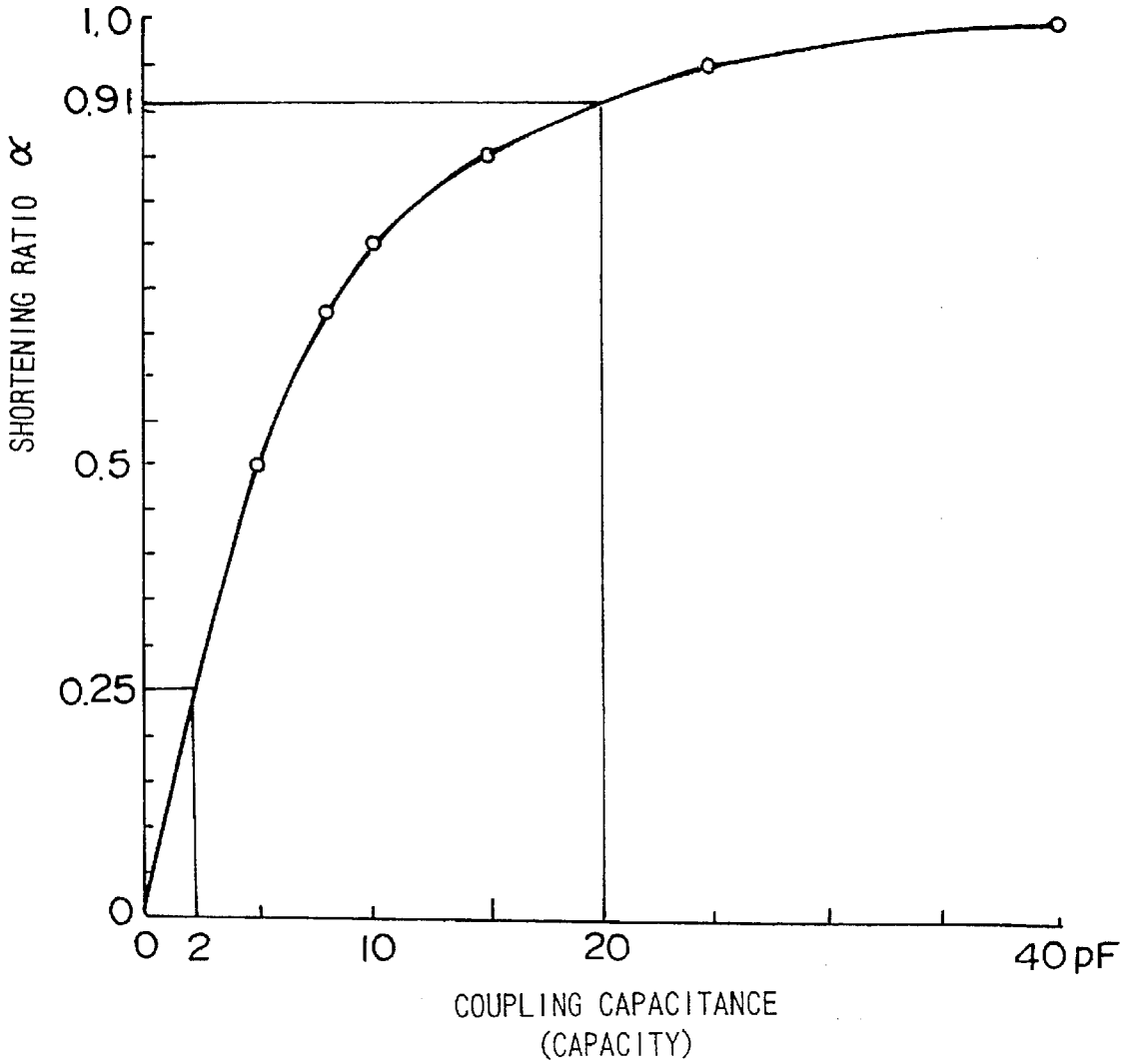
FIG. 58 is a graph showing the relationship between a shortening ratio a and a coupling capacitance C.
Figures 59, 60:
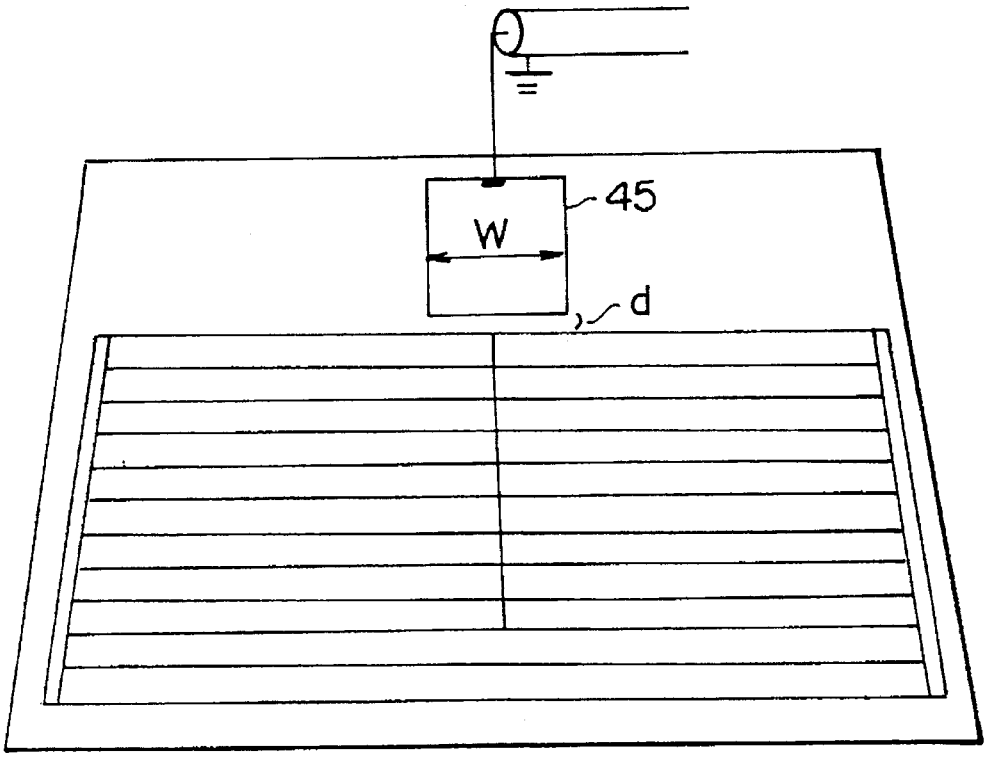
FIG. 59 is a table showing the relationship between a shortening ratio a and a coupling capacitance C by way of example.
FIG. 60 is a plan view showing the arrangement of a glass antenna of a seventh embodiment.

FIG. 55 shows the region of a defogger in which heating wires 6 are disposed and a conductor 41 is stretched across the heating wires 6. A conductor 42 is disposed in parallel with the uppermost heating wire 6*a* and a conductor 40 is disposed perpendicularly to the conductor 42. The conductor 40 corresponds to the electric conductor sheet 13 in the first embodiment, and the like. The conductor 41 corresponds to the conductor 18 of the first embodiment, and the like. It is assumed that the length of the conductor 40 from a current feeding point is L and the length of the heating wire (the uppermost heating wire 6*a*) of the defogger is 2Y. An equivalent circuit diagram as shown in FIG. 56 will be considered to examine the relationship between the conductor 40 and the heating wires 6. In FIG. 56, a capacitor 43 is composed of a coupling capacitance of the conductor 42 and the heating wire 6*a*. An antenna shortening ratio achieved by the capacitor 43 is represented by α. When it is assumed that a coupling capacitance C=11 pF (84 MHz) L=12 cm and Y=28 cm, the antenna shown in FIG. 56 is made equivalent to the antenna shown in FIG. 57 by the shortening effect of the capacitor 43. Since the length of the antenna conductor located behind the capacitor 43 is shortened from 28 cm to 22 cm, the shortening ratio by capacitor α is represented by α=22/28. The relationship between the shortening ratio α and the coupling capacitance could be experimentally determined as shown in FIG. 58 and FIG. 59. According to the graph shown in FIG. 58, as the coupling capacitance C increases, the shortening ratio α is increased. When the coupling capacitance C exceeds 40 pF, the shortening ratio α does not exceeds 1 even if the coupling capacitance C increases more. This shows that it is meaningless to increase the coupling capacitance in excess of 40 pF.

It suffices only to greatly increase the impedance of the heating wire 6 having the length of 2Y to prevent the heating wire from greatly affecting the antenna. As a result of the experiment, the inventors have found that it suffices only to set the relationship between the length L of a conductor (a portion of an antenna), the length Y of a heating wire (the uppermost heating wire) and the shortening ratio α by capacitance coupling so that the relationship satisfies the following formula (1) in order to greatly increase the impedance of the heating wire 6.

$$\beta \cdot \frac{\lambda}{4} = L + \alpha \cdot Y \tag{1}$$

where, λ is the wavelength of a radio wave to be received and β is an antenna shortening ratio by glass and it is known that β is usually about 0.6 in the case of glass for vehicles.

When the formula (1) is modified, the following formula (2) can be obtained.

$$\alpha = \left( \frac{\beta \cdot \lambda}{4} - L \right) \cdot \frac{1}{Y} \tag{2}$$

The case in which a different vehicle is used will be examined using the formula (2). When the length L is increased depending upon a vehicle, since it is found from the formula (2) that α is made small, the coupling capacitance C is reduced in accordance with the graph of FIG. 58 to reduce the effect of a defogger. On the other hand, in a vehicle in which the length Y is short, since it is found from the formula (2) that α is made large, the capacitance C is set to a large value.

The setting of the defogger determined by the above method so that the defogger does not almost affect the characteristics of antenna is shown by the following formula when a wavelength is in an FM frequency band.

$$70\ cm \leqq \lambda/4 \leqq 100\ cm$$

When the above formula is expressed in a vehicle mounted state, the above formula is multiplied by the glass shortening ratio (β=0.6) to obtain the following formula.

$$42\ cm \leqq \beta \cdot \lambda/4 \leqq 60\ cm,$$

that is, $$42\ cm \leqq L + \alpha \cdot Y \leqq 60\ cm$$

Note, the relationship expressed by the formula (1) is established when the ideal state that the end of the bus bar of a defogger is short-circuited to a vehicle body is assumed. Since it can be assumed in an actual vehicle that the bus bar is connected to the body through a certain degree of capacitance coupling, it has been experimentally obtained that a preferable area to be taken by the above $L+\alpha\cdot Y$ for FM radio is given by the following formula.

$$20\ cm \leqq L+\alpha\cdot Y \leqq 70\ cm \quad (3)$$

Further, the following formula is obtained with respect to an antenna which is suitably used in North America where the frequency band of 88 MHz to 108 MHz is used for FM radio.

$$40\ cm \leqq L+\alpha\cdot Y \leqq 50\ cm$$

On the other hand, with respect to the frequency band of 76 MHz to 90 MHz used as FM radio wave in Japan, an glass antenna set to satisfy the following formula particularly exhibits a preferable performance.

$$50\ cm \leqq L+\alpha\cdot Y \leqq 60\ cm$$

Further, since the antenna actually receives radio waves in a frequency band having a certain range such as radio waves for FM radio, it is of course preferable that $L+\alpha\cdot Y$ has a length corresponding to the frequency which is substantially at the center of a frequency band to be received.

[Seventh Embodiment] Application of Loop Conductor to Antenna

Figure 61:
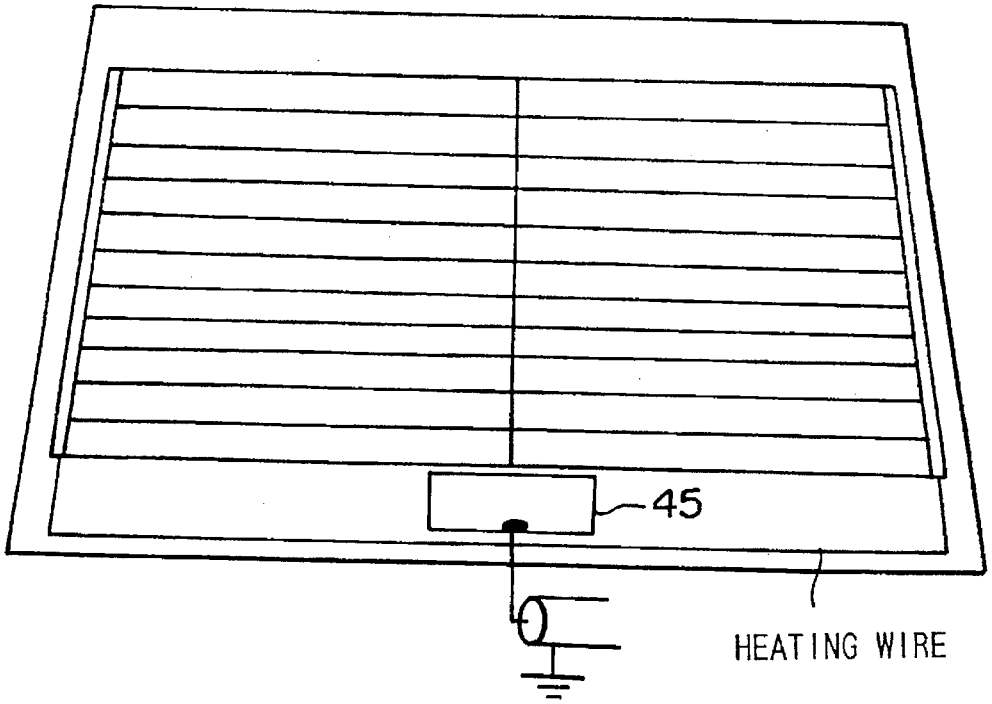
FIG. 61 is a plan view showing the another arrangement of the glass antenna of the seventh embodiment.
Figure 62:
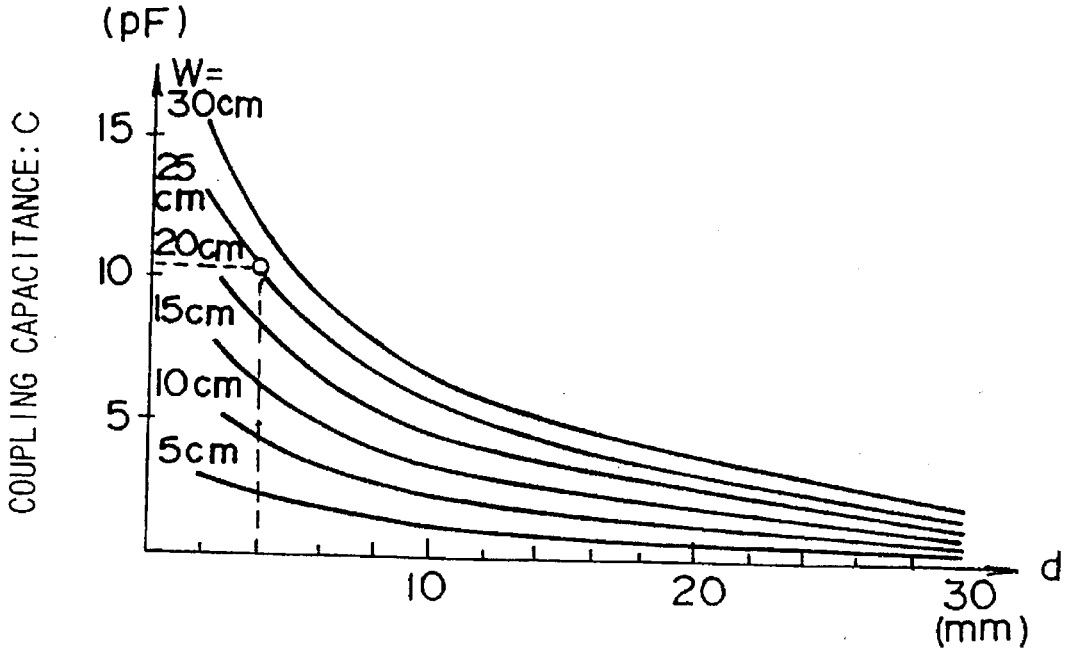
FIG. 62 is a graph showing the relationship between the coupling capacitance C and the gap d in the embodiment.

FIG. 60 and FIG. 61 show an antenna (seventh embodiment) obtained by replacing the first conductor 40 portion of the antenna shown in FIG. 55 with a loop 45, the antenna in FIG. 55 being a model for explaining the principle of the first embodiment to the sixth embodiment. A feature of the loop conductor is that it has a width W in a vehicle width direction and when such a loop conductor is used, a coupling capacitance can be easily set by changing the width W. FIG. 62 shows how the coupling capacitance is changed when the width W of the loop conductor 45 as the first antenna conductor is variously changed and when the distance d between the loop conductor 45 and the heating wire 6 of a defogger is variously changed.

Figure 63:
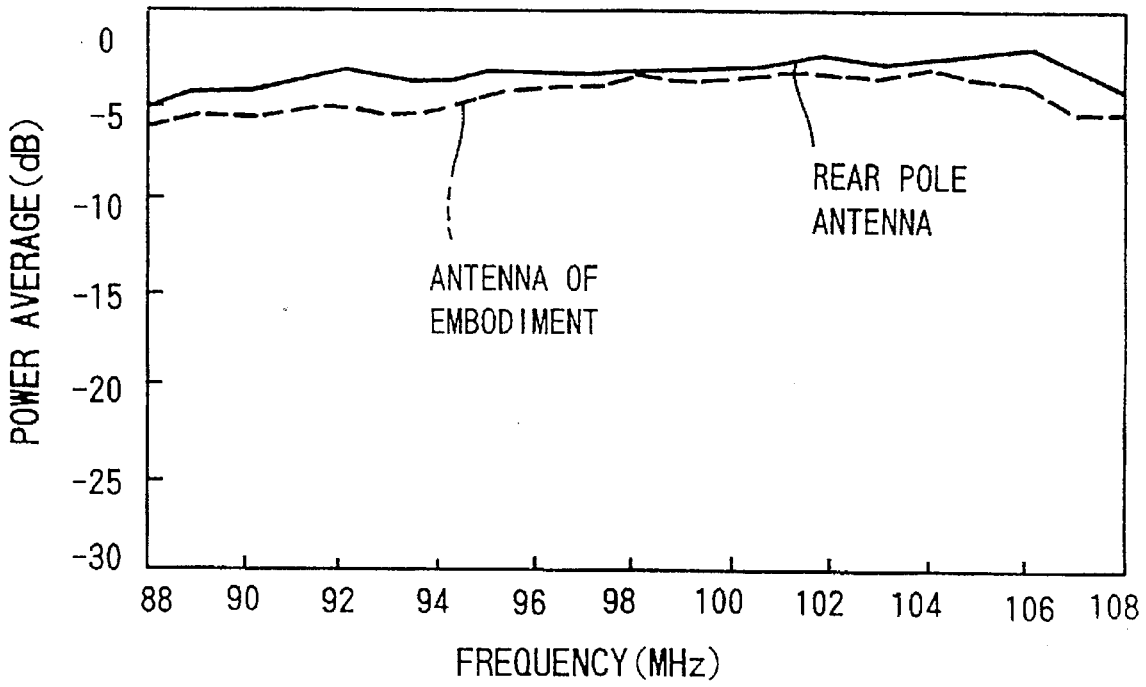
FIG. 63 is a graph showing the result of comparison of the performance (vertically polarized wave) of a rear pole antenna with that of the antenna of the embodiment.
Figure 64:
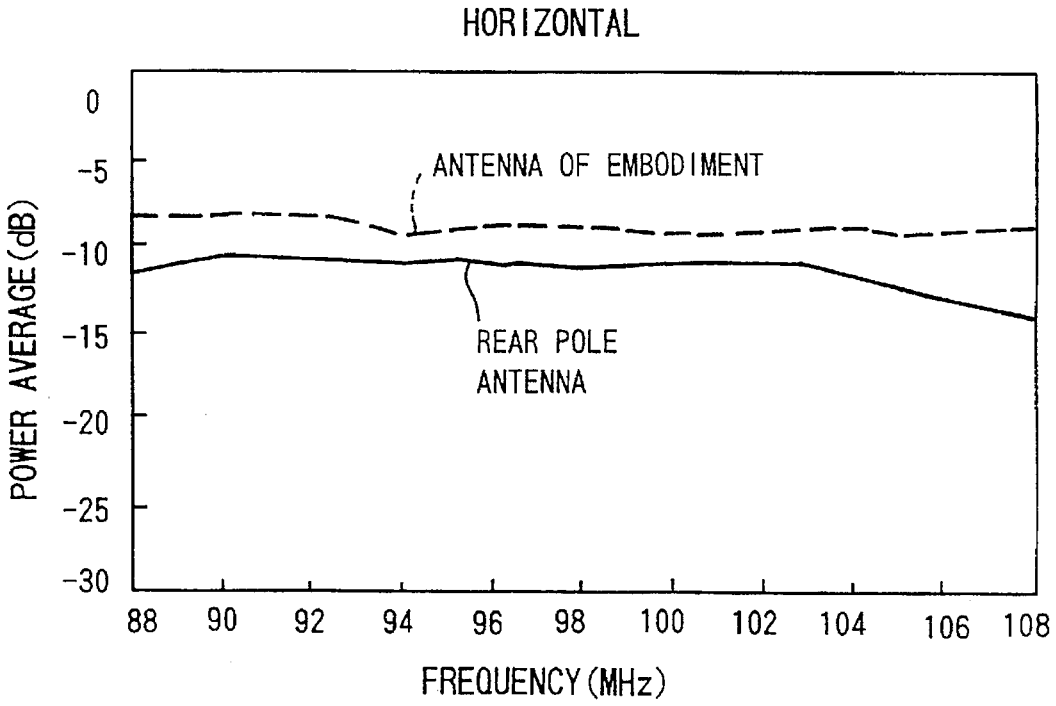
FIG. 64 is a graph showing the result of comparison of the performance (horizontally polarized wave) of the rear pole antenna with that of the antenna of the embodiment.

FIG. 63 shows the result of comparison of the performance of a glass antenna having the shape shown in the seventh embodiment of FIG. 60 with that of a conventional rear pole antenna (90 cm rod antenna) (when a polarized surface is vertical) and FIG. 64 shows the result of the same comparison (when the polarized surface is horizontal). In FIG. 63 and FIG. 64, the solid lines show the characteristics of the rear pole antenna and the broken lines show the characteristics of the glass antenna of FIG. 60. The power average shows an average received strength at each frequency. As apparent from the comparison of the broken lines (the antenna of the embodiment) with the solid lines (prior art rear pole antenna), it is found that the glass antenna of the embodiment exhibits a performance which is not inferior to that of the rear pole antenna. In particular, since the glass antenna is greatly superior to the rear pole antenna with respect to maintenance, noise produced when the pole antenna travels with a swing of its body and the like, when a sufficient performance as antenna can be obtained by the glass antenna, the glass antenna has a very large value in practical use.

Figure 65:
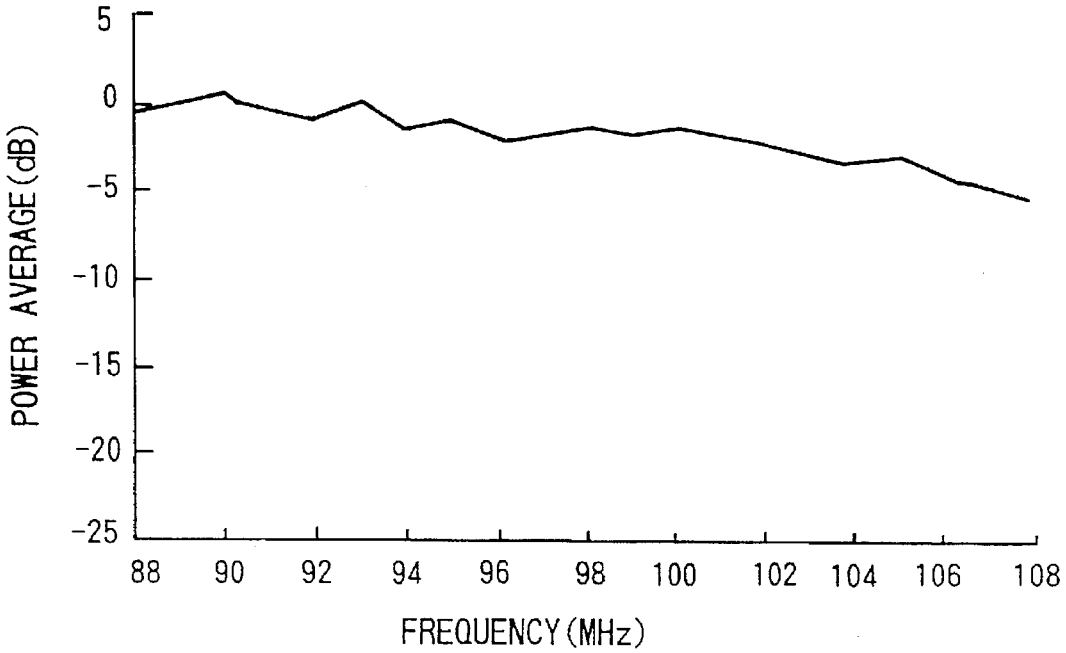
FIG. 65 is a graph explaining the receiving characteristics (vertically polarized wave) of the antenna of the embodiment.
Figure 66:
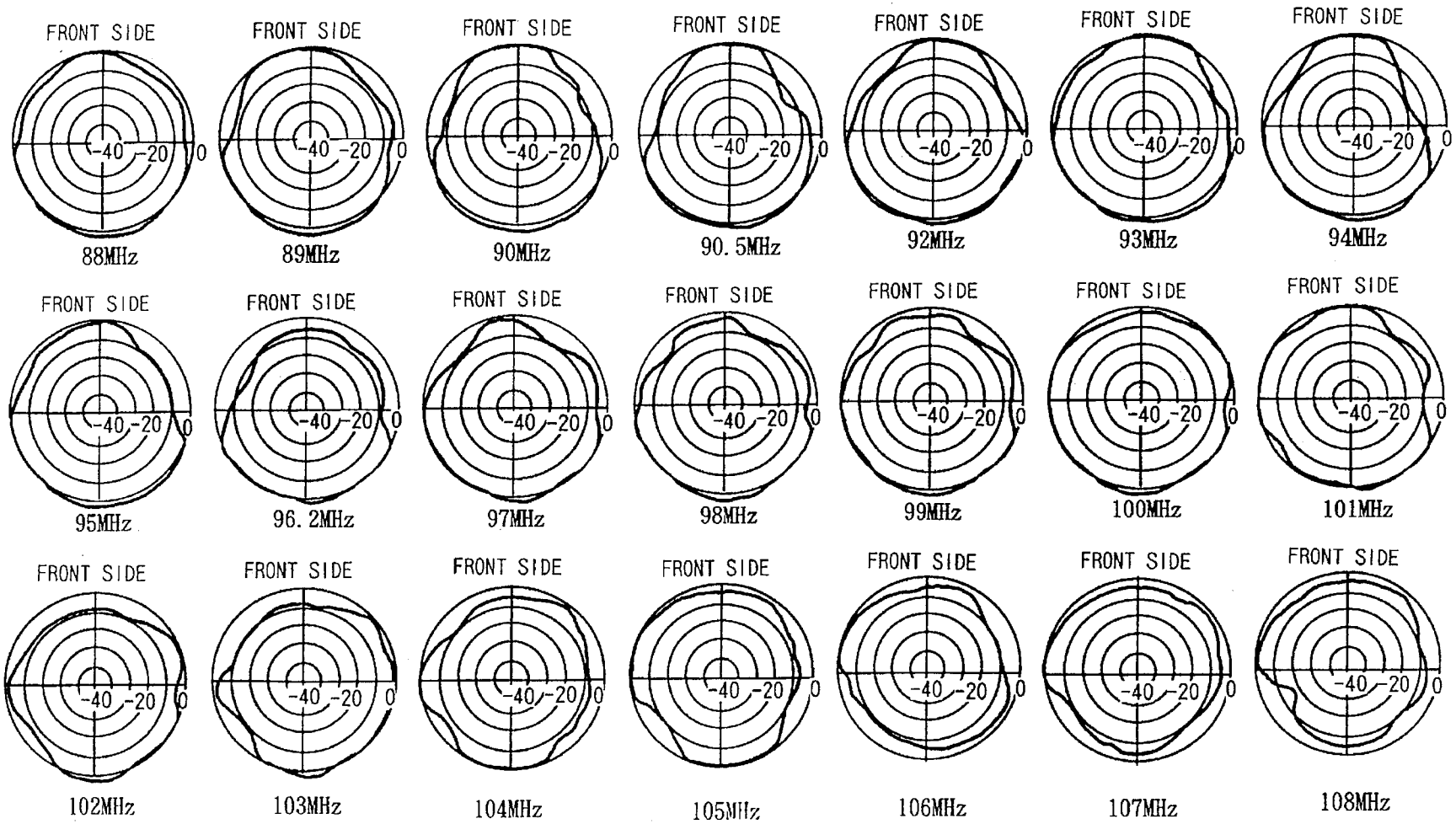
FIG. 66 is views explaining the directive characteristics of the antenna of the embodiment to a vertically polarized wave.
Figure 67:
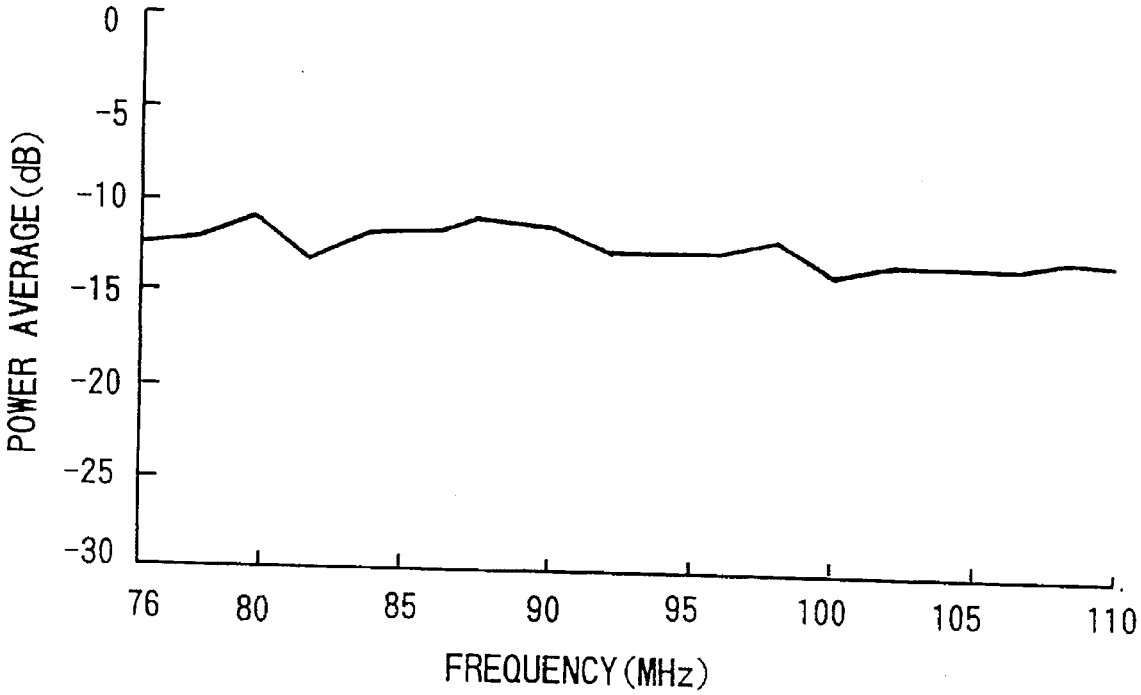
FIG. 67 is a graph explaining the receiving characteristics (horizontally polarized wave) of the antenna of the embodiment.
Figure 68:
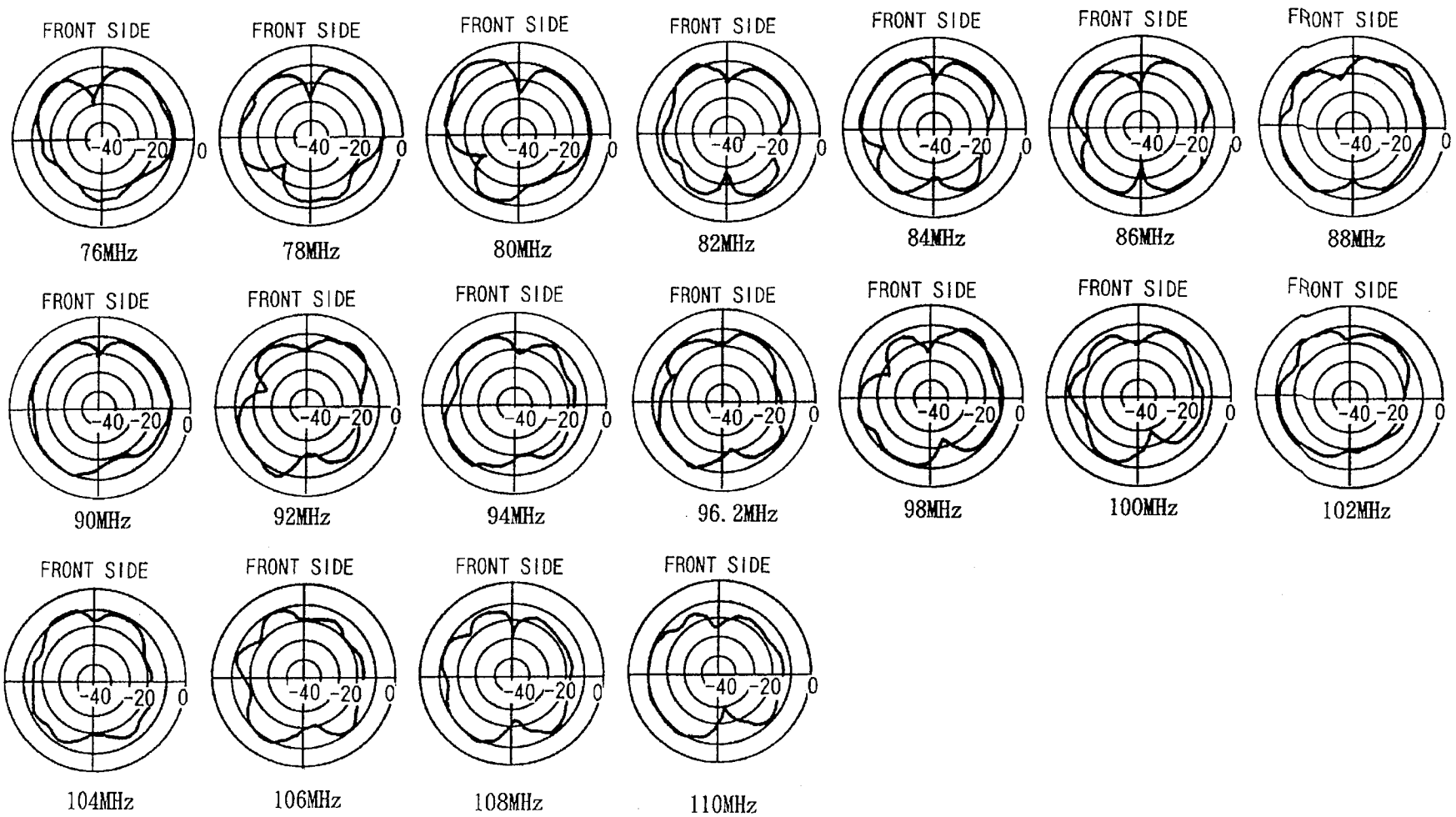
FIG. 68 is views explaining the directive characteristics of the antenna of the embodiment to a horizontally polarized wave.

Next, FIG. 65 to FIG. 68 show the characteristics of an example arranged such that the loop conductor 45 (W=20 cm) is disposed below a defogger and electric current is fed to the antenna 45 at the center of the defogger. In particular, FIG. 65 shows the power average when a polarized surface is vertical and FIG. 66 shows directivity characteristics when a vertically polarized radio wave is received in the same way. Further, FIG. 67 shows the power average when a polarized surface is horizontal and FIG. 68 shows directivity characteristics when a horizontally polarized radio wave is received in the same way.

It is found from these graphs that the loop conductor portion may be disposed below the defogger.

[Comparison when Antenna Shape is Changed]

Figures 69, 70:
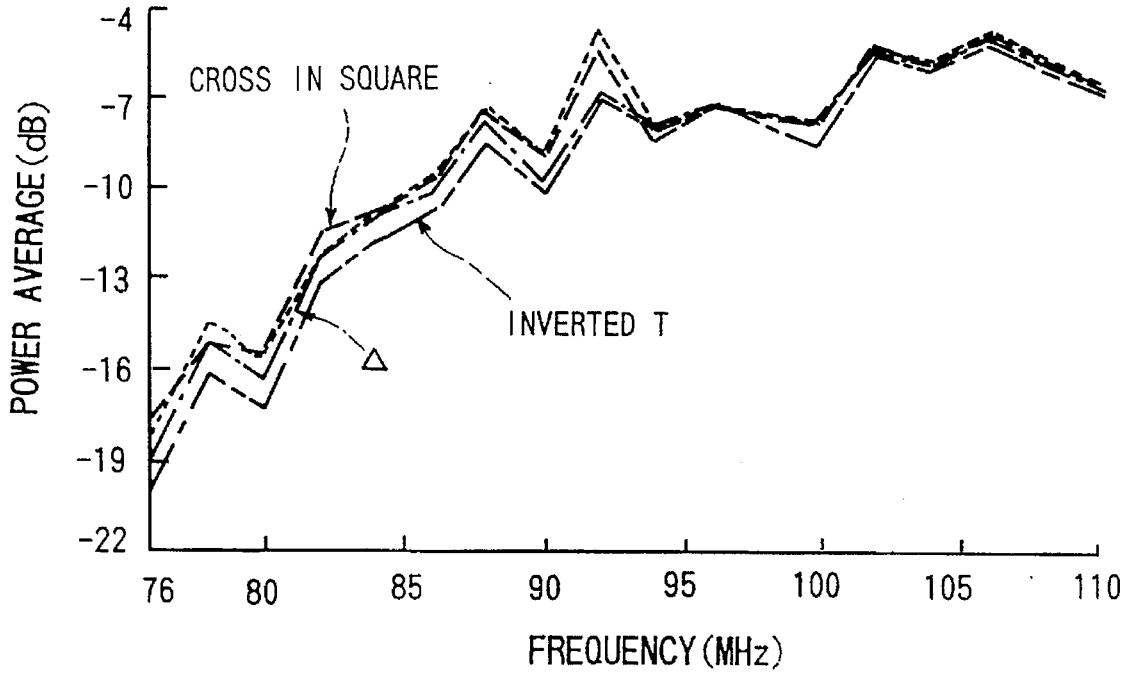
FIG. 69 is a graph showing the change of characteristics (vertically polarized wave) when the configuration of a first antenna is changed in the antenna of the embodiment.
FIG. 70 is a table showing the change of characteristics (vertically polarized wave) when the configuration of the first antenna is changed in the antenna of the embodiment.
Figures 71, 72:
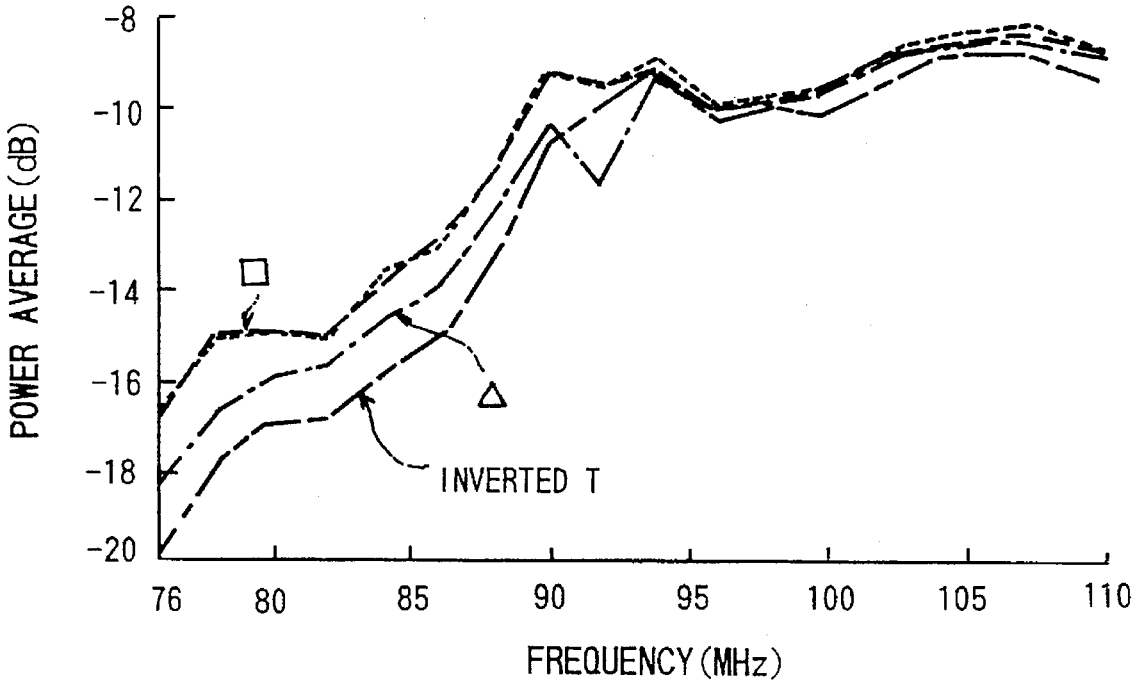
FIG. 71 is a graph showing the change of characteristics (horizontally polarized wave) when the configuration of the first antenna is changed in the antenna of the embodiment.
FIG. 72 is a table showing the change of characteristics (horizontally polarized wave) when the configuration of the first antenna is changed in the antenna of the embodiment.

Next, FIG. 69–FIG. 72 compare the characteristics of the first antenna conductor as a glass antenna when the shape of the first antenna conductor is variously changed. FIG. 69–FIG. 70 shows the case that a polarized surface is vertical and FIG. 71–FIG. 72 show the case that the polarized surface is horizontal. For the convenience of illustration, a symbol "■" shows the characteristics of an entirely adhered electric conductor sheet 13 as that shown in the first embodiment, a symbol "cross-in-square" shows the characteristics of an antenna conductor element having two cross-shaped conductors disposed in a loop conductor (formed to a square, such as, for example, shown in FIG. 5), a symbol "two-horizontal-line-in-square" shows the characteristics of an antenna conductor element having two minus-letter-shaped conductors disposed in a loop conductor, a symbol "Δ" shows the characteristics of a triangular antenna conductor element, and a symbol "inverse T" shows the characteristics of an antenna conductor element such as shown in FIG. 55. From the tables shown in FIG. 70 and FIG. 72, it is found that a glass antenna having an excellent performance can be obtained using any of the loop conductors shown in the symbols "two-horizontal-line-in-square", "cross-in-square", "Δ" and the like.

[Experiment Data]

Next, it will be described that an antenna such as shown in FIG. 60 which has the shape shown in the first embodiment is an antenna having characteristics similar to those of the mono-pole type antenna shown in FIG. 73. Then, it will be described with reference to graphs that when the length of the mono-pole type antenna as a glass antenna is variously changed, how the characteristics of the mono-pole type antenna are changed.

Figure 73:
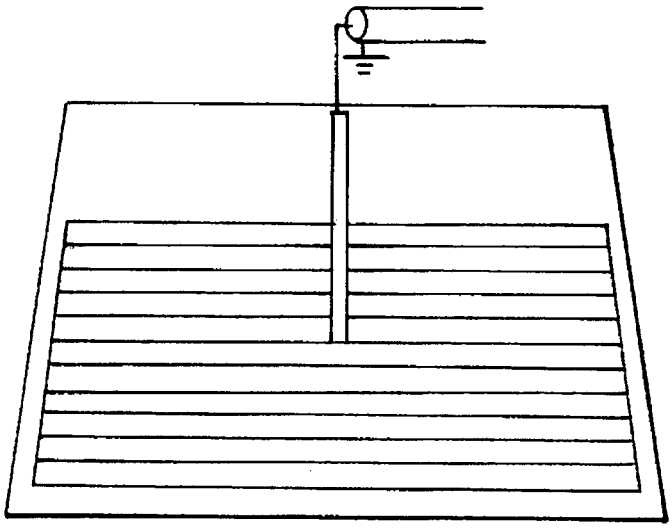
FIG. 73 is a view showing the principle of the arrangement of a mono-pole type antenna disposed to a glass without a defogger.
Figure 74:
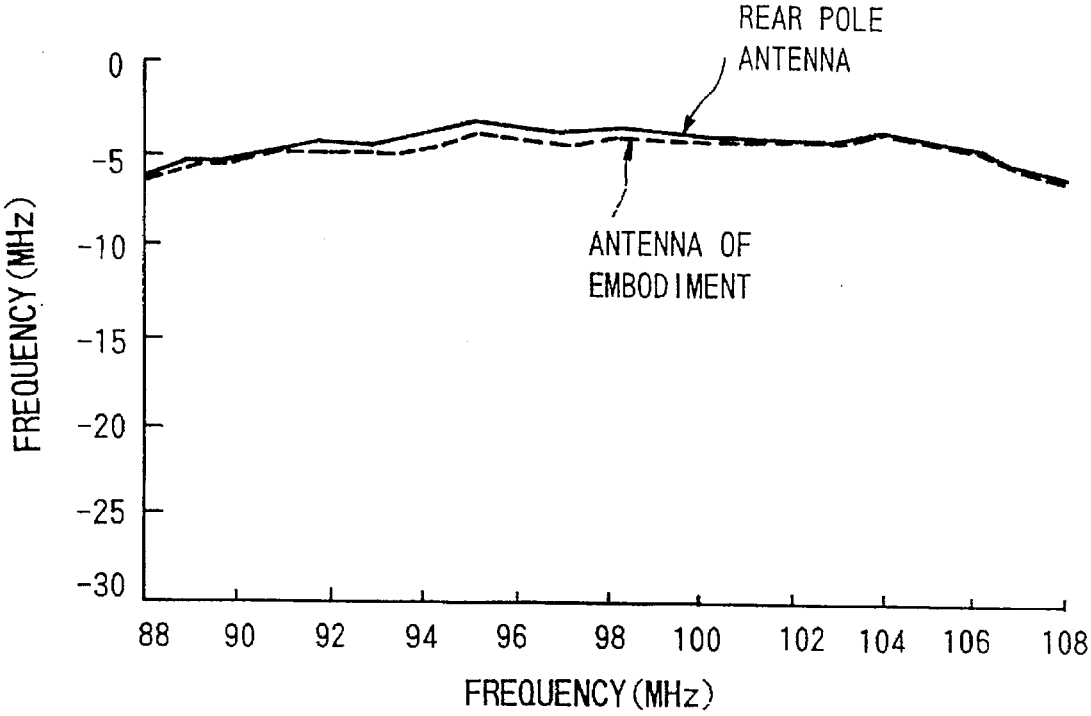
FIG. 74 is a graph comparing the performance (receiving sensitivity characteristics to a vertically polarized wave) of the antenna of the embodiment shown in FIG. 60 with that of the mono-pole type antenna.
Figure 75:
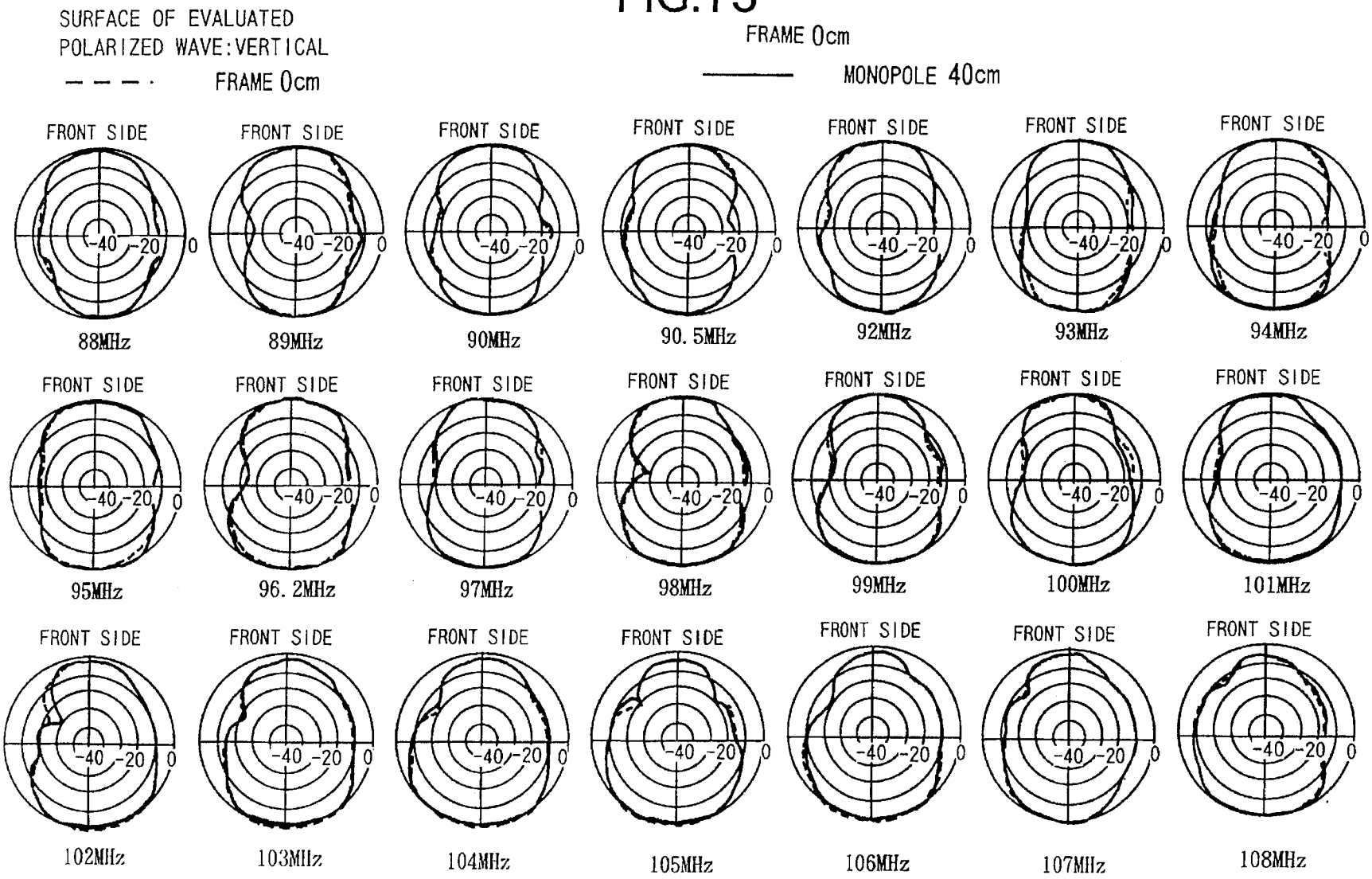
FIG. 75 is views comparing the performance (directive characteristics to a vertically polarized wave) of the antenna of the embodiment shown in FIG. 60 with that of the mono-pole type antenna.
Figure 76:
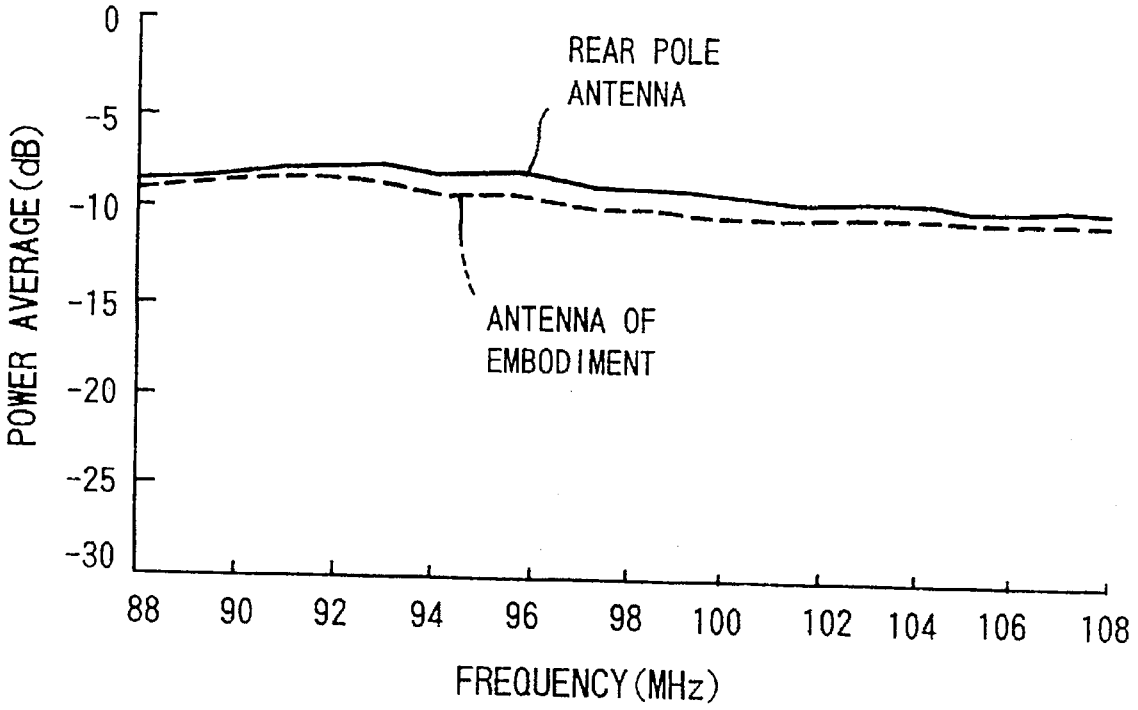
FIG. 76 is a graph comparing the performance (receiving sensitivity characteristics to a horizontally polarized wave) of the antenna of the embodiment shown in FIG. 60 with that of the mono-pole type antenna.
Figure 77:
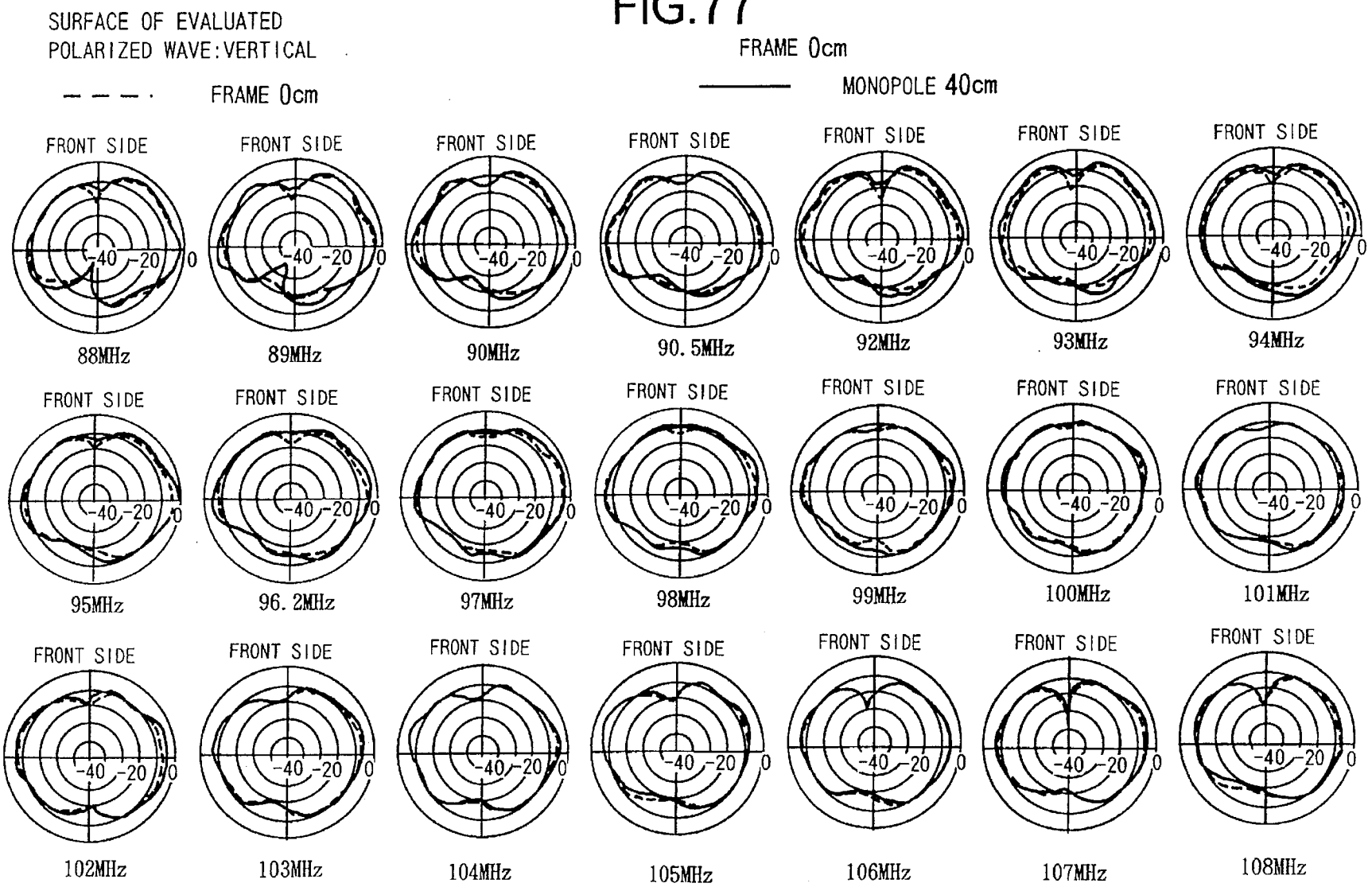
FIG. 77 is views comparing the performance (directive characteristics to a horizontally polarized wave) of the antenna of the embodiment shown in FIG. 60 with that of the mono-pole type antenna.
Figures 78, 79:
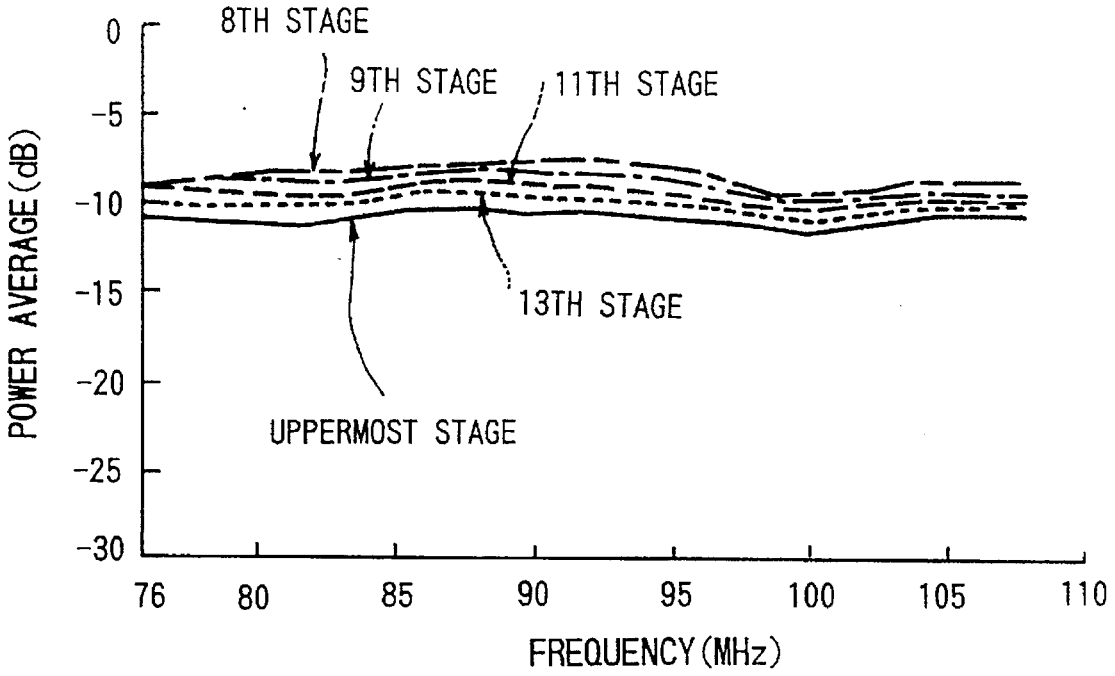
FIG. 78 is a graph showing the change of characteristics (horizontally polarized wave) when the length of the mono-pole type antenna is changed.
FIG. 79 is a table showing the change of characteristics (horizontally polarized wave) when the length of the monopole type antenna is changed.
Figures 80, 81:
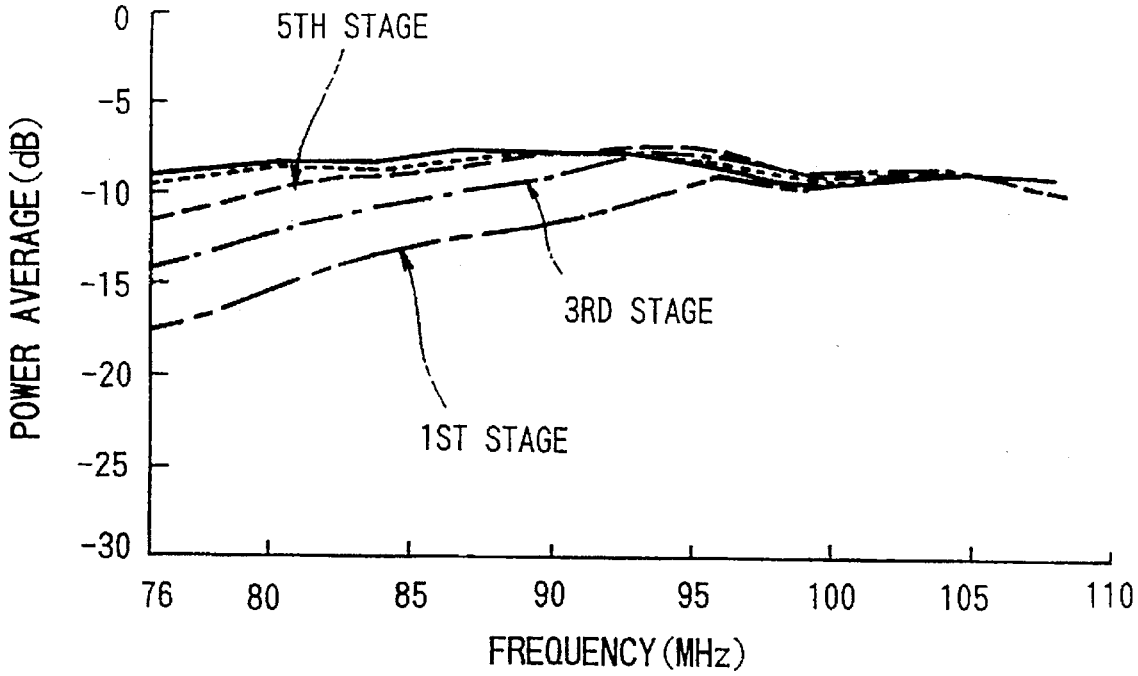
FIG. 80 is a graph showing the change of characteristics (horizontally polarized wave) when the length of the monopole type antenna is changed.
FIG. 81 is a table showing the change of characteristics (horizontally polarized wave) when the length of the monopole type antenna is changed.

FIG. 74 and FIG. 75 show the result of comparison of the performance of a glass antenna having the shape shown in the seventh embodiment of FIG. 60 with that of the mono-pole type antenna shown in FIG. 73 (length: 40 cm) when a polarized surface is vertical. FIG. 76 and FIG. 77 shows the result of the same comparison when a polarized surface is horizontal. In FIG. 74–FIG. 77, the solid lines show the receiving sensitivity characteristics and directivity characteristics of the mono-pole type antenna and the broken lines show the receiving sensitivity characteristics and directivity characteristics of the glass antenna shown in FIG. 60. As apparent from the comparison of the broken lines (embodiment) with the solid lines (mono-pole type antenna), since the data of the receiving sensitivity characteristics and directivity characteristics showing the antenna characteristics substantially coincide with each other, it is found that the characteristics of the glass antenna of the embodiment are substantially the same as those of the mono-pole type antenna. Next, FIG. 78–FIG. 85 show the power average characteristics when the mono-pole type antenna shown in FIG. 73 receives a radio wave having a horizontally polarized wave surface and the length of the mono-pole type antenna is variously changed and FIG. 86–FIG. 93 show the power average when the mono-pole type antenna receives a radio wave having a vertically polarized wave surface in the above case. In these cases, a current feeding point is located above a defogger at the center of a glass window in the vehicle width direction thereof. In these graphs, the length of the mono-pole type antenna is indicated by the position of the stage of the defogger at the lower end of the antenna. Thus, "uppermost position", i.e., "fed at upper central position" indicates 63 cm, the thirteenth stage indicates 57 cm, eleventh stage indicates 51 cm, ninth stage indicates 45 cm, eighth indicates 42 cm, seventh stage indicates 39 cm, fifth stage indicates 33 cm, first stage indicates 21 cm and zero-th stage indicates 18 cm, respectively.

Figures 82, 83:
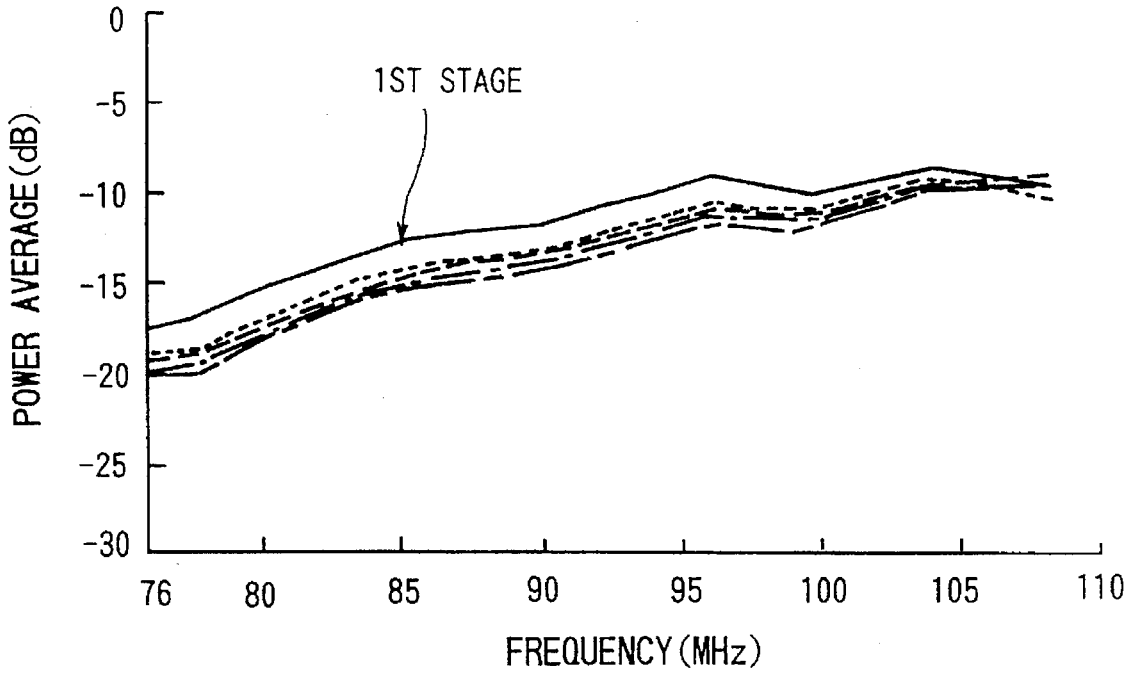
FIG. 82 is a graph showing the change of characteristics (horizontally polarized wave) when the length of the monopole type antenna is changed.
FIG. 83 is a table showing the change of characteristics (horizontally polarized wave) when the length of the monopole type antenna is changed.
Figure 84:
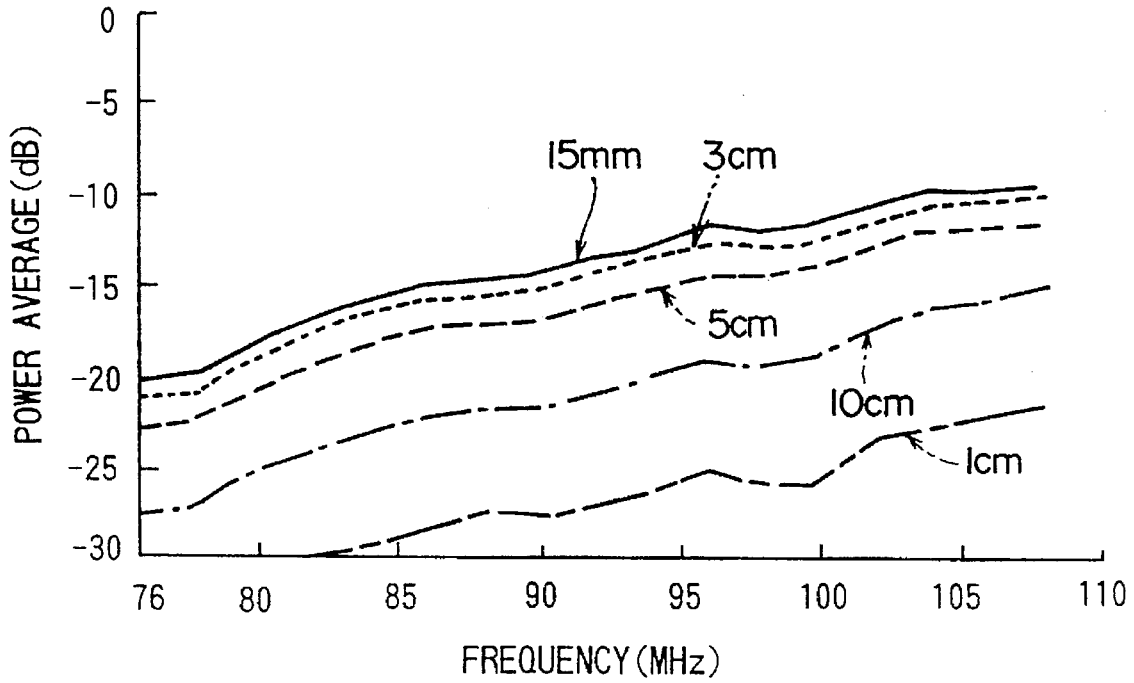
FIG. 84 is a graph showing the change of characteristics (horizontally polarized wave) when the length of the monopole type antenna is changed.
Figures 85, 86:
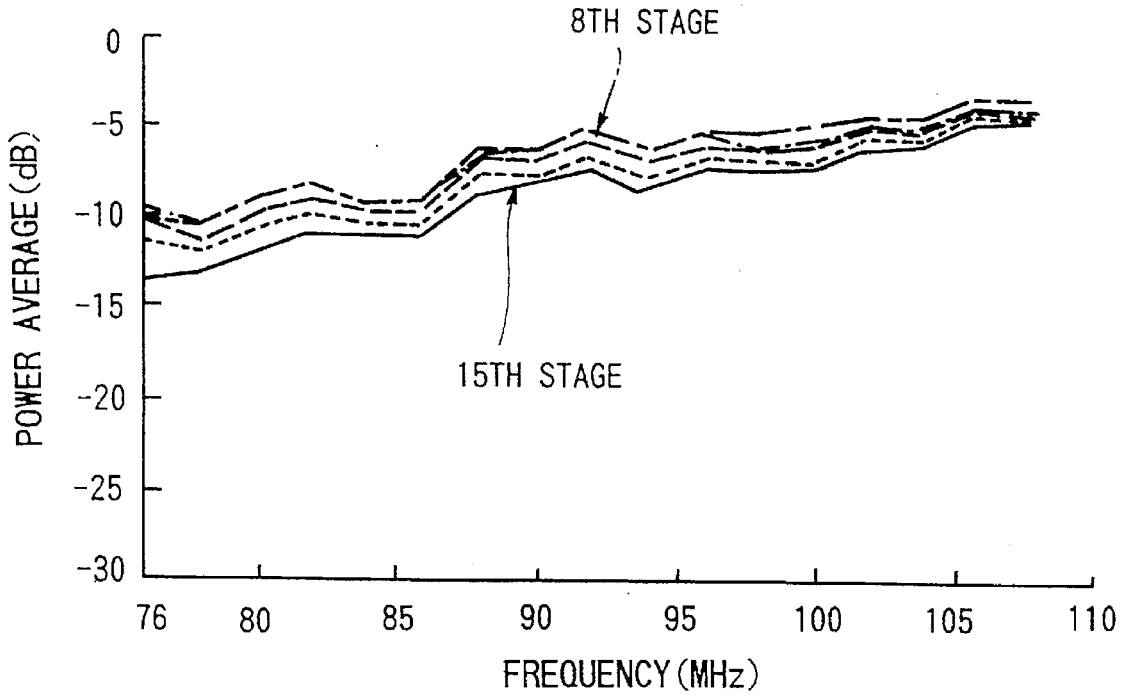
FIG. 85 is a table showing the change of characteristics (horizontally polarized wave) when the length of the monopole type antenna is changed.
FIG. 86 is a graph showing the change of characteristics (vertically polarized wave) when the length of the monopole type antenna is changed.
Figures 87, 88:
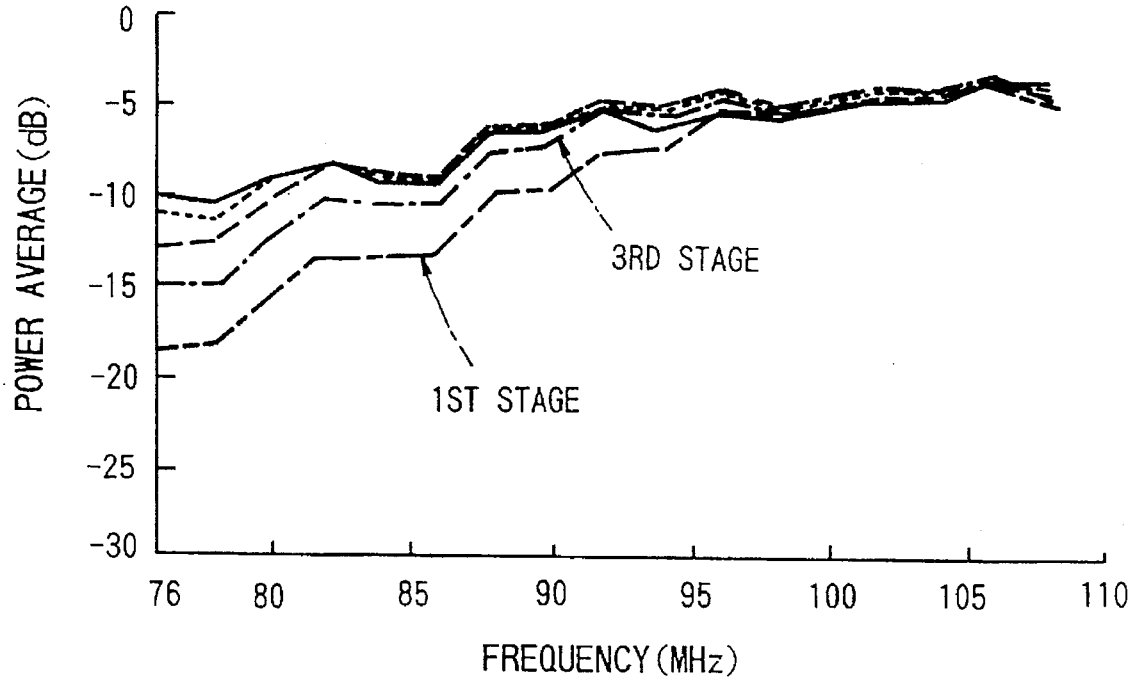
FIG. 87 is a table showing the change of characteristics (vertically polarized wave) when the length of the monopole type antenna is changed.
FIG. 88 is a graph showing the change of characteristics (vertically polarized wave) when the length of the monopole type antenna is changed.
Figures 89, 90:
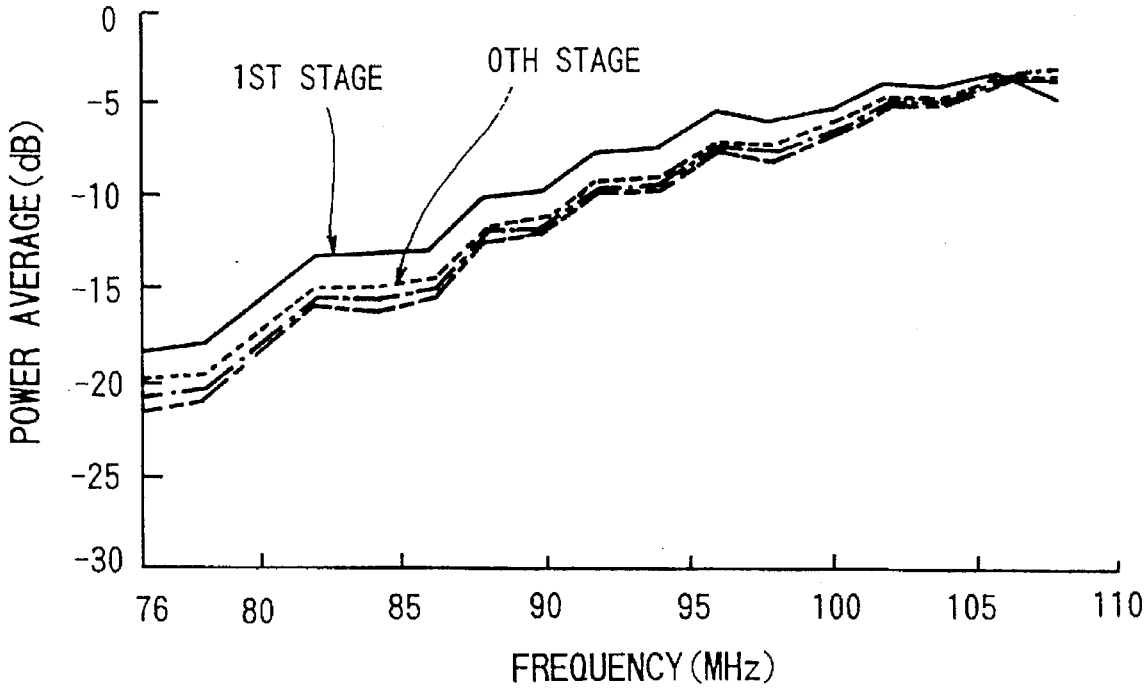
FIG. 89 is a table showing the change of characteristics (vertically polarized wave) when the length of the monopole type antenna is changed.
FIG. 90 is a graph showing the change of characteristics (vertically polarized wave) when the length of the monopole type antenna is changed.
Figures 91, 92:
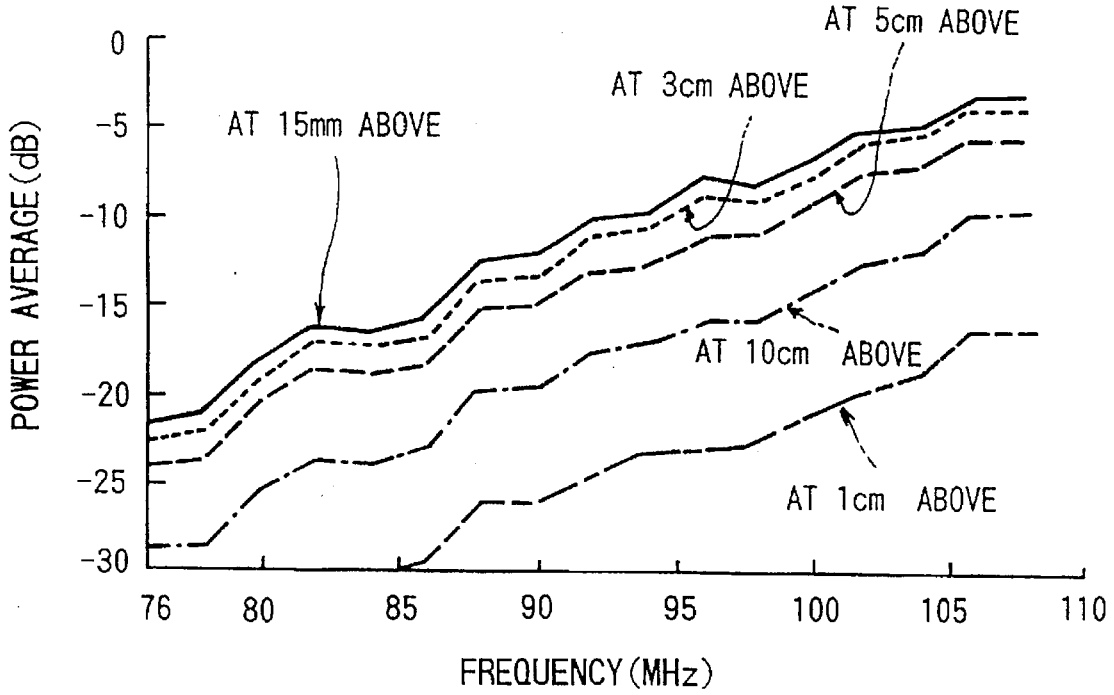
FIG. 91 is a table showing the change of characteristics (vertically polarized wave) when the length of the monopole type antenna is changed.
FIG. 92 is a graph showing the change of characteristics (vertically polarized wave) when the length of the monopole type antenna is changed.

Judging from the tables of FIG. 82–FIG. 83, it can be contemplated that the lower limit length of the mono-pole type antenna is the position of zero-th stage (18 cm) with respect to a horizontally polarized wave. Judging from the tables of FIG. 92 and FIG. 93, it can be contemplated that the lower limit length of the mono-pole type antenna is the position 3 cm above the defogger (that is, 15 cm).

Figures 93, 94:
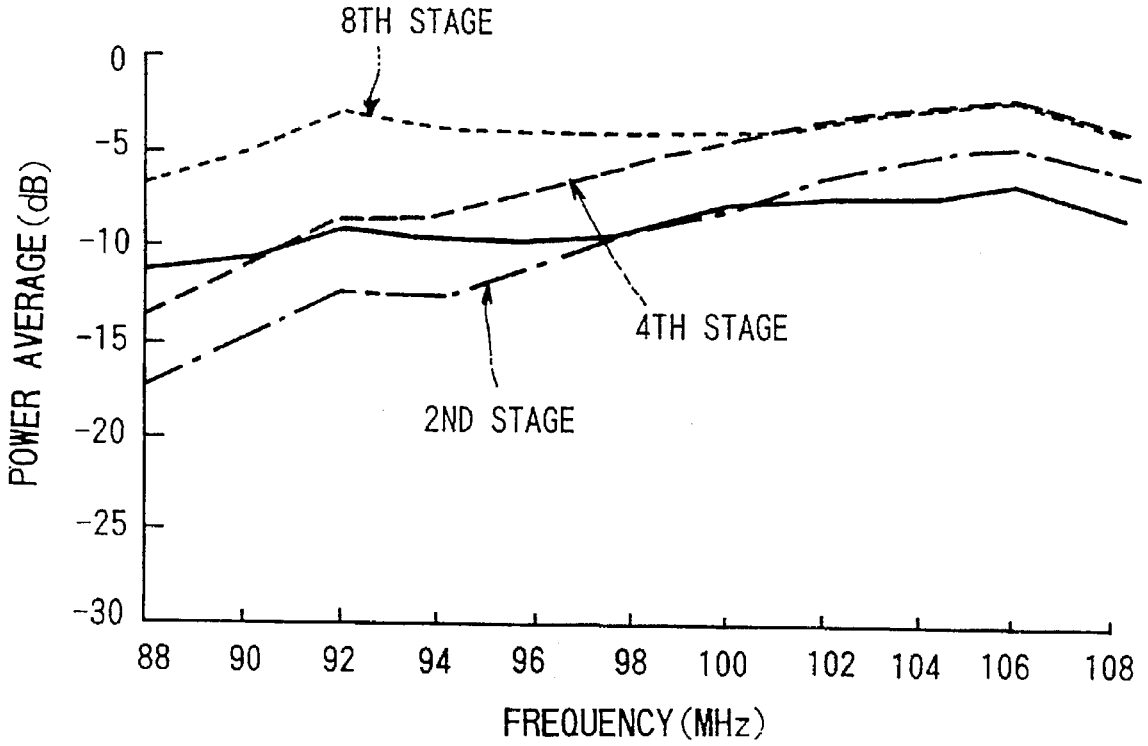
FIG. 93 is a table showing the change of characteristics (vertically polarized wave) when the length of the monopole type antenna is changed.
FIG. 94 is a graph showing the change of characteristics (vertically polarized wave) when the length of the monopole type antenna is changed in a different type of a vehicle.
Figures 95, 96, 97:
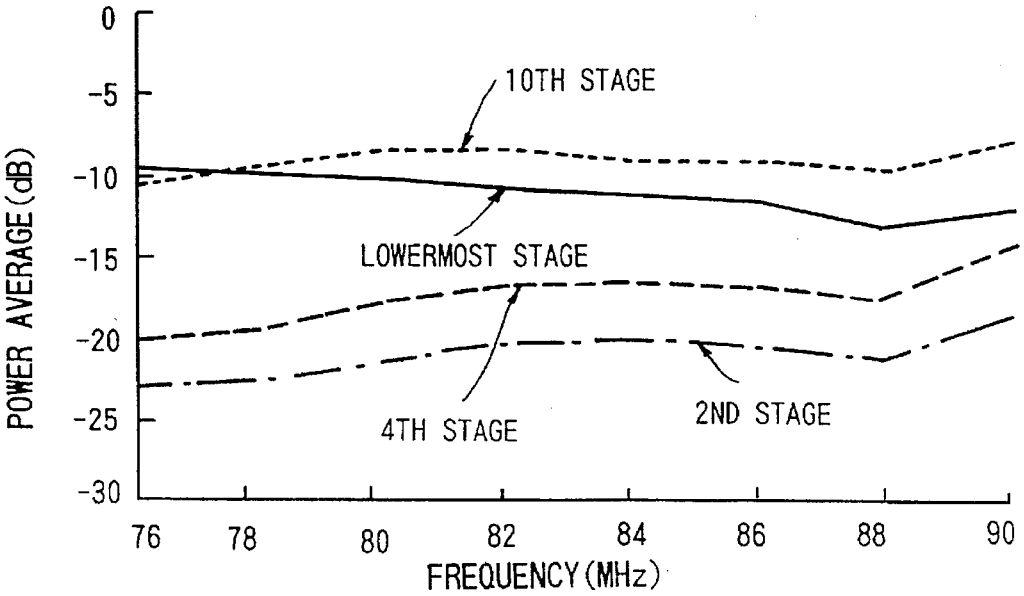
FIG. 95 is a table showing the change of characteristics (vertically polarized wave) when the length of the monopole type antenna is changed in a different type a vehicle.
FIG. 96 is a graph showing the change of characteristics (horizontally polarized wave) when the length of the monopole type antenna is changed in a different type of a vehicle.
FIG. 97 is a table showing the change of characteristics (horizontally polarized wave) when the length of the monopole type antenna is changed in a different type of a vehicle.

Further, FIG. 94–FIG. 97 show how the characteristics of the mono-pole type antenna change when the length thereof is changed in accordance with a different type of a vehicle. Note, FIG. 94–FIG. 95 show the change of the characteristics with respect to the a vertically polarized wave and FIG. 96–FIG. 97 show the change of the characteristics with respect to the a horizontally polarized wave. It can be contemplated that the lower limit length of the mono-pole type antenna is the position of the fourth stage (29.5 cm) with respect to the a horizontally polarized wave. When supposed from the data, the position of the third stage (i.e., 26.5 cm) is suitable for a vertically polarized wave.

Therefore, when FIG. 78–FIG. 97 are totally examined, when the mono-pole type antenna is mounted on a vehicle as a glass antenna, an antenna of high performance can be obtained in the range of the following formula.

$$20\ cm \leqq L_x \leqq 70\ cm \quad (4)$$

where, $L_x$ is the length of the mono-pole type antenna.

When the antenna system of the above embodiment is set to satisfy the formula (1) as described above, it is also applicable to a VHF band for TV.

In the wavelength (92 MHz–222 MHz) of the VHF band for TV, the setting at which a defogger does not almost affect the antenna characteristics is shown by the following formula.

$$34\ cm \leqq \lambda/4 \leqq 82\ cm$$

In a vehicle mounted state, the above formula is multiplied by the glass shortening ratio ($\beta$=0.6) to obtain the following formula.

$$20\ cm \leqq \beta \cdot \lambda/4 \leqq 50\ cm$$

that is, $$20\ cm \leqq L+\alpha \cdot Y \leqq 50\ cm.$$

As described above, the formula (1) is established when the ideal state that the end of the bus bar of a defogger is short-circuited to a vehicle body is supposed. Since it is regarded in an actual vehicle that the bus bar is connected to the body through a certain degree of capacitance coupling, a preferable area to be taken by $L+\alpha \cdot Y$ which is used for the VHF band for TV has a certain amount of range as compared with an ideal state in the same way as an antenna for FM frequency. Thus, the length is 10 cm or more to 60 cm or less. It cm or less. It is needless to say that $L+\alpha \cdot Y$ has a length which corresponds to the frequency substantially at the center of a VHF band in order to secure a receiving performance over the entire VHF band in practical use.

[Enhancement of Defogging Function]

In the glass antenna show in FIG. 61, the conductor 45 as the first antenna conductor is connected to the defogger through capacitive coupling at the power portion thereof as well as further surrounded by another heating wire. Although the conductor is surrounded by the heating wire, it is not in contact therewith. Therefore, the conductor 45 is scarcely affected by the direct current of the heating wire. Thus, the glass region around the conductor 45 is heated by the heating wire and thus is not fogged.

[Specific Example 1]

Specific glass antennas which are achieved by expanding and developing the various embodiments described above and applicable to actual vehicles will be described below.

Figure 98:
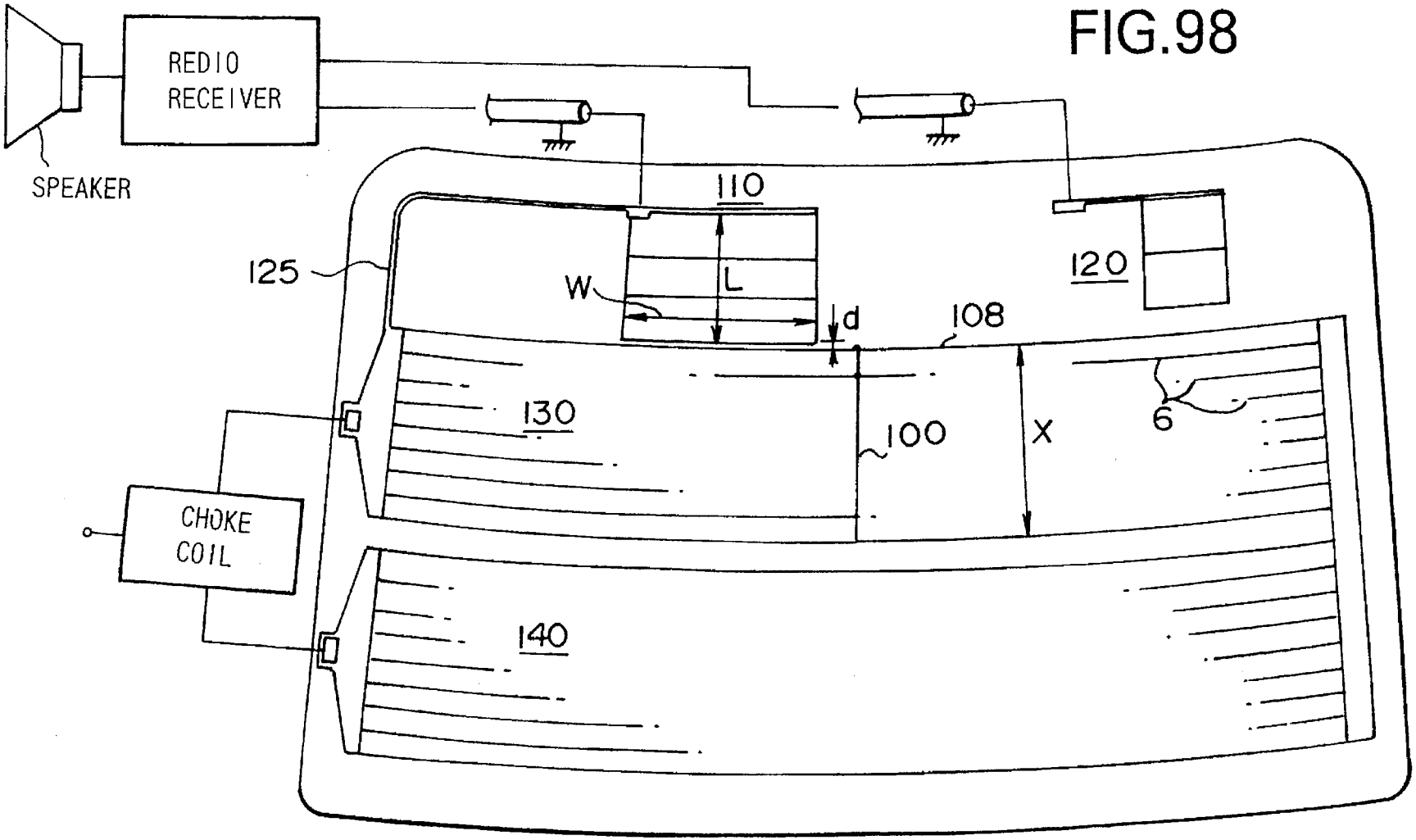
FIG. 98 is a view showing the arrangement of an antenna system when the seventh embodiment is further specified.

FIG. 98 is a plan view of the arrangement of a glass antenna relating to a specific example 1 observed from the inside of a vehicle different from FIG. 1 and the like described above. Therefore, the right side and the left side of the glass antenna are upset.

A defogger is also divided into two regions 130, 140 in the specific example similarly to the aforesaid embodiments. A conductor 100 as a second antenna conductor is disposed at the center of the defogger 130 so that it is across a plurality of heating wires 6. Since the conductor 100 having a length of X is connected to the respective heating wires 6 at the center thereof in a vehicle width direction, a heater current does not flow to the interior of it. Two antennas 110, 120 are disposed in the region where the defogger is not disposed and connected to an uppermost heating wire 108 through capacitive coupling to constitute a diversity antenna system. The current feeding point of each antenna is directly connected to a radio receiver and thus to speakers through a coaxial feeder cable without passing through an antenna booster and the like.

The antenna 110 as the main antenna element of a first antenna conductor has a "two-horizontal-line-in-square" shape. Further, the antenna 120 as a subantenna has a "a horizontal-line-in-square shape". The antenna 110 has a height L and a width W. Therefore, L, W, d etc. are determined to optimum values satisfying the above formulas (1)–(3) ($\alpha$ is determined by W and d).

When the antenna is specifically set, first, the combination of the height L of the optimum first antenna conductor element (main antenna element 110) which is difficult to be affected by the defogger and a coupling capacitance C (relating to the shortening ratio $\alpha$) is determined from the wavelength (center) $\lambda$ of a radio wave to be received and the length Y of the defogger disposed on a glass based on the relationship expressed by the above formula (1). The sizes of the width W and d are determined based on the value of the coupling capacitance C.

Next, the length X of the conductor 100 is determined based on the following relation to the length ($L_x$) of an optimum mono-pole type antenna obtained by experiments executed to respective vehicles, and the like.

$$L+\alpha \cdot X=L_x$$

Note, the value of $L_x$ is in the range of from 20 cm to 70 cm when an FM radio wave is received in a usual state of use. This range is the same as the aforesaid range. Further, the value of the width W of the main antenna is preferably set to the range of from 50 mm to 300 mm and more preferable to the range of from 100 mm to 250 mm. The value of the height L is preferably set to the range of 40 mm to 300 mm.

Since the subantenna 120 provides a diversity function by a receiving sensitivity different from that of the main antenna 110, the coupling capacitance when the antenna 120 as the subantenna is connected to the heating wire 108 through capacitive coupling is set to a small value because the antenna 120 is the subantenna. Further, the width and height of the subantenna 120 are set to vales smaller than those of the main antenna 110.

An electric conductor wire 125 extends from the current feeding point of the main antenna 100 and is connected to the bus bar of the defogger 130. Since the antenna 110 which is intrinsically an FM antenna is connected to the bus bar of the defogger through the electric conductor wire 125, the resonance point of the antenna 110 is also produced in an AM region, thus the antenna 110 can be also used as an AM antenna.

[Specific Example 2]

Figure 99:
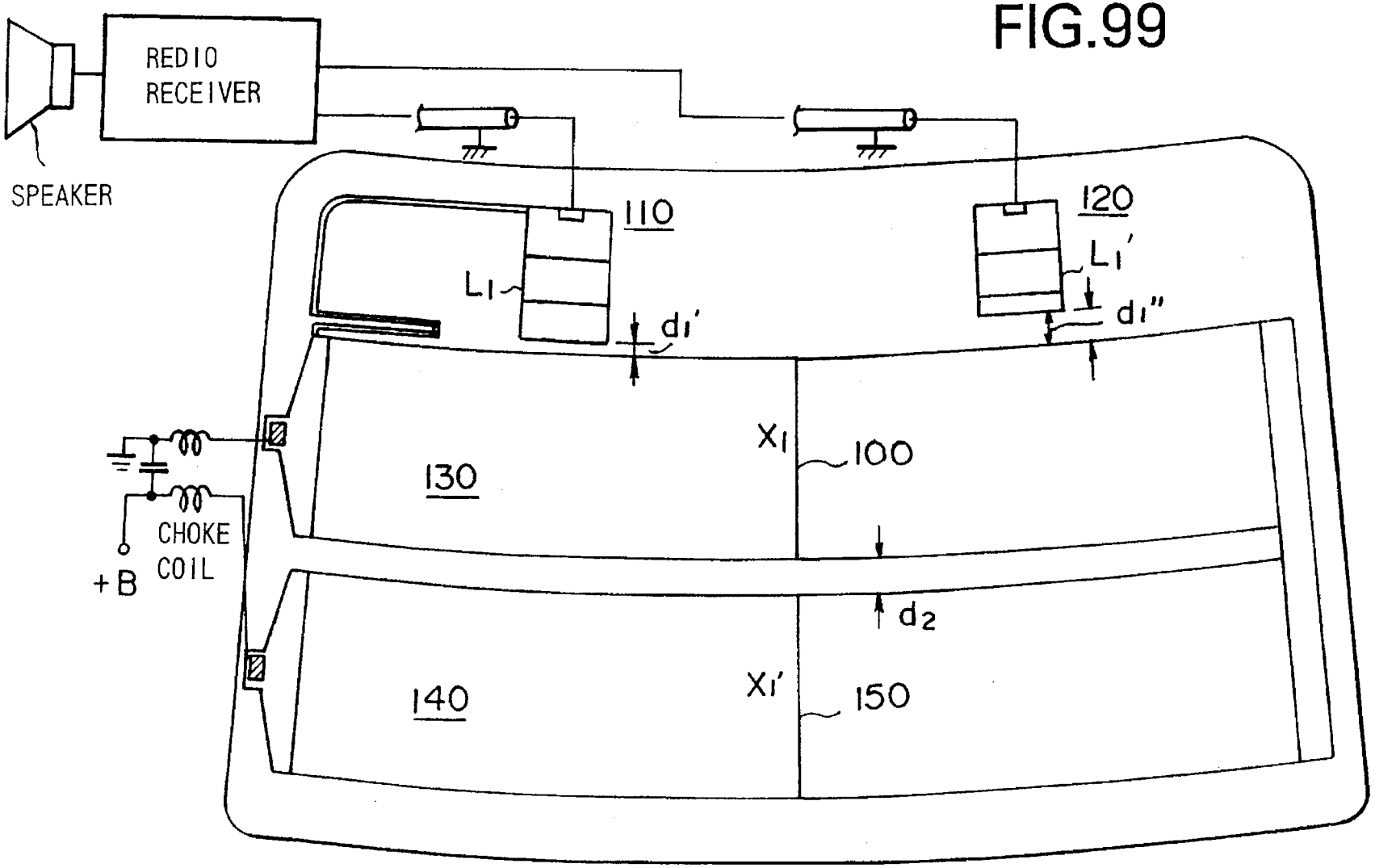
FIG. 99 is a view showing another arrangement of the antenna system when the seventh embodiment is further specified.

A specific example 2 shown in FIG. 99 is different from the specific example 1 shown in FIG. 98 in that a conductor 150 is added to the defogger 140 in addition to the antenna conductor 100 disposed in the defogger 130. When it is assumed that the height of the antenna 100 is $L_1$, the height of the antenna 120 is $L_2$, the distance between the antenna 110 and the heating wire is $d_1'$, the distance between the antenna 120 and the heating wire is $d_1''''$, the length of the conductor 100 is X1, the length of the conductor 150 is $X_1'$, and the distance between the defogger 130 and the defogger 140 is $d_2$, a glass antenna having an excellent performance can be provided when $$20\ cm \leqq L_1+\alpha_1\cdot(X_1+\alpha_2\cdot X_1')\leqq 70\ cm$$

is established with respect to the antenna 110, and $$20\ cm \leqq L'_1+\alpha_1'\cdot(X_1+\alpha_2\cdot X_1')\leqq 70\ cm$$

is established with respect to the antenna 120 as preferable antenna lengths, where $\alpha_1'$ is the shortening ratio of the antenna 120 by the defogger 130 and $\alpha_2$ is the shortening ratio of the conductor 150 by the capacitive coupling of the defoggers 130 and 140.

[Summary of First Embodiment to Sixth Embodiment]

It is apparent that glass antennas having the following arrangements and methods of setting them are proposed by the numerous embodiments described above.

(1): A glass antenna characterized by that:

a defogger is disposed on a glass apart from a space portion formed from the upper edge or lower edge of the glass; and an electric conductor sheet is disposed to the glass space portion above or below the defogger and electric current is fed to the electric conductor sheet.

(2): A glass antenna according to the item (1), wherein:

an electric conductor wire extending upward and downward is disposed to the defogger region at the position corresponding to the electric conductor sheet in the upward and downward direction.

(3): A glass antenna according to the item (2), wherein:

the distance between the electric conductor sheet and the defogger is in the range of from 1 mm to 50 mm.

(4): A glass antenna according to the item (2), wherein:

the electric conductor sheet is composed of an equivalent and uniform conductor.

(5): A glass antenna according to the item (4), wherein:

a space portion is formed at the center of the electric conductor sheet to install a telephone antenna and the like.

(6): A method of setting a glass antenna according to the item (2), comprising the step of:

setting a frequency having a maximum receiving sensitivity by adjusting the length of the electric conductor wire.

(7): A method of setting a glass antenna according to the item (2), comprising the step of:

setting a maximum receiving sensitivity by adjusting the gap between the electric conductor sheet and the defogger.

(8): A method of setting a glass antenna according to the item (2), comprising the step of:

setting a frequency having a maximum receiving sensitivity by adjusting the right to left width of the electric conductor sheet.

(9): A method of setting a glass antenna according to the item (2), comprising the step of:

setting a frequency having a maximum receiving sensitivity by adjusting the offset amount of the electric conductor sheet with respect to the center in the right and left direction of the glass.

(10): A glass antenna characterized by that:

a defogger is disposed on a glass apart from a space portion formed from the upper edge or lower edge of the glass;

an electric conductor wire having a predetermined length and extending upward and downward is disposed at the center in the right and left direction of the defogger; and a plurality of electric conductor sheets are disposed to the glass space portion above or below the defogger and electric current is fed to each of the electric conductor sheets to thereby constitute a diversity antenna.

(11): A glass antenna according to the item (10), wherein:

at least two electric conductor sheets are disposed by being equally spaced apart from the position of the electric conductor wire located at the center in the right and left direction of the defogger.

(12): A glass antenna according to the item (10), wherein:

the capacitance of the predetermined electric conductor sheet and the defogger is set larger than that of the capacitance of the other electric conductor sheets and the defogger.

(13): A glass antenna according to the item (12), wherein:

the gap between the predetermined electric conductor sheet and the defogger is set smaller than that of the other electric conductor sheets and the defogger.

(14): A glass antenna according to the item (12), wherein:

the right to left width of the predetermined electric conductor sheet is set larger than that of the other electric conductor sheets.

(15): A glass antenna according to the item (10), wherein:

the predetermined electric conductor sheet is disposed at the position corresponding to the electric conductor wire located at the center in the right and left direction of the defogger in the upward and downward direction and the other electric conductor sheets are disposed at positions offset from the center in the right and left direction of the defogger.

(16): A glass antenna according to the item (12), wherein:

the electric conductor sheet having a large capacitance with the defogger is disposed on the ground side of the defogger and connected thereto.

(17): A method of setting a glass antenna according to the item (10), comprising the step of:

setting a diversity antenna by giving a different value to the capacitance between each of the electric conductor sheets and the defogger.

(18): A method of setting a glass antenna according to the item (10), comprising the step of:

setting a diversity antenna by changing the frequency band where a maximum receiving sensitivity can be obtained.

(19): A method of setting a glass antenna according to the item (17), comprising the step of:

giving a different value to the capacitance between each of the electric conductor sheets and the defogger by changing the gap between each of the electric conductor sheets and the defogger.

(20): A method of setting a glass antenna according to the item (17), comprising the step of:

giving a different value to the capacitance between each of the electric conductor sheets and the defogger by changing the right to left width of each of the electric conductor sheets.

(21): A method of setting a glass antenna according to the item (17), comprising the step of:

giving a different value to the capacitance between each of the electric conductor sheets and the defogger by changing the position in the right to left direction of each of the electric conductor sheets with respect to the center in the right and left direction of the defogger.

Of the glass antennas and the methods of setting the glass antennas shown in the above items (1)–(21), according to the glass antenna of the item (1), since the defogger is disposed on the glass apart from the space portion formed from the upper edge or the lower edge of the glass, the electric conductor sheet is disposed to the space portion above or below the defogger and electric current is fed to the electric conductor sheet, the electric conductor sheet can be connected to the defogger through capacitive coupling, whereby the performance of the glass antenna can be improved by the simple arrangement making use of the glass to which the defogger is disposed.

According to the glass antenna of the item (2), since the electric conductor wire extending upward and downward is disposed to the defogger region at the position corresponding to the electric conductor sheet in the upward and downward direction, the performance of the glass antenna can be further improved.

According to the glass antenna of the item (3), since the distance between the electric conductor sheet and the defogger is set in the range of from 1 mm to 50 mm, the effect of the defogger can be excluded.

According to the glass antenna of the item (4), since the electric conductor sheet is composed of the equivalent and uniform conductor, the space portion and the like can be formed in the electric conductor sheet to thereby easily install various equipment without lowering the performance of the antenna.

According to the glass antenna of the item (5), since the space portion is formed at the center of the electric conductor sheet to install a telephone antenna and the like, the telephone antenna and the like can be easily positioned.

According to the glass antenna of the item (6), a frequency having a maximum received sensitivity is set by adjusting the length of the electric conductor wire.

According to the glass antenna of the item (7), a maximum received sensitivity is set by adjusting the gap between the electric conductor sheet and the defogger.

According to the glass antenna of the item (8), a frequency having a maximum received sensitivity is set by adjusting the right to left width of the electric conductor sheet.

According to the glass antenna of the item (9), a frequency having a maximum receiving sensitivity is set by adjusting the offset amount of the electric conductor sheet with respect to the center in the right and left direction of the glass. Consequently, according to these glass antennas, an antenna can be easily adjusted to an excellent sensitivity.

According to the glass antenna of the item (10), since the electric conductor wire extending upward and downward is disposed to the defogger at the center in the right and left direction thereof in the glass, a plurality of the electric conductor sheets are disposed to the glass space portion above or below the defogger and electric current is fed to each of the electric conductor sheets, the diversity antenna system can be easily set.

According to the glass antenna of the item (11), since at least the two electric conductor sheets of a plurality of the electric conductor sheets which are disposed to the glass space portion above or below of the defogger are disposed by being equally spaced apart from the position of the electric conductor wire located at the center in the right and left direction of the defogger, the diversity antenna having the same receiving sensitivities can be provided.

According to the glass antenna of the item (12), since the coupling capacitance of the predetermined electric conductor sheet with the defogger of a plurality of the electric conductor sheets disposed to the glass space portion above or below of the defogger is set larger than the coupling capacitance of the other electric conductor sheets with the defogger, the diversity antenna can be composed of the electric conductor sheet having the large coupling capacitance with the defogger and serving as a main antenna and the other electric conductor sheets having the small coupling capacitance with the defogger and serving as a subantenna, whereby an excellent receiving sensitivity can be obtained in a weak electric field area using only the main antenna having the large coupling capacitance with the defogger and a high sensitivity.

According to the glass antenna of the item (13), since the gap between the predetermined electric conductor sheet and the defogger is set smaller than that between the other electric conductor sheets and the defogger, the coupling capacitance of the electric conductor sheet having the small gap to the defogger can be increased.

According to the glass antenna of the item (14), since the right to left width of the predetermined electric conductor sheet is set larger than that of the other electric conductor sheets, the coupling capacitance of the electric conductor sheet having the large right to left width with the defogger can be increased.

According to the glass antenna of the item (15), since the predetermined electric conductor sheet is disposed at the position corresponding to the electric conductor wire located at the center in the right and left direction of the defogger in the upward and downward direction and the other electric conductor sheet are disposed at positions offset from the center in the right and left direction of the defogger, the coupling capacitance of the electric conductor sheet disposed at the center in the right and left direction of the defogger with the defogger can be increased.

According to the glass antenna of the item (16), since the electric conductor sheet having the large coupling capacitance with the defogger is disposed on the ground side of the defogger and connected thereto, when the electric conductor sheet having the large coupling capacitance with the defogger is connected to the defogger and acts as an AM antenna, the coupling wire between the electric conductor sheet and the defogger can be shortened, whereby the transmission loss of AM radio wave signals can be reduced. Further, the subantenna for an FM receiving band is composed of the electric conductor sheets having the small coupling capacitance with the defogger, a capacitor for cutting an AM receiving band which is needed when a conventional defogger is used as a subantenna for the FM receiving band can be made unnecessary.

According to the glass antenna of the item (17), since the diversity antenna is set by giving a different value to the coupling capacitance of each of a plurality of the electric conductor sheets disposed to the glass space portion above or below the defogger with the defogger, the electric conductor sheet having the large coupling capacitance with the defogger is used as the main antenna of the diversity antenna, whereas the electric conductor sheets having the small coupling capacitance with the defogger is used as the subantenna thereof, whereby the main antenna and the subantenna of the diversity antenna can be easily set.

According to the glass antenna of the item (18), since the diversity antenna is set by changing a frequency band where a maximum receiving sensitivity can be obtained, the electric conductor sheet corresponding to the frequency band at which the maximum receiving sensitivity can be obtained can be used as the main antenna of a diversity antenna and other electric conductor sheets can be used as the subantenna thereof, whereby the main antenna and the subantenna of the diversity antenna can be easily set.

A different value is given to the capacitance between each of the electric conductor sheets and the defogger in such a manner that the gap between each of the electric conductor sheets and the defogger is changed in the glass antenna of the item (19) by the glass antenna setting method of the item (17), the right to left width of each of the electric conductor sheets is changed in the glass antenna of the item (20), and further the right to left position of each of the electric conductor sheets with respect to the defogger is changed in the glass antenna of the item (21), respectively. Consequently, according to these glass antennas, a different value can be easily given to the coupling capacitance between each of the electric conductor sheets and the defogger.

[Further Modification]

The present invention can be further modified within the range which does not depart from the gist of the invention.

Although the glass antennas of the aforesaid various embodiments are applied to FM band radios and VHF band for TV as a state of use being supposed, it can be of course applied to other communication apparatuses (for example, a keyless entry system) using these frequency bands.

Further, although the coupling capacitance between the first antenna conductor element and the second antenna conductor element is obtained by disposing them on the glass surface with the gap set therebetween in the aforesaid various embodiments, the coupling capacitance may be obtained by interposing a chip capacitor between the first antenna conductor element and the second antenna conductor element. Further, when the chip capacitor is composed of a variable capacitor whose capacitance can be varied, the coupling capacitance between the first antenna conductor element and the second antenna conductor element can be adjusted even after the glass is mounted on a vehicle body. As a result, matching to a frequency to be received, a fine adjustment for setting an optimum antenna length which is needed due to a difference inherent to each vehicle body can be effected even after the vehicle body is removed from a manufacturing line. Thus, a large effect can be obtained by this modification.

[Modification]

Figure 100:
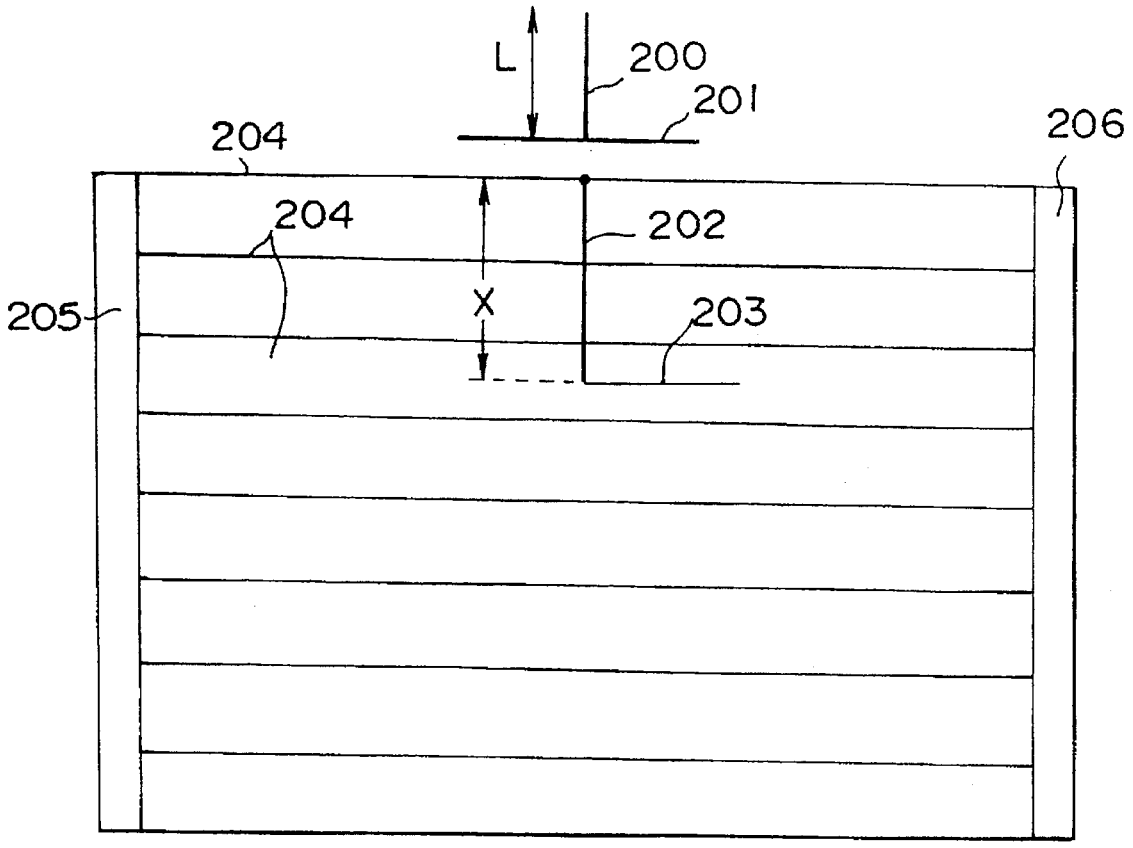
FIG. 100 is a view showing the arrangement of a glass antenna according to a further modification of the present invention.

The antennas in the above embodiments have the electric conductor wire extending on the glass surface upward and downward. Here, the inventors propose a glass antenna having a horizontally extending electric conductor wire is proposed. More specifically, as shown in FIG. 100, a longitudinal electric conductor wire 202 (length: X) is disposed at the center of the uppermost one of heating wires 204 stretched between the bus bars on a glass surface and a longitudinal electric conductor wire 200 (length: L) is disposed through a lateral electric conductor wire 201 to a space portion where no heating wire of a defogger is disposed. Further, a lateral electric conductor wire 203 is disposed in contact with the lower end of the electric conductor wire 202 and in parallel with the heating wires 204. That is, the lateral electric conductor wire 203 is additionally provided in the defogger as compared with the above embodiments.

When the following relation is established in the glass antenna arranged as described above, the glass antenna can achieve the same performance as the glass antenna system in which the electric conductor wire 203 is not provided.

$$L_1 \leqq L+\alpha \cdot X \leqq L_2$$

From the aforesaid, it is found that the effect of the upward and downward electric conductor wire is dominant in the glass antennas of the present invention. Therefore, the lateral electric conductor wire may be added in the range satisfying the above formula.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A glass antenna extending on a glass surface, comprising a defogger; and an antenna conductor having:

a first antenna conductor element to which electric current is fed from a current feeding point disposed on a region of said glass around said defogger and extending along said glass surface; and a second antenna conductor element which extends upward and downward along said glass surface in a region where said defogger extends and a portion of which is directly coupled to a heating wire of said defogger, wherein, said first antenna conductor element is disposed to said defogger so that said heating wire connected to said portion of said second antenna conductor element is coupled to said first antenna conductor element through capacitive coupling, and wherein;

the following relation is satisfied $$\beta \cdot \lambda/4 = L+\alpha \cdot Y$$

where, the length of said first antenna conductor element in a direction perpendicular to a vehicle width direction is L, an antenna shortening ratio by the capacitive coupling is $\alpha$, an antenna shortening ratio by glass is $\beta$, the wavelength of a radio wave to be received is $\lambda$, and the length of said defogger in the vehicle width direction is 2Y.

2. A glass antenna according to claim 1, wherein said current feeding point is disposed below or above said defogger.

3. A method of designing a glass antenna, said glass antenna having:

a flat glass;

a defogger disposed on said glass;

a first antenna conductor element to which electric current is fed from a current feeding point disposed on a region of said glass around said defogger and extending along said glass surface; and a second antenna conductor element which extends upward and downward along said glass surface in a region where said defogger extends and a portion of which is directly coupled to a heating wire of said defogger, wherein, said first antenna conductor element is disposed to said defogger so that said heating wire connected to said portion of said second antenna conductor element is coupled to said first antenna conductor element through capacitive coupling, said design method comprising the steps of:

determining the length of said first antenna conductor element in a direction perpendicular to a vehicle width direction L based on $$\beta\cdot\lambda/4=L+\alpha\cdot Y$$

where, an antenna shortening ratio by the capacitive coupling is $\alpha$, an antenna shortening ratio by glass is $\beta$, the wavelength of a radio wave to be received is $\lambda$, and the length of said defogger in the vehicle width direction is 2Y; and determining the upward and downward length of said second antenna conductor element X based on $$L+\alpha\cdot X=L_x$$

where, $L_x$ is the length of an optimum unipole type antenna.

4. A glass antenna according to claim 3, wherein said current feeding point is disposed below or above said defogger.

5. A glass antenna for receiving an FM radio wave including a defogger having a length 2Y in a vehicle width direction and a first antenna conductor element having a length L in the direction perpendicular to the vehicle width direction, the antenna conductor elements extending on a glass surface, said glass antenna comprising:

a current feeding point disposed on a region of said glass around said defogger;

said first antenna conductor element to which electric current is fed from said current feeding point and which extends along said glass surface; and a second antenna conductor element which extends upward and downward along said glass surface in a region where said defogger extends and a portion of which is directly coupled to a heating wire of said defogger, wherein, said first antenna conductor element is disposed to said defogger so that said heating wire connected to said portion of said second antenna conductor element is coupled to said first antenna conductor element through capacitive coupling and $$20\ cm\leqq L+\alpha\cdot Y\leqq 70\ cm$$

is satisfied, where $\alpha$ is an antenna shortening ratio by the capacitive coupling.

6. A glass antenna for receiving an FM radio wave according to claim 5, wherein $$40\ cm\leqq L+\alpha\cdot Y\leqq 60\ cm$$

is satisfied.

7. A glass antenna for receiving an FM radio wave according to claim 6, wherein, $$40\ cm\leqq L+\alpha\cdot Y\leqq 50\ cm$$

is satisfied.

8. A glass antenna for receiving an FM radio wave according to claim 6, wherein, $$50\ cm\leqq L+\alpha\cdot Y\leqq 60\ cm$$

is satisfied.

9. A glass antenna according to claim 5, wherein said first antenna conductor element has a substantially loop shape.

10. A glass antenna according to claim 9, wherein said first antenna conductor element has a loop conductor of a rectangular loop shape and at least one conductor wire for connecting an interior of said loop conductor.

11. A glass antenna according to claim 10, wherein said defogger has a minus bus bar and an apex of said loop conductor is coupled to said bus bar.

12. A glass antenna according to claim 5, wherein a portion of said first antenna conductor element is coupled to a portion the heating wire of said defogger through a capacitance of about 40 pF or less.

13. A glass antenna according to claim 12, wherein the length of said first antenna conductor element in a vehicle width direction is set to the range of from 50 mm to 300 mm.

14. A glass antenna according to claim 13, wherein the length of said first antenna conductor element in the vehicle width direction is set to the range of from 100 mm to 250 mm.

15. A glass antenna according to claim 12, wherein a portion of said first antenna conductor element is coupled to a heating wire of said defogger through a capacitance of about 2 pF to 20 pF.

16. A glass antenna according to claim 12, wherein a gap between the first antenna conductor element and the heating wire of said defogger connected thereto through capacitive coupling is in the range of from 1 mm to 50 mm.

17. A glass antenna according to claim 16, wherein the gap is in the range of from 2 mm to 35 mm.

18. A glass antenna according to claim 5, wherein the length of said first antenna conductor element in a direction perpendicular to the vehicle width direction is set in the range of from 4 cm to 30 cm.

19. A glass antenna according to claim 5, wherein said current feeding point is directly connected to a radio receiver through a feeder cable.

20. A glass antenna according to claim 5, wherein said first antenna conductor element includes at least two second antenna elements which are spaced apart from each other.

21. A glass antenna according to claim 20, wherein a diversity antenna system is composed by setting a different receiving sensitivity to each of said at least two antenna elements.

22. A glass antenna according to claim 21, wherein each of said at least two antenna elements has a portion connected to a heating wire of said defogger through capacitive coupling and the coupling capacitance thereof is differently set.

23. A glass antenna according to claim 21, wherein each of said at least two antenna elements has a different length in the vehicle width direction.

24. A glass antenna according to claim 21, wherein each of said at least two antenna elements has a different length in the direction perpendicular to the vehicle width direction.

25. A glass antenna according to claim 20, wherein said at least two antenna elements are disposed together above or below said defogger on a same side where said first antenna conductor element is disposed.

26. A glass antenna according to claim 20, wherein said at least two antenna elements are offset in the vehicle width direction with respect to the position where said second antenna conductor element is disposed.

27. A glass antenna according to claim 26, wherein said at least two antenna elements are disposed at positions which are symmetrical to the position where said second antenna conductor element is disposed in the vehicle width direction.

28. A glass antenna according to claim 27, wherein said second antenna conductor element is disposed substantially at the center in the vehicle width direction.

29. A glass antenna according to claim 5, wherein said first antenna conductor element is surrounded by said defogger.

30. A glass antenna according to claim 5, wherein said second antenna conductor element is entirely located in the region into which said defogger wire is extended.

31. A glass antenna according to claim 5, wherein said second antenna conductor element is disposed substantially at the center in the vehicle width direction.

32. A glass antenna according to claim 5, wherein said current feeding point is disposed below or above said defogger.

33. A glass antenna for receiving a TV radio wave having a defogger having a length 2Y in a vehicle width direction and a first antenna conductor element having a length L in the direction perpendicular to the vehicle width direction, each extending on a glass, comprising:

a current feeding point disposed on a region of said glass around said defogger;

said first antenna conductor element to which electric current is fed from said current feeding point and which extends along said glass surface; and a second antenna conductor element which extends upward and downward along said glass surface in a region where said defogger extends and a portion of which is directly coupled to a heating wire of said defogger, wherein, said first antenna conductor element is disposed to said defogger so that said heating wire connected to said portion of said second antenna conductor element is coupled to said first antenna conductor element through capacitive coupling and $$10\ cm \leqq L+\alpha \cdot Y \leqq 60\ cm$$

is satisfied, where $\alpha$ is an antenna shortening ratio by the capacitive coupling.

34. A glass antenna according to claim 33, wherein said first antenna conductor element includes at least two second antenna elements which are spaced apart from each other.

35. A glass antenna according to claim 34, wherein a diversity antenna system is composed by setting a different receiving sensitivity to each of said at least two antenna elements.

36. A glass antenna according to claim 35, wherein each of said at least two antenna elements has a portion connected to a heating wire of said defogger through capacitive coupling and the coupling capacitance thereof is differently set.

37. A glass antenna according to claim 34, wherein said at least two antenna elements are disposed together above or below said defogger on a same side where said first antenna conductor element is disposed.

38. A glass antenna according to claim 34, wherein said second antenna conductor element is disposed substantially at the center in the vehicle width direction.

39. A glass antenna according to claim 33, wherein said current feeding point is disposed below or above said defogger.

40. A glass antenna having a defogger and an antenna conductor extending on a glass surface, comprising:

a current feeding point disposed on a region of said glass around said defogger;

a first antenna conductor element to which electric current is fed from said current feeding point and which extends along said glass surface; and a second antenna conductor element which extends upward and downward along said glass surface in a region where said defogger extends and a portion of which is directly coupled to a heating wire of said defogger, wherein said first antenna conductor element has a length L in a direction perpendicular to a vehicle width direction, said second antenna conductor element has a length X in the direction perpendicular to the vehicle width direction, and said first antenna conductor element is disposed to said defogger so that said heating wire connected to said portion of said second antenna conductor element is coupled to said first antenna conductor element through capacitive coupling as well as $$20\ cm \leqq L+\alpha \cdot X \leqq 70\ cm$$

is established, where $\alpha$ is an antenna shortening ratio by the capacitive coupling.

41. A glass antenna according to claim 40, wherein the length of said first antenna conductor element in a direction perpendicular to the vehicle width direction is set in the range of from 4 cm to 30 cm.

42. A glass antenna according to claim 40, wherein said current feeding point is directly connected to a radio receiver through a feeder cable.

43. A glass antenna according to claim 40, wherein said first antenna conductor element includes at least two second antenna elements which are spaced apart from each other.

44. A glass antenna according to claim 43, wherein said at least two antenna elements are disposed together above or below said defogger on a same side where said first antenna conductor element is disposed.

45. A glass antenna according to claim 43, wherein said at least two antenna elements are offset in the vehicle width direction with respect to the position where said second antenna conductor element is disposed.

46. A glass antenna according to claim 45, wherein said at least two antenna elements are disposed at positions which are symmetrical to the position where said second antenna conductor element is disposed in the vehicle width direction.

47. A glass antenna according to claim 46, wherein said second antenna conductor element is disposed substantially at the center in the vehicle width direction.

48. A glass antenna according to claim 43, wherein a diversity antenna system is composed by setting a different receiving sensitivity to each of said at least two antenna elements.

49. A glass antenna according to claim 48, wherein each of said at least two antenna elements has a portion connected to a heating wire of said defogger through capacitive coupling, and the coupling capacitances thereof are differently set.

50. A glass antenna according to claim 48, wherein said at least two antenna elements have a different length in the vehicle width direction from each other.

51. A glass antenna according to claim 48, wherein said at least two antenna elements have a different length in the direction perpendicular to the vehicle width direction from each other.

52. A glass antenna according to claim 40, wherein said first antenna conductor element is surrounded by said defogger.

53. A glass antenna according to claim 40, wherein said second antenna conductor element is entirely located in a region into which said defogger wire is extended.

54. A glass antenna according to claim 40, wherein a gap between the first antenna conductor element and the heating wire of said defogger connected thereto through capacitive coupling is in the range of from 1 mm to 50 mm.

55. A glass antenna according to claim 54, wherein the gap is in the range of from 2 mm to 35 mm.

56. A glass antenna according to claim 40, wherein said second antenna conductor element is disposed substantially at the center in the vehicle width direction.

57. A glass antenna according to claim 40, wherein said current feeding point is disposed below or above said defogger.

* * * * *